US009854346B2

(12) United States Patent
Adams

(10) Patent No.: US 9,854,346 B2
(45) Date of Patent: Dec. 26, 2017

(54) PROTECTIVE, SOUND ABSORBING, AND/OR DECORATIVE DEVICE FOR COVERING EARPIECE OF HEADPHONES AND/OR EARPHONES

(71) Applicant: NECTAR SOUND LABS, LLC, Lake Forest, CA (US)

(72) Inventor: Erik Devon Adams, Lake Forest, CA (US)

(73) Assignee: Nectar Sound Labs, LLC, Lake Forest, CA (US)

( * ) Notice: Subject to any disclaimer, the term of this patent is extended or adjusted under 35 U.S.C. 154(b) by 31 days.

(21) Appl. No.: 15/154,745

(22) Filed: May 13, 2016

(65) Prior Publication Data

US 2016/0337745 A1 Nov. 17, 2016

Related U.S. Application Data

(60) Provisional application No. 62/161,769, filed on May 14, 2015, provisional application No. 62/161,001, filed on May 13, 2015.

(51) Int. Cl.
*H04R 1/10* (2006.01)
*H04R 3/00* (2006.01)

(52) U.S. Cl.
CPC ..... *H04R 1/1041* (2013.01); *H04R 1/1008* (2013.01); *H04R 1/1058* (2013.01); *H04R 1/1083* (2013.01); *H04R 3/00* (2013.01); *H04R 2499/15* (2013.01)

(58) Field of Classification Search
CPC .. H04R 1/1041; H04R 1/1008; H04R 1/1058; H04R 1/1083; H04R 3/00; H04R 2499/15
See application file for complete search history.

(56) References Cited

U.S. PATENT DOCUMENTS

2013/0272560 A1* 10/2013 Dougherty ..... H04R 1/1066 381/378

* cited by examiner

*Primary Examiner* — Ping Lee
(74) *Attorney, Agent, or Firm* — Knobbe, Martens, Olson & Bear, LLP

(57) ABSTRACT

In some embodiments, a protective, sound absorbing, and/or decorative device and/or a plurality thereof can be attached and/or coupled to one or more earpiece portions of a headphone and/or earphone device. For example, in certain embodiments, one or more caps can be configured to be attached and/or coupled to one or more earpieces of headphones and/or earphones to provide additional protection for the earpiece portion from damage, such as scratches, to provide an additional layer of sound absorbing, and/or to provide means for displaying one or more graphics as determined by a user.

20 Claims, 33 Drawing Sheets

PROTECTIVE, SOUND ABSORBING, AND/OR DECORATIVE DEVICE FOR COVERING EARPIECE OF HEADPHONES AND/OR EARPHONES

CROSS-REFERENCE TO RELATED APPLICATIONS

This application claims the benefit of U.S. Provisional Application No. 62/161,769, filed May 14, 2015, and titled HEADPHONE DEVICE, and U.S. Provisional Application No. No. 62/161,001, filed May 13, 2015, and titled EARPIECE DEVICE WITH ADAPTABLE NECK PORTION. Each of the foregoing applications is hereby incorporated herein by reference in its entirety.

BACKGROUND

Field

The disclosure relates generally to the field of headphones and/or earphones, and more particularly to protective and/or sound absorbing devices for covering one or more earpieces of a headphone and/or earphones.

Description

Headphones and/or earphones have become a popular way to listen to audio, music, or the like. For example, some recent developments in headphone and earphone device technology include devices such as Bluetooth and noise canceling headphone and/or earphone devices. However, one inherent problem with any type of headphone and/or earphone device is that they are prone to scratches and/or other damages. The earpiece portion of a headphone and/or earphone device can be especially sensitive to such damages. Another inherent problem to headphone and/or earphone devices is that unwanted outside noise may be heard by a user of a headphone and/or earphone device. Moreover, sound being produced by a headphone and/or earphone device may also escape the general area, thereby disturbing neighboring persons. Noise canceling headphone and/or earphone devices have set out to resolve such issues, but at a premium price. Furthermore, many headphone and/or earphone devices include a logo, brand, or trademark of the headphone and/or earphone manufacturer on the earpiece. Some users may not wish to display such information and may want to display other graphics instead.

SUMMARY

The disclosure herein provides a protective, sound absorbing, and/or decorative device or cap, and/or a plurality thereof, which can be attached and/or coupled to one or more earpiece portions of a headphone and/or earphone device. For purposes of this summary, certain aspects, advantages, and novel features of the invention are described herein. It is to be understood that not necessarily all such advantages may be achieved in accordance with any particular embodiment of the invention. Thus, for example, those skilled in the art will recognize that the invention may be embodied or carried out in a manner that achieves one advantage or group of advantages as taught herein without necessarily achieving other advantages as may be taught or suggested herein.

In certain embodiments, a protective cap configured to be removably coupled to an earpiece portion of a headphone comprises a base portion comprising an inner surface and an outer surface, wherein the outer further comprises one or more graphics; one or more sidewall portions, wherein the one or more sidewall portions extend from the base portion, wherein the one or more sidewall portions comprises one or more gaps; and one or more locking portions, wherein the one or more locking portions extend from the one or more sidewall portions, and wherein the one or more locking portions are configured to guide the cap to be slid on over the earpiece portion of the headphone.

In some embodiments, a monolithic protective cap configured to be removably coupled to an earpiece portion of a headphone, wherein the earpiece portion comprises a circular façade, comprises a generally circular base portion comprising an inner surface and an outer surface, wherein the outer surface comprises one or more graphics; a base wall portion extending from an outer circumference of the base portion, wherein the base wall portion extends from the base portion at a first angle measured between the base wall portion and the inner surface of the base portion, wherein the first angle is greater than 90 degrees, wherein the base wall portion comprises a fragment of a generally annular shape, and wherein the base wall portion extends from only a fragment of the outer circumference of the base portion, thereby forming a first gap between a first end of the base wall portion and a second end of the base wall portion; a first connecting portion and a second connecting portion, wherein the first and second connecting portions extend from the base wall portion at a second angle measured between an outer surface of the base wall portion and outer surfaces of the first and second connecting portions, wherein the second angle is greater than 90 degrees, wherein the first and second connecting portions comprise fragments of a generally annular shape, and wherein the first and second connecting portions each extend from only a portion of the base wall portion, wherein a first end of the first connecting portion and first end of the second connecting portion form a second gap, wherein a width of the second gap is larger than a width of a headband portion of the headphone as to allow the headband portion to extend from the earpiece portion of the headphone through the second gap, and wherein a third gap is formed by a second end of the first connecting portion and a second end of the second connecting portion, wherein a width of the third gap and a width of the first gap are substantially equal; a first sidewall portion and a second sidewall portion, wherein the first and second sidewall portions are connected to the base wall portion via the first and second connecting portions respectively, wherein the first and second sidewall portions are substantially perpendicular to a plane parallel to the base portion, wherein a first end of the first sidewall portion and a first end of the second sidewall portion form a fourth gap, wherein a width of the fourth gap and the width of the second gap are substantially equal, and wherein a fifth gap is formed by a second end of the first sidewall portion and a second end of the second sidewall portion, wherein a width of the fifth gap and the widths of the first and third gaps are substantially equal; and a first locking portion and a second locking portion, wherein the first and second locking portions extend from the first and second sidewall portions respectively, wherein the first and second locking portions are substantially perpendicular to the first and second sidewall portions, and wherein the first and second locking portions are substantially parallel to the base portion, wherein the first and second locking portions each further comprises: a curved portion, wherein the curved portion comprises a fragment of a generally annular shape, wherein a first end of the curved portion of the first locking portion and a first end of the curved portion of the second locking portion form a sixth gap, wherein a width of the sixth gap is substantially equal to the width of the second and fourth gaps; and a straight portion, wherein the straight portion is elongated from a second end of the curved portion of the first locking portion and a second end of the second locking portion, wherein a first end of the straight portion of the first locking portion and a first end of the straight portion of the second locking portion form a seventh gap, wherein a width of the seventh gap is substantially equal to the widths of the first, third, and fifth gaps, wherein the curved portion and straight portion are configured to allow the cap to be slid on over the earpiece portion of the headphone to protectively cover the earpiece portion, and wherein the curved portion and straight portion of the first and second locking portions comprise a fragment of a generally elongated annular shape, wherein an inner circumference of the generally elongated annular shape is smaller than a circumference of the earpiece of the headphone, thereby maintaining the cap over the earpiece at a substantially constant position with respect to the earpiece, wherein the protective cap is shaped such that a layer of air is formed between the inner surface of the base portion and the earpiece portion of the headphone when the cap is slid onto the earpiece portion, thereby decreasing friction between the cap and the earpiece portion to allow for easy removal and installation of the cap, and thereby preventing damage to the earpiece when removing or installing the cap, wherein the base portion comprises sound absorbing properties, thereby preventing outside noise from entering the earpiece of the headphone and further preventing sound from the headphone from escaping.

In some embodiments, a monolithic protective cap is configured to be slid on over the earpiece portion in a general direction from a top end of the earpiece portion towards a bottom end of the earpiece portion, wherein the top end of the earpiece portion is closer to the headband portion compared to the bottom end of the earpiece portion. In some embodiments, a monolithic protective cap is configured to be slid on over the earpiece portion in a general direction from a bottom end of the earpiece portion towards a top end of the earpiece portion, wherein the top end of the earpiece portion is closer to the headband portion compared to the bottom end of the earpiece portion. In some embodiments, a monolithic protective cap is made of a rigid, plastic material.

In some embodiments, a monolithic protective cap further comprises one or more printed circuit boards. In some embodiments, a base portion of a monolithic protective cap comprises one or more electronic display modules configured to display the one or more graphics. In some embodiments, one or more graphics or one or more features thereof of a monolithic protective cap is configured to change at a speed corresponding to a beats per minute of music being played by the headphone. In some embodiments, a monolithic protective cap comprises one or more input buttons, wherein the one or more input buttons are configured to receive one or more input commands from a user, and wherein the one or more input buttons are further configured to initiate execution of the one or more input commands. In some embodiments, one or more input commands of a monolithic protective cap comprises selecting one of the one or more graphics to be displayed on the base portion. In some embodiments, one or more electronic display modules of a monolithic protective cap comprise an LED display.

In certain embodiments, a monolithic protective cap configured to be removably coupled to an earpiece portion of a headphone, wherein the earpiece portion comprises a circular façade, comprises: a generally circular base portion comprising an inner surface and an outer surface, wherein the outer further comprises one or more graphics; a first sidewall portion and a second sidewall portion, wherein the first and second sidewall portions extend from the base portion, wherein the first and second sidewall portions are substantially perpendicular to the base portion, wherein a first end of the first sidewall portion and a first end of the second sidewall portion form a first gap, and wherein a second end of the first sidewall portion and a second end of the second sidewall portion form a second gap, wherein the first and second sidewall portions each further comprises: a curved portion, wherein the curved portion of the first and second sidewall portions comprises a fragment of a generally annular shape, wherein a first end of the curved portion of the first locking portion and a first end of the curved portion of the second locking portion form the first gap; and a straight portion, wherein the straight portion of the first and second sidewall portions is elongated from a second end of the curved portion of the first sidewall portion and a second end of the second sidewall portion, wherein a first end of the straight portion of the first sidewall portion and a first end of the straight portion of the second sidewall portion form the second gap; and a first locking portion and a second locking portion, wherein the first and second locking portions extend from the first and second sidewall portions respectively, wherein the first and second locking portions are substantially perpendicular to the first and second sidewall portions, and wherein the first and second locking portions are substantially parallel to the base portion, wherein the first and second locking portions each further comprises: a curved portion, wherein the curved portion of the first and second locking portions comprises a fragment of a generally annular shape, wherein a first end of the curved portion of the first locking portion and a first end of the curved portion of the second locking portion form a third gap, wherein a width of the third gap is substantially equal to the width of the first gap; and a straight portion, wherein the straight portion is elongated from a second end of the curved portion of the first locking portion and a second end of the second locking portion, wherein a first end of the straight portion of the first locking portion and a first end of the straight portion of the second locking portion form a fourth gap, wherein a width of the fourth gap is substantially equal to the width of the second gap, wherein the curved portion and straight portion of the first and second locking portions are configured to allow the cap to be slid on over the earpiece portion of the headphone to protectively cover the earpiece portion, and wherein the curved portion and straight portion of the first and second locking portions comprise a fragment of a generally elongated annular shape, wherein an inner circumference of the generally elongated annular shape is smaller than a circumference of the earpiece of the headphone, thereby maintaining the cap over the earpiece at a substantially constant position with respect to the earpiece, wherein the protective cap is shaped such that a layer of air is formed between the inner surface of the base portion and the earpiece portion of the headphone when the cap is slid onto the earpiece portion, thereby decreasing friction between the cap and the earpiece portion to allow for easy removal and installation of the cap, and thereby preventing damage to the earpiece when removing or installing the cap, wherein the base portion comprises sound absorbing properties, thereby preventing outside noise from entering the earpiece of the headphone and further preventing sound from the headphone from escaping.

For purposes of this summary, certain aspects, advantages, and novel features of the invention are described herein. It is to be understood that not necessarily all such advantages may be achieved in accordance with any particular embodiment of the invention. Thus, for example, those skilled in the art will recognize that the invention may be embodied or carried out in a manner that achieves one advantage or group of advantages as taught herein without necessarily achieving other advantages as may be taught or suggested herein

DETAILED DESCRIPTION

Figure 1:
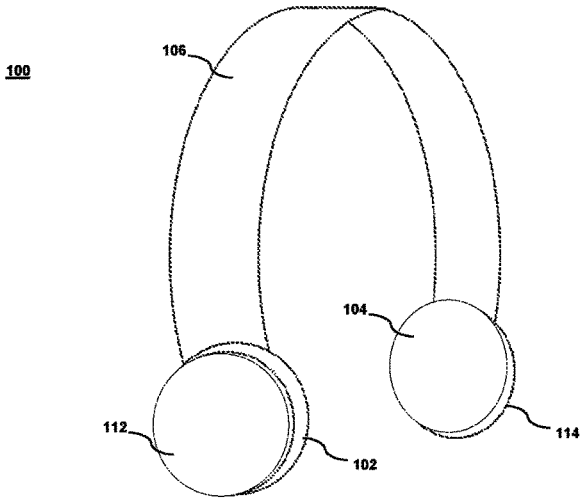
FIG. 1 illustrates an overview of an embodiment of a protective, sound absorbing, and/or decorative device attached to a headphone device.

Although several embodiments, examples, and illustrations are disclosed below, it will be understood by those of ordinary skill in the art that the inventions described herein extend beyond the specifically disclosed embodiments, examples, and illustrations and includes other uses of the inventions and obvious modifications and equivalents thereof. Embodiments of the inventions are described with reference to the accompanying figures, wherein like numerals refer to like elements throughout. The terminology used in the description presented herein is not intended to be interpreted in any limited or restrictive manner simply because it is being used in conjunction with a detailed description of certain specific embodiments of the inventions. In addition, embodiments of the inventions can comprise several novel features and no single feature is solely responsible for its desirable attributes or is essential to practicing the inventions herein described.

Headphone and/or earphone devices have become a widely popular way to enjoy music, watch movies without disturbing others, or the like. Many people carry portable headphone and/or earphone devices with them as well, for example when traveling on a plane, bus, train, or other means of transportation. However, when one carries around his or her headphone and/or earphone device, such devices can become prone to scratches and/or other types of damage. For example, if a user drops his or her headphone and/or earphone device or friction is caused between a headphone and/or earphone device and other objects, scratches can occur. Also, depending on the force exerted on the headphone and/or earphone device, other more serious damage to the device or to electronics thereof can also occur. The earpiece portion of headphone and/or earphone devices can especially be prone to such damages, as they comprise a large portion of such devices. One aspect of the embodiments disclosed herein provides a device for protecting the earpiece portion of headphones and/or earphones, wherein the device can be configured to be removably, semi-permanently, and/or permanently attached and/or coupled to an earpiece portion of headphones and/or earphones, thereby providing a protective cover against damages.

Moreover, when using headphones and/or earphones, issues relating to noise seclusion can arise. For example, in some situations, unwanted outside noise may be heard by a user of a headphone and/or earphone device. Also, in certain situations, some sound produced by a user's headphone and/or earphone device may be heard by other people located nearby. Although noise canceling headphone and earphone devices have been developed to resolve this issue, they are not perfect and are sold at a premium price. As such, another aspect of the embodiments disclosed herein provides a device for absorbing sound, thereby preventing unwanted outside noise from reaching a headphone and/or earphone user and/or preventing sound produced by headphones and/or earphones from escaping to the near vicinity.

Furthermore, most headphone and/or earphone devices being sold in the market include a logo, trademark, or other graphic identifying the manufacturer of the device. For example, the earpiece portions of many headphone and earphone devices include such graphics. However, some users may not wish to display such graphics. Moreover, certain users may want to display other graphics on their headphone and/or earphone devices instead. As such, another aspect of the embodiments disclosed herein provides a device for displaying one or more other graphics on an earpiece portion of headphone and/or earphone devices as determined by a user.

Overview

In some embodiments, a protective, sound absorbing, and/or decorative device or cap, and/or a plurality thereof can be attached and/or coupled to one or more earpiece portions of a headphone and/or earphone device. For example, in certain embodiments, one or more caps can be configured to be attached and/or coupled to one or more earpieces of headphones and/or earphones to provide additional protection for the earpiece portion from damage, such as scratches, to provide an additional layer of sound absorption, and/or to provide means for displaying one or more graphics as determined by a user.

FIG. 1 illustrates an embodiment of one or more protective, sound absorbing, and/or decorative caps attached to a headphone. For example, as depicted in FIG. 1, a headphone device 100 can comprise one or more earpiece portions 102, 104, wherein the one or more earpiece portions are connected to each other via a headband portion 106. In some embodiments, one or more protective, sound absorbing, and/or decorative caps 110, 114 can be attached and/or coupled to the one or more earpiece portions 102, 104 of a headphone device 100, earphones and/or ear buds. In certain embodiments, the one or more earpiece portions 102, 104 of a headphone 100 and/or earphone device can comprise a generally circular shape and/or a circular façade.

In some embodiments, the one or more caps 112, 114 can be configured to be removably, semi-permanently, and/or permanently attached and/or coupled to the one or more earpiece portions 102, 104 of a headphone 100 and/or earphone device. For example, in some embodiments, a cap 112, 114 can be configured to be attached and/or coupled to an earpiece portion 102, 104 of a headphone 100 and/or earphone device via mechanical, magnetic, and/or chemical means to hold the position of the cap 112, 114 substantially constant with respect to the earpiece portion 102, 104 of a headphone 100 and/or earphone device. More specifically, in certain embodiments, a cap 112, 114 can be attached and/or coupled to an earpiece portion 102, 104 of a headphone 100 and/or earphone device via a mechanical locking configuration. For example, in certain embodiments a cap 112, 114 can be configured to be slid onto an earpiece portion 102, 104 of a headphone 100 and/or earphone device in a manner such that one or more grooves present on the cap 112, 114 slide onto and/or lock with one or more existing, pre-existing, and/or newly formed grooves on an exterior of an earpiece portion 102, 104 of a headphone 100 and/or earphone device. In some embodiments, a cap 112, 114 can comprise one or more base portions, base wall portions, connecting portions, sidewall portions, locking portions, and/or any subset thereof, which can further comprise one or more grooves. In certain embodiments, the one or more grooves can be concave and/or convex and/or inward and/or outward. Although various embodiments disclosed herein are described as being slid onto an earpiece, various embodiments may mount in various ways. For example, some embodiments may be similar in design to the embodiments shown in the various figures, but may be sufficiently flexible that they can bend and "snap" into place on the earpiece portion.

In some embodiments, a cap 112, 114 can be configured to be slid onto an earpiece portion 102, 104 of a headphone 100 and/or earphone device from one or more directions. For example, a cap 112, 114 can be configured to be slid down onto an earpiece portion 102, 104 of a headphone 100 and/or earphone device in a general direction from where the headband portion and earpiece portions 102, 104 connect to a bottom end of the earpiece portion 102, 104. Similarly, a cap 112, 114 can be configured to be slid up onto an earpiece portion 102, 104 of a headphone 100 and/or earphone device in a general direction from a bottom end of the earpiece portion 102, 104 to where the headband portion and earpiece portions 102, 104 connect. Also, in some embodiments, a cap 112, 114 can be configured to be slid in a generally left to right and/or right to left direction, wherein the direction is substantially perpendicular to a longitudinal axis that connects the headband portion to an earpiece portion 102, 104 of a headphone 100 and/or earphone device. Further, in certain embodiments, a cap 112, 114 can be configured to slide onto an earpiece portion 102, 104 of a headphone 100 and/or earphone device in a diagonal direction.

In other embodiments, the cap 112, 114 can be configured to snap onto an earpiece portion 102, 104 of a headphone 100 and/or earphone device, whereby one or more locking portions and/or grooves of the cap 112, 114 can be configured to snap onto one or more existing, pre-existing, and/or newly formed grooves and/or other aspect of the exterior surface of an earpiece portion 102 104. In other embodiments, a cap 112, 114 can be stuck onto and/or attached and/or coupled to an earpiece portion 102, 104 of a headphone 100 and/or earphone device via one or more chemical adhesives or glue.

In certain embodiments, the one or more caps 112, 114 can comprise one or more gaps. For example, in some embodiments, a cap 112, 114 can comprise a gap located at the top portion of the cap. In some embodiments, a gap located at the top portion of a cap 112, 114 can comprise a width that is wide enough to allow a headband portion 106 of a headphone device 100 to extend and/or protrude from one or more earpiece portions 102, 104 through said gap. For example, the width of a gap in a cap 112, 114 can be about 0.5 cm, about 1 cm, about 1.5 cm, about 2 cm, about 2.5 cm, about 3 cm, about 3.5 cm, about 4 cm, about 4.5 cm, about 5 cm, about 5.5 cm, about 6 cm, about 6.5 cm, about 7 cm, about 7.5 cm, about 8 cm, about 8.5 cm, about 9 cm, about 9.5 cm, about 10 cm, about 11 cm, about 12 cm, about 13 cm, about 14 cm, 15 cm, 16 cm, 17 cm, about 18 cm, 19 cm, about 20 cm, and/or can be within a range defined by any two of the above identified values. In certain embodiments, the width of the one or more gaps of a cap 112, 114 can be adjustable. For example, in some embodiments, a user can adjust the width of one or more gaps of a cap 112, 114 as to fit the width of a particular headband portion of a headphone device, thereby providing customized strengthened support for maintaining a location of the cap 112, 114 substantially constant over the earpiece portion of the headphone device.

In some embodiments, the one or more caps 112, 114 configured to be coupled to a headphone 100 and/or earphone device or a portion thereof can be made from a material configured to provide a protective layer for the earpiece portion 102, 104. For example, in some embodiments, the cap 112, 114 can provide some protection for the earpiece portions 102, 104 from physical damage, such as scratches or dents, water damage, and/or damage resulting from electromagnetic waves. In certain embodiments, the cap 112, 114 or a portion thereof can be made from a plastic, metallic, rubber, wood, leather, copper, gloss, snake leather, and/or waterproof, sound absorbing, soundproof, sound reflecting, and/or electromagnetic wave insulating material. In certain embodiments, the cap 112, 114 or a portion thereof can be made of a flexible material as to allow easy installation and/or removal. In some embodiments, the cap 112, 114 or a portion thereof can be made a rigid or substantially rigid material.

In certain embodiments, the one or more caps 112, 114 configured to be coupled to a headphone 100 and/or earphone device can comprise a base portion. For example, the base portion can comprise a generally circular, generally elliptical, generally rectangular, and/or generally square shape. In some embodiments, the base portion can comprise one or more surfaces. For example, the base portion can comprise an inner surface and an outer surface. The inner surface or a portion thereof can be configured to face and/or come into contact with the earpiece portion 102, 104. In certain embodiments, the cap 112, 114 can be configured such that a layer of air (e.g., an air gap) is formed between the inner surface or a portion thereof and an exterior surface of an earpiece portion 102, 104. Such layer of air can provide, in some embodiments, a layer of soundproofing, buffer for protection of the earpiece portion 102, 104, and/or decrease friction between the earpiece portion 102, 104 and the cap 112, 114 as to allow for easy removal and/or installation of the one or more caps 112, 114 onto the one or more earpiece portions 102, 104 and/or preventing damage to the earpiece portion 102 while removing and/or installing the one or more caps 112, 114. In some embodiments, including such an air gap may be desirable to, for example, enable optional insertion of an accessory therein. For example, in some embodiments, a layer of sound deadening material may be shaped or configured to be positioned within such an air gap to help decrease an amount of sound being emitted from the headphones to the external environment.

The outer surface of a cap 112, 114, in some embodiments, can comprise one or more graphical displays as to allow such graphics to be viewable when a user is wearing his or her headphone and/or earphone device. For example, the one or more graphical displays can comprise one or more text, logos, drawings, lights, videos, and/or photographs as selected by the user. For example, a user may wish to display text and/or a logo of his or her favorite professional and/or amateur sports team, company, club, and/or association. Alternatively, a user may wish to display his or her name, a family member's name, photograph of him or herself, photograph of his or her family, or the like. Also, a user may wish to display his or her role, nickname, or job. In certain embodiments, the base portion and/or outer surface thereof can be translucent and/or transparent. In some embodiments, the base portion and/or outer surface thereof can comprise an LED, LCD, and/or other display means, as to allow one or more graphical displays to be displayed. For example, the displayed graphics may be configured to change and/or alternate between a select plurality. In certain embodiments, one or more graphical displays and/or lights displayed on the outer surface can be configured to blink, change in intensity, and/or change another parameter, along with the beat and/or other quality of the music being played. For example, one or more graphical displays and/or features thereof being displayed on the outer surface can be configured to change at a speed corresponding to the beats per minute of the music being played by a user via the headphone and/or earphone device.

In some embodiments, the displayed graphics can be configured to be changed, altered, and/or otherwise controlled by a user via a handheld device, such as a smartphone and/or digital music player. In some embodiments, an outer surface can comprise a white board, chalk board, and/or other type of medium that allows a user or other person to write and/or draw. For example, in certain embodiments, a user and/or other person can write his or her own messages onto the outer surface. In some embodiments, the one or more caps 112, 114 can comprise at least one opening and/or at least partially transparent portion that enables a logo or other portion of the earpiece 102, 104 to be seen therethrough. Such an embodiment may be desirable when, for example, a user desires that an existing logo located on the earpiece 102, 104 be shown along with the graphic or other feature shown on the caps 112, 114.

In some embodiments, the one or more caps 112, 114 configured to be coupled to a headphone 100 and/or earphone device can comprise one or more printed circuits. For example, in certain embodiments, a cap 112, 114 can comprise one or more circuits adapted to generate one or more graphical displays, as discussed above.

In certain embodiments, the cap 112, 114 can comprise one or more buttons, sensor touch buttons, pressure buttons, and/or other user interface components configured to initiate one or more commands when selected by a user. For example, in some embodiments, a user can control the headphones and/or one or more electronics embedded in the cap 112, 114 via one or more buttons of the cap 112 114. More specifically, in certain embodiments, the user may be able to turn the headphones on or off, increase or decrease the volume, turn on or off a display on the cap, pause, play, fast-forward, rewind, go to a next track, go back to a previous track, or the like via one or more buttons and/or other input means located on the one or more caps 112, 114. In some embodiments, such input received from a user by the one or more caps 112, 114 can be relayed to one or more electronics of the cap 112 114, headphones, and/or audio source via a printed circuit, wire or cable, and/or wireless connectivity, such as Bluetooth. In certain embodiments, a handheld device can be configured to receive any of the aforementioned commands from a user and relay such to one or more caps 112, 114. In some embodiments, one or more caps 112, 114 may comprise a power source, such as a rechargeable battery, alkaline battery, lithium battery, and/or the like configured to provide power to electrical functions of the caps (e.g., graphical display, button press detection, transmission of wireless control commands over Bluetooth, and/or the like).

In some embodiments, the one or more caps 112, 114 configured to be coupled to a headphone device 100 and/or earphones comprises a monolithic configuration (e.g., one-piece, unitary structure, and/or the like). In other embodiments, one or more portions of a cap 112, 114 can be manufactured separately at first and are molded and/or otherwise connected at a later point in time to form the cap 112, 114 (or may be combined during manufacturing of some components, such as by using insert molding or other processes). For example, the whole cap 112, 114 can all be made of a single type of material in some embodiments. In other embodiments, different portions of the cap 112, 114 can each be made of one or more different materials. More specifically, in some embodiments, a portion of the cap 112, 114, such as the base portion, base wall portion, sidewall portion, connecting portion, locking portion or any combinations thereof can comprise sound absorbing, sound reflecting, soundproof material, printed circuit(s), LED, LCD, while other portions of the cap 112, 114, such as the base portion, base wall portion, sidewall portion, connecting portion, locking portion or any combinations thereof can comprise a plastic and/or metallic material for effectively attaching and/or locking the cap 112, 114 onto an earpiece portion 102, 104.

Embodiment(s) #1

FIGS. 2A-H illustrate different views of an embodiment of a protective, sound absorbing, and/or decorative cap configured to be coupled and/or attached to an earpiece portion of a headphone and/or earphone device. In some embodiments, as shown in FIGS. 2A-H, a protective, sound absorbing, and/or decorative cap 200 can comprise one or more base portions 202, one or more base wall portions 204, one or more connecting portions 206, one or more sidewall portions 208, and/or one or more locking portions 210. In certain embodiments, the one or more base portions 202, base wall portions 204, connecting portions 206, sidewall portions 208, and/or locking portions 210 are formed as a single piece, as to create a cap 200 that is monolithic. In other embodiments, the one or more base portions 202, base wall portions 204, connecting portions 206, sidewall portions 208, locking portions 210, and/or any portion(s) thereof and/or any combination thereof are formed separately first and then attached together to create a single cap 200 (or may be assembled together during production of one or more portion, such as by using insert molding and/or the like).

Base Portion(s)

In some embodiments, the base portion 202 comprises a generally circular shape. In other embodiments, the base portion 202 can comprise a substantially rectangular, substantially square, substantially triangular, substantially pentagonal, substantially hexagonal, and/or any other shape. In certain embodiments, the base portion 202 can comprise a shape that is substantially equal to and/or is a smaller or larger version of a substantially same shape as an earpiece portion of a headphone and/or earphone.

In certain embodiments, the base portion 202 can comprise one or more surfaces. For example, in certain embodiments, the base portion 202 can comprise an inner surface and an outer surface. The inner surface can be configured to oppositely face an exterior surface of an earpiece portion of a headphone and/or earphone device. In some embodiments, the inner surface of a base portion 202 or a portion thereof can come into contact with an outer surface of an earpiece of a headphone and/or earphone when coupled to the headphone and/or earphone device. The outer surface of the base portion 202, in certain embodiments, comprises one or more decorative artwork and/or other graphical display as discussed above.

In some embodiments, the radius of a circular inner surface and/or outer surface of a base portion 202 can be about 1 cm, about 1.1 cm, about 1.2 cm, about 1.3 cm, about 1.4 cm, about 1.5 cm, about 1.6 cm, about 1.7 cm, about 1.8 cm, about 1.9 cm, about 2 cm, about 2.1 cm, about 2.2 cm, about 2.3 cm, about 2.4 cm, about 2.5 cm, about 2.6 cm, about 2.7 cm, about 2.8 cm, about 2.9 cm, about 3 cm, about 3.1 cm, about 3.2 cm, about 3.3 cm, about 3.4 cm, about 3.5 cm, about 3.6 cm, about 3.7 cm, about 3.8 cm, about 3.9 cm, about 4 cm, about 4.1 cm, about 4.2 cm, about 4.3 cm, about 4.4 cm, about 4.5 cm, about 4.6 cm, about 4.7 cm, about 4.8 cm, about 4.9 cm, about 5 cm, about 6 cm, about 7 cm, about 8 cm, about 9 cm, about 10 cm, about 11 cm, about 12 cm, about 13 cm, about 14 cm, about 15 cm, about 16 cm, about 17 cm, about 18 cm, about 19 cm, about 20 cm, and/or within a range defined by two of the aforementioned values.

In certain embodiments, a thickness of the base portion 202 or distance between an outer surface and inner surface thereof can be about 0.1 mm, about 0.2 mm, about 0.3 mm, about 0.4 mm, about 0.5 mm, about 0.6 mm, about 0.7 mm, about 0.8 mm, about 0.9 mm, about 1 mm, about 2 mm, about 3 mm, about 4 mm, about 5 mm, about 6 mm, about 7 mm, about 8 mm, about 9 mm, about 1 cm, about 1.1 cm, about 1.2 cm, about 1.3 cm, about 1.4 cm, about 1.5 cm, about 1.6 cm, about 1.7 cm, about 1.8 cm, about 1.9 cm, about 2 cm, about 2.1 cm, about 2.2 cm, about 2.3 cm, about 2.4 cm, about 2.5 cm, about 2.6 cm, about 2.7 cm, about 2.8 cm, about 2.9 cm, about 3 cm, about 4 cm, about 5 cm, about 6 cm, about 7 cm, about 8 cm, about 9 cm, about 10 cm, and/or within a range defined by any two of the aforementioned values. In some embodiments, a ratio between a radius of an inner and/or outer surface of a base portion 202 and a thickness thereof can be calculated by combining any of the aforementioned values.

Base Wall Portion(s)

In some embodiments, a base wall portion 204 can extend and/or protrude from the base portion 202. In certain embodiments, a base wall portion 204 can extend and/or protrude from the base portion 202 at an angle. An angle 220 measured from the inner surface of the base wall portion 204 and the inner surface of the base portion 202 can be greater than 90° . In certain embodiments, the angle 220 measured from the inner surface of the base wall portion 204 and the inner surface of the base portion 202 can be about 0°, about 10°, about 20°, about 30°, about 40°, about 50°, about 60°, about 70°, about 80°, about 90°, about 100°, about 110°, about 120°, about 130°, about 140°, about 150°, about 160°, about 170°, about 180°, or within a range defined by any of the two above-identified values.

In certain embodiments, the base wall portion 204 comprises a generally annular shape that surrounds the outer circumference of the base portion 202. In some embodiments, the base wall portion 204 comprises one or more circular portions and one or more elongated portions. In certain embodiments, the one or more elongated portions can be substantially straight. For example, the base wall portion 204 can comprise a circular portion and two elongated portions, wherein the two elongated portions connect from each of the two ends of the circular portion.

In some embodiments, the radius of an circular plane which the circular portion of a base wall portion 204 traces and/or substantially traces can be about 1 cm, about 1.1 cm, about 1.2 cm, about 1.3 cm, about 1.4 cm, about 1.5 cm, about 1.6 cm, about 1.7 cm, about 1.8 cm, about 1.9 cm, about 2 cm, about 2.1 cm, about 2.2 cm, about 2.3 cm, about 2.4 cm, about 2.5 cm, about 2.6 cm, about 2.7 cm, about 2.8 cm, about 2.9 cm, about 3 cm, about 3.1 cm, about 3.2 cm, about 3.3 cm, about 3.4 cm, about 3.5 cm, about 3.6 cm, about 3.7 cm, about 3.8 cm, about 3.9 cm, about 4 cm, about 4.1 cm, about 4.2 cm, about 4.3 cm, about 4.4 cm, about 4.5 cm, about 4.6 cm, about 4.7 cm, about 4.8 cm, about 4.9 cm, about 5 cm, about 6 cm, about 7 cm, about 8 cm, about 9 cm, about 10 cm, about 11 cm, about 12 cm, about 13 cm, about 14 cm, about 15 cm, about 16 cm, about 17 cm, about 18 cm, about 19 cm, about 20 cm, and/or within a range defined by two of the aforementioned values.

In certain embodiments, the length of an elongated portion of a base wall portion 204, which extends from the circumference of the circular portion thereof can be about 1 cm, about 1.1 cm, about 1.2 cm, about 1.3 cm, about 1.4 cm, about 1.5 cm, about 1.6 cm, about 1.7 cm, about 1.8 cm, about 1.9 cm, about 2 cm, about 2.1 cm, about 2.2 cm, about 2.3 cm, about 2.4 cm, about 2.5 cm, about 2.6 cm, about 2.7 cm, about 2.8 cm, about 2.9 cm, about 3 cm, about 3.1 cm, about 3.2 cm, about 3.3 cm, about 3.4 cm, about 3.5 cm, about 3.6 cm, about 3.7 cm, about 3.8 cm, about 3.9 cm, about 4 cm, about 4.1 cm, about 4.2 cm, about 4.3 cm, about 4.4 cm, about 4.5 cm, about 4.6 cm, about 4.7 cm, about 4.8 cm, about 4.9 cm, about 5 cm, about 6 cm, about 7 cm, about 8 cm, about 9 cm, about 10 cm, and/or within a range defined by two of the aforementioned values.

In some embodiments, the height of a base wall portion 204 as measured from where the base wall portion 204 connects with a base portion 202 to where the base wall portion 204 connects with another portion, such as for example a connecting portion 206, sidewall portion 206 and/or locking portion 210, can be about 1 cm, about 1.1 cm, about 1.2 cm, about 1.3 cm, about 1.4 cm, about 1.5 cm, about 1.6 cm, about 1.7 cm, about 1.8 cm, about 1.9 cm, about 2 cm, about 2.1 cm, about 2.2 cm, about 2.3 cm, about 2.4 cm, about 2.5 cm, about 2.6 cm, about 2.7 cm, about 2.8 cm, about 2.9 cm, about 3 cm, about 3.1 cm, about 3.2 cm, about 3.3 cm, about 3.4 cm, about 3.5 cm, about 3.6 cm, about 3.7 cm, about 3.8 cm, about 3.9 cm, about 4 cm, about 4.1 cm, about 4.2 cm, about 4.3 cm, about 4.4 cm, about 4.5 cm, about 4.6 cm, about 4.7 cm, about 4.8 cm, about 4.9 cm, about 5 cm, about 6 cm, about 7 cm, about 8 cm, about 9 cm, about 10 cm, and/or within a range defined by two of the aforementioned values.

In some embodiments, a thickness of a base wall portion 204 as measured between an interior surface of the base wall portion 204, wherein the interior surface faces towards the center of the base portion 202, and an exterior surface of the base wall portion 204, wherein the exterior surface faces away from the center of the base portion 202, can be about 0.1 mm, about 0.2 mm, about 0.3 mm, about 0.4 mm, about 0.5 mm, about 0.6 mm, about 0.7 mm, about 0.8 mm, about 0.9 mm, about 1 mm, about 2 mm, about 3 mm, about 4 mm, about 5 mm, about 6 mm, about 7 mm, about 8 mm, about 9 mm, about 1 cm, about 1.1 cm, about 1.2 cm, about 1.3 cm, about 1.4 cm, about 1.5 cm, about 1.6 cm, about 1.7 cm, about 1.8 cm, about 1.9 cm, about 2 cm, about 2.1 cm, about 2.2 cm, about 2.3 cm, about 2.4 cm, about 2.5 cm, about 2.6 cm, about 2.7 cm, about 2.8 cm, about 2.9 cm, about 3 cm, about 4 cm, about 5 cm, about 6 cm, about 7 cm, about 8 cm, about 9 cm, about 10 cm, and/or within a range defined by any two of the aforementioned values. In certain embodiments, the ratio between a circular portion, elongated portion, height, and/or thickness of a base wall portion 204 can be calculated from any of the aforementioned values.

In certain embodiments, the base wall portion 204 extends and/or protrudes from the whole outer circle conference of the base portion 202. In other embodiments, the base wall portion 204 does not encompass the whole outer circumference of the base portion 202 but only extends and/or protrudes from a fragment of the outer circumference of the base portion 202. In other words, in some embodiments, a base wall portion 204 can encompass not the whole 360° of the outer circumference of the base portion 202 but a portion thereof as depicted by angle 222 in FIG. 2A. In certain embodiments, the base wall portion 204 can extend and/or protrude from about 10°, about 20°, about 30°, about 40°, about 50°, about 60°, about 70°, about 80°, about 90°, about 100°, about 110°, about 120°, about 130°, about 140°, about 150°, about 160°, about 170°, about 180°, about 190°, about 200°, about 210°, about 220°, about 230°, about 240°, about 250°, about 260°, about 270°, about 280°, about 290°, about 300°, about 310°, about 320°, about 330°, about 340°, about 350°, about 360° of the outer circumference of the base portion 202. In certain embodiments, the base wall portion 204 can extend and/or protrude from a fragment of the outer circumference of the base portion 202, wherein the fragment can be defined as comprising a portion of the outer circumference of the base portion 202 within a range of degrees defined by any of the two above-identified values.

In some embodiments, a gap can be formed between two or more ends of the base wall portion 204. For example, in certain embodiments, having a gap in the base wall portion 204 can be advantageous for sliding a cap 200 onto an earpiece portion of a headphone and/or earphone device. Further, in some embodiments, a gap in the base wall portion 204 can be advantageous for easily removing and/or sliding on or otherwise attaching the cap onto an earpiece portion of a headphone and/or earphone device. In some embodiments, a width of a gap in the base wall portion 204 can be about 1 cm, about 2 cm, about 3 cm, about 4 cm, about 5 cm, about 6 cm, about 7 cm, about 8 cm, 9 cm, about 10 cm, about 11 cm, about 12 cm, about 13 cm, about 14 cm, 15 cm, 16 cm, 17 cm, about 18 cm, 19 cm, about 20 cm, and/or can be within a range defined by any two of the above-identified values.

Connecting Portion(s)

In certain embodiments, one or more connecting portions 206 further extend and/or protrude from the one or more base wall portions 204. For example, in some embodiments, a cap 200 can comprise one, two, three, four, five, six, seven, eight, nine, or ten connecting portions 206. In certain embodiments, one or more connecting portions 206 can extend and/or protrude from one or more base wall portions 204 at an angle. An angle 224 measured from the outer surface of the one or more connecting portions 206 and the outer surface of the one or more base wall portions 204 can be greater than 90° . In certain embodiments, the angle 224 measured from the inner surface of the one or more connecting portions 206 and the inner surface of the one or more base wall portions 204 can be about 0°, about 10°, about 20°, about 30°, about 40°, about 50°, about 60°, about 70°, about 80°, about 90°, about 100°, about 110°, about 120°, about 130°, about 140°, about 150°, about 160°, about 170°, about 180°, or within a range defined by any of the two above-identified values.

In certain embodiments, the one or more connecting portions 206 comprise a generally annular shape that surrounds the outer circumference of the one or more base wall portions 204. In some embodiments, the one or more connecting portions 206 comprise one or more circular portions and one or more elongated portions. In certain embodiments, the one or more elongated portions can be substantially straight. For example, the one or more connecting portions 206 can comprise one circular portion and one elongated portion, wherein the elongated portion can be connected to the circular portion.

In some embodiments, the radius of an circular plane which the circular portion of a connecting portion 206 traces and/or substantially traces can be about 1 cm, about 1.1 cm, about 1.2 cm, about 1.3 cm, about 1.4 cm, about 1.5 cm, about 1.6 cm, about 1.7 cm, about 1.8 cm, about 1.9 cm, about 2 cm, about 2.1 cm, about 2.2 cm, about 2.3 cm, about 2.4 cm, about 2.5 cm, about 2.6 cm, about 2.7 cm, about 2.8 cm, about 2.9 cm, about 3 cm, about 3.1 cm, about 3.2 cm, about 3.3 cm, about 3.4 cm, about 3.5 cm, about 3.6 cm, about 3.7 cm, about 3.8 cm, about 3.9 cm, about 4 cm, about 4.1 cm, about 4.2 cm, about 4.3 cm, about 4.4 cm, about 4.5 cm, about 4.6 cm, about 4.7 cm, about 4.8 cm, about 4.9 cm, about 5 cm, about 6 cm, about 7 cm, about 8 cm, about 9 cm, about 10 cm, about 11 cm, about 12 cm, about 13 cm, about 14 cm, about 15 cm, about 16 cm, about 17 cm, about 18 cm, about 19 cm, about 20 cm, and/or within a range defined by two of the aforementioned values.

In certain embodiments, the length of an elongated portion of a connecting portion 206, which extends from the circumference of the circular portion thereof can be about 1 cm, about 1.1 cm, about 1.2 cm, about 1.3 cm, about 1.4 cm, about 1.5 cm, about 1.6 cm, about 1.7 cm, about 1.8 cm, about 1.9 cm, about 2 cm, about 2.1 cm, about 2.2 cm, about 2.3 cm, about 2.4 cm, about 2.5 cm, about 2.6 cm, about 2.7 cm, about 2.8 cm, about 2.9 cm, about 3 cm, about 3.1 cm, about 3.2 cm, about 3.3 cm, about 3.4 cm, about 3.5 cm, about 3.6 cm, about 3.7 cm, about 3.8 cm, about 3.9 cm, about 4 cm, about 4.1 cm, about 4.2 cm, about 4.3 cm, about 4.4 cm, about 4.5 cm, about 4.6 cm, about 4.7 cm, about 4.8 cm, about 4.9 cm, about 5 cm, about 6 cm, about 7 cm, about 8 cm, about 9 cm, about 10 cm, and/or within a range defined by two of the aforementioned values.

In some embodiments, the height of a connecting portion 206 as measured from where the connecting portion 206 connects with a base wall portion 204 to where the connecting portion 206 connects with another portion, such as for example a sidewall portion 208 and/or locking portion 210, can be about 1 cm, about 1.1 cm, about 1.2 cm, about 1.3 cm, about 1.4 cm, about 1.5 cm, about 1.6 cm, about 1.7 cm, about 1.8 cm, about 1.9 cm, about 2 cm, about 2.1 cm, about 2.2 cm, about 2.3 cm, about 2.4 cm, about 2.5 cm, about 2.6 cm, about 2.7 cm, about 2.8 cm, about 2.9 cm, about 3 cm, about 3.1 cm, about 3.2 cm, about 3.3 cm, about 3.4 cm, about 3.5 cm, about 3.6 cm, about 3.7 cm, about 3.8 cm, about 3.9 cm, about 4 cm, about 4.1 cm, about 4.2 cm, about 4.3 cm, about 4.4 cm, about 4.5 cm, about 4.6 cm, about 4.7 cm, about 4.8 cm, about 4.9 cm, about 5 cm, about 6 cm, about 7 cm, about 8 cm, about 9 cm, about 10 cm, and/or within a range defined by two of the aforementioned values.

In some embodiments, a thickness of a connecting portion 206 as measured between an interior surface of the connecting portion 206, wherein the interior surface faces towards the center of the base portion 202, and an exterior surface of the connecting portion 206, wherein the exterior surface faces away from the center of the base portion 202, can be about 0.1 mm, about 0.2 mm, about 0.3 mm, about 0.4 mm, about 0.5 mm, about 0.6 mm, about 0.7 mm, about 0.8 mm, about 0.9 mm, about 1 mm, about 2 mm, about 3 mm, about 4 mm, about 5 mm, about 6 mm, about 7 mm, about 8 mm, about 9 mm, about 1 cm, about 1.1 cm, about 1.2 cm, about 1.3 cm, about 1.4 cm, about 1.5 cm, about 1.6 cm, about 1.7 cm, about 1.8 cm, about 1.9 cm, about 2 cm, about 2.1 cm, about 2.2 cm, about 2.3 cm, about 2.4 cm, about 2.5 cm, about 2.6 cm, about 2.7 cm, about 2.8 cm, about 2.9 cm, about 3 cm, about 4 cm, about 5 cm, about 6 cm, about 7 cm, about 8 cm, about 9 cm, about 10 cm, and/or within a range defined by any two of the aforementioned values. In certain embodiments, the ratio between a circular portion, elongated portion, height, and/or thickness of a connecting portion 206 can be calculated from any of the aforementioned values.

In certain embodiments, the one or more connecting portions 206 extend and/or protrude from the whole outer rim of the one or more base wall portions 204. In other embodiments, the one or more connecting portions 206 do not encompass the whole rim of the base wall portion 204 but only extends and/or protrudes from a fragment of the rim of the base wall portion 204. For example, in some embodiments, the one or more connecting portions 206 can extend and/or protrude from about 10°, about 20°, about 30°, about 40°, about 50°, about 60°, about 70°, about 80°, about 90°, about 100°, about 110°, about 120°, about 130°, about 140°, about 150°, about 160°, about 170°, about 180°, about 190°, about 200°, about 210°, about 220°, about 230°, about 240°, about 250°, about 260°, about 270°, about 280°, about 290°, about 300°, about 310°, about 320°, about 330°, about 340°, about 350°, about 360° of the rim of the base wall portion 204. In certain embodiments, the one or more connecting portions 206 can extend and/or protrude from a fragment of the rim of the base wall portion 204, wherein the fragment can be defined as comprising a portion of the rim of the base wall portion 204 within a range of degrees defined by any of the two above identified values.

In some embodiments, one or more gaps can be formed between two or more ends of the one or more connecting portions 206. For example, in certain embodiments, one, two, three, four, five, six, seven, eight, nine, or ten gaps can be formed between two or more ends of one or more connecting portions 206. In certain embodiments, a first gap can formed between a first end of a first connecting portion 206 and a first end of a second connecting portion 206. In some embodiments, a head band portion of a headphone device can be configured to extend from one or more earpiece portions of a headphone device through this first gap. For example, in certain embodiments a width of this first gap can be larger than a width of a headband portion of a headphone device as to allow the headband portion to extend through the first gap. In some embodiments, a width of a first gap of the one or more connecting portions 206 can be about 1 cm, about 2 cm, about 3 cm, about 4 cm, about 5 cm, about 6 cm, about 7 cm, about 8 cm, 9 cm, about 10 cm, about 11 cm, about 12 cm, about 13 cm, about 14 cm, 15 cm, 16 cm, 17 cm, about 18 cm, 19 cm, about 20 cm, and/or can be within a range defined by any two of the above identified values.

In some embodiments, a second gap can be formed between a second end of a first connecting portion 206 and a second end of a second connecting portion 206. In certain embodiments, having a second gap in the one or more connecting portions 206 can be advantageous for sliding a cap 200 onto an earpiece portion of a headphone and/or earphone device. Further, in some embodiments, a second gap in the one or more connecting portions 206 can be advantageous for easily removing and/or sliding on or otherwise attaching the cap 200 onto an earpiece portion of a headphone and/or earphone device. In certain embodiments, a width of a gap and/or the second gap of a connecting portion 206 can be substantially equal to a width of a gap of the base wall portion 204. In some embodiments, a width of a second gap of the one or more connecting portions can be about 1 cm, about 2 cm, about 3 cm, about 4 cm, about 5 cm, about 6 cm, about 7 cm, about 8 cm, 9 cm, about 10 cm, about 11 cm, about 12 cm, about 13 cm, about 14 cm, 15 cm, 16 cm, 17 cm, about 18 cm, 19 cm, about 20 cm, and/or can be within a range defined by any two of the above identified values.

Sidewall Portion(s)

In certain embodiments, one or more sidewall portions 208 further extend and/or protrude from the one or more connecting portions 206. For example, in some embodiments, a cap 200 can comprise one, two, three, four, five, six, seven, eight, nine, or ten sidewall portions 208. In some embodiments, one or more connecting portions 206 are configured to connect the one or more sidewall portions 208 to one or more base wall portions 204. In certain embodiments, one or more sidewall portions 208 can extend and/or protrude from one or more connecting portions 206 at an angle. An angle measured from the inner surface of the one or more sidewall portions 208 and an imaginary plane drawn to be parallel to the base portion 202 can be substantially 90° in some embodiments. In certain embodiments, an angle 226 measured from the inner surface of the one or more sidewall portions 208 and the inner surface of the one or more connecting portions 206 can be about 0°, about 10°, about 20°, about 30°, about 40°, about 50°, about 60°, about 70°, about 80°, about 90°, about 100°, about 110°, about 120°, about 130°, about 140°, about 150°, about 160°, about 170°, about 180°, or within a range defined by any of the two above-identified values.

In certain embodiments, the one or more sidewall portions 208 comprise a generally annular shape that surrounds the outer circumference of the one or more connecting portions 206. In some embodiments, the one or more sidewall portions 208 comprise one or more circular portions and one or more elongated portions. In certain embodiments, the one or more elongated portions can be substantially straight. For example, the one or more sidewall portions 208 can each comprise one circular portion and one elongated portion, wherein the elongated portion can be each connected to the circular portion.

In some embodiments, the radius of an circular plane which the circular portion of a sidewall portion 208 traces and/or substantially traces can be about 1 cm, about 1.1 cm, about 1.2 cm, about 1.3 cm, about 1.4 cm, about 1.5 cm, about 1.6 cm, about 1.7 cm, about 1.8 cm, about 1.9 cm, about 2 cm, about 2.1 cm, about 2.2 cm, about 2.3 cm, about 2.4 cm, about 2.5 cm, about 2.6 cm, about 2.7 cm, about 2.8 cm, about 2.9 cm, about 3 cm, about 3.1 cm, about 3.2 cm, about 3.3 cm, about 3.4 cm, about 3.5 cm, about 3.6 cm, about 3.7 cm, about 3.8 cm, about 3.9 cm, about 4 cm, about 4.1 cm, about 4.2 cm, about 4.3 cm, about 4.4 cm, about 4.5 cm, about 4.6 cm, about 4.7 cm, about 4.8 cm, about 4.9 cm, about 5 cm, about 6 cm, about 7 cm, about 8 cm, about 9 cm, about 10 cm, about 11 cm, about 12 cm, about 13cm, about 14 cm, about 15 cm, about 16 cm, about 17 cm, about 18 cm, about 19 cm, about 20 cm, and/or within a range defined by two of the aforementioned values.

In certain embodiments, the length of an elongated portion of a sidewall portion 208, which extends from the circumference of the circular portion thereof can be about 1 cm, about 1.1 cm, about 1.2 cm, about 1.3 cm, about 1.4 cm, about 1.5 cm, about 1.6 cm, about 1.7 cm, about 1.8 cm, about 1.9 cm, about 2 cm, about 2.1 cm, about 2.2 cm, about 2.3 cm, about 2.4 cm, about 2.5 cm, about 2.6 cm, about 2.7 cm, about 2.8 cm, about 2.9 cm, about 3 cm, about 3.1 cm, about 3.2 cm, about 3.3 cm, about 3.4 cm, about 3.5 cm, about 3.6 cm, about 3.7 cm, about 3.8 cm, about 3.9 cm, about 4 cm, about 4.1 cm, about 4.2 cm, about 4.3 cm, about 4.4 cm, about 4.5 cm, about 4.6 cm, about 4.7 cm, about 4.8 cm, about 4.9 cm, about 5 cm, about 6 cm, about 7 cm, about 8 cm, about 9 cm, about 10 cm, and/or within a range defined by two of the aforementioned values.

In some embodiments, the height of a sidewall portion 208 as measured from where the sidewall portion 204 connects with another portion, such as for example a connecting portion 206, base wall portion 204, base portion 202, and/or locking portion 210, to where the sidewall portion 204 connects with another portion of the like can be about 1 cm, about 1.1 cm, about 1.2 cm, about 1.3 cm, about 1.4 cm, about 1.5 cm, about 1.6 cm, about 1.7 cm, about 1.8 cm, about 1.9 cm, about 2 cm, about 2.1 cm, about 2.2 cm, about 2.3 cm, about 2.4 cm, about 2.5 cm, about 2.6 cm, about 2.7 cm, about 2.8 cm, about 2.9 cm, about 3 cm, about 3.1 cm, about 3.2 cm, about 3.3 cm, about 3.4 cm, about 3.5 cm, about 3.6 cm, about 3.7 cm, about 3.8 cm, about 3.9 cm, about 4 cm, about 4.1 cm, about 4.2 cm, about 4.3 cm, about 4.4 cm, about 4.5 cm, about 4.6 cm, about 4.7 cm, about 4.8 cm, about 4.9 cm, about 5 cm, about 6 cm, about 7 cm, about 8 cm, about 9 cm, about 10 cm, and/or within a range defined by two of the aforementioned values.

In some embodiments, a thickness of a sidewall portion 208 as measured between an interior surface of the base wall portion 208, wherein the interior surface faces towards the center of the base portion 202, and an exterior surface of the sidewall portion 208, wherein the exterior surface faces away from the center of the base portion 202, can be about 0.1 mm, about 0.2 mm, about 0.3 mm, about 0.4 mm, about 0.5 mm, about 0.6 mm, about 0.7 mm, about 0.8 mm, about 0.9 mm, about 1 mm, about 2 mm, about 3 mm, about 4 mm, about 5 mm, about 6 mm, about 7 mm, about 8 mm, about 9 mm, about 1 cm, about 1.1 cm, about 1.2 cm, about 1.3 cm, about 1.4 cm, about 1.5 cm, about 1.6 cm, about 1.7 cm, about 1.8 cm, about 1.9 cm, about 2 cm, about 2.1 cm, about 2.2 cm, about 2.3 cm, about 2.4 cm, about 2.5 cm, about 2.6 cm, about 2.7 cm, about 2.8 cm, about 2.9 cm, about 3 cm, about 4 cm, about 5 cm, about 6 cm, about 7 cm, about 8 cm, about 9 cm, about 10 cm, and/or within a range defined by any two of the aforementioned values. In certain embodiments, the ratio between a circular portion, elongated portion, height, and/or thickness of a sidewall portion 208 can be calculated from any of the aforementioned values.

In certain embodiments, the one or more sidewall portions 208 extend and/or protrude from the whole outer rim of the one or more connecting portions 206. In other embodiments, the one or more sidewall portions 208 do not encompass the whole rim of the one or more connecting portions 206 but only extends and/or protrudes from a fragment thereof. For example, in some embodiments, the one or more sidewall portions 208 can extend and/or protrude from about 10°, about 20°, about 30°, about 40°, about 50°, about 60°, about 70°, about 80°, about 90°, about 100°, about 110°, about 120°, about 130°, about 140°, about 150°, about 160°, about 170°, about 180°, about 190°, about 200°, about 210°, about 220°, about 230°, about 240°, about 250°, about 260°, about 270°, about 280°, about 290°, about 300°, about 310°, about 320°, about 330°, about 340°, about 350°, about 360° of the rim of the one or more connecting portions 206. In certain embodiments, the one or more sidewall portions 208 can extend and/or protrude from a fragment of the rim of the one or more connecting portions 206, wherein the fragment can be defined as comprising a portion of the rim of the one or more connecting portions 206 within a range of degrees defined by any of the two above-identified values.

In some embodiments, one or more gaps can be formed between two or more ends of the one or more sidewall portions 208. For example, in certain embodiments, one, two, three, four, five, six, seven, eight, nine, or ten gaps can be formed between two or more ends of one or more sidewall portions 208. In certain embodiments, a first gap can formed between a first end of a first sidewall portion 208 and a first end of a second sidewall portion 208. In some embodiments, a headband portion of a headphone device can be configured to extend from one or more earpiece portions of a headphone device through this first gap. For example, in certain embodiments a width of this first gap can be larger than a width of a headband portion of a headphone device as to allow the headband portion to extend through the first gap. In some embodiments, a width of a first gap of the one or more sidewall portions 208 can be about 1 cm, about 2 cm, about 3 cm, about 4 cm, about 5 cm, about 6 cm, about 7 cm, about 8 cm, 9 cm, about 10 cm, about 11 cm, about 12 cm, about 13 cm, about 14 cm, 15 cm, 16 cm, 17 cm, about 18 cm, 19 cm, about 20 cm, and/or can be within a range defined by any two of the above-identified values. In certain embodiments, a width of a gap or first gap of one or more sidewall portions 208 can be substantially equal to a width of a gap or first gap of one or more connecting portions 206.

In some embodiments, a second gap can be formed between a second end of a first sidewall portion 208 and a second and of a second sidewall portion 208. In certain embodiments, having a second gap in the one or more sidewall portions 208 can be advantageous for sliding a cap 200 onto an earpiece portion of a headphone and/or earphone device. Further, in some embodiments, a second gap in the one or more sidewall portions 208 can be advantageous for easily removing and/or sliding on or otherwise attaching the cap 200 onto an earpiece portion of a headphone and/or earphone device. In certain embodiments, a width of a gap or the second gap of the one or more sidewall portions 208 can be substantially equal to a width of a gap of one or more base wall portions 204 and/or a width of a gap or second gap of one or more connecting portions 206. In some embodiments, a width of a second gap of the one or more sidewall portions 208 can be about 1 cm, about 2 cm, about 3 cm, about 4 cm, about 5 cm, about 6 cm, about 7 cm, about 8 cm, 9 cm, about 10 cm, about 11 cm, about 12 cm, about 13 cm, about 14 cm, 15 cm, 16 cm, 17 cm, about 18 cm, 19 cm, about 20 cm, and/or can be within a range defined by any two of the above-identified values.

Locking Portion(s)

In certain embodiments, one or more locking portions 210 (e.g., protruding members, tabs, latches, and/or the like) further extend and/or protrude from the one or more sidewall portions 208. For example, in some embodiments, a cap 200 can comprise one, two, three, four, five, six, seven, eight, nine, or ten locking portions 210. In certain embodiments, one or more locking portions 210 can extend and/or protrude from one or more sidewall portions 208 at an angle. An angle 228 measured from the inner surface of the one or more locking portions 210 and an inner surface of the one or more sidewall portions 208 can be substantially 90° in some embodiments. In certain embodiments, an angle 228 measured from the inner surface of the one or more locking portions 210 and the inner surface of the one or more sidewall portions 208 can be about 0°, about 10°, about 20°, about 30°, about 40°, about 50°, about 60°, about 70°, about 80°, about 90°, about 100°, about 110°, about 120°, about 130°, about 140°, about 150°, about 160°, about 170°, about 180°, or within a range defined by any of the two above-identified values.

In certain embodiments, the one or more locking portions 210 comprise a generally annular shape that surrounds the outer circumference of the one or more sidewall portions 208. In some embodiments, each of the one or more locking portions 210 comprises one or more circular portions and one or more elongated portions. In certain embodiments, the one or more elongated portions can be substantially straight. For example, each of the one or more locking portions 210 can comprise a circular portion and one elongated portion, wherein the elongated portion can be connected to the circular portion.

In some embodiments, the radius of an circular plane which the circular portion of a locking portion 210 traces and/or substantially traces can be about 1 cm, about 1.1 cm, about 1.2 cm, about 1.3 cm, about 1.4 cm, about 1.5 cm, about 1.6 cm, about 1.7 cm, about 1.8 cm, about 1.9 cm, about 2 cm, about 2.1 cm, about 2.2 cm, about 2.3 cm, about 2.4 cm, about 2.5 cm, about 2.6 cm, about 2.7 cm, about 2.8 cm, about 2.9 cm, about 3 cm, about 3.1 cm, about 3.2 cm, about 3.3 cm, about 3.4 cm, about 3.5 cm, about 3.6 cm, about 3.7 cm, about 3.8 cm, about 3.9 cm, about 4 cm, about 4.1 cm, about 4.2 cm, about 4.3 cm, about 4.4 cm, about 4.5 cm, about 4.6 cm, about 4.7 cm, about 4.8 cm, about 4.9 cm, about 5 cm, about 6 cm, about 7 cm, about 8 cm, about 9 cm, about 10 cm, about 11 cm, about 12 cm, about 13 cm, about 14 cm, about 15 cm, about 16 cm, about 17 cm, about 18 cm, about 19 cm, about 20 cm, and/or within a range defined by two of the aforementioned values.

In certain embodiments, the length of an elongated portion of a locking portion 210, which extends from the circumference of the circular portion thereof can be about 1 cm, about 1.1 cm, about 1.2 cm, about 1.3 cm, about 1.4 cm, about 1.5 cm, about 1.6 cm, about 1.7 cm, about 1.8 cm, about 1.9 cm, about 2 cm, about 2.1 cm, about 2.2 cm, about 2.3 cm, about 2.4 cm, about 2.5 cm, about 2.6 cm, about 2.7 cm, about 2.8 cm, about 2.9 cm, about 3 cm, about 3.1 cm, about 3.2 cm, about 3.3 cm, about 3.4 cm, about 3.5 cm, about 3.6 cm, about 3.7 cm, about 3.8 cm, about 3.9 cm, about 4 cm, about 4.1 cm, about 4.2 cm, about 4.3 cm, about 4.4 cm, about 4.5 cm, about 4.6 cm, about 4.7 cm, about 4.8 cm, about 4.9 cm, about 5 cm, about 6 cm, about 7 cm, about 8 cm, about 9 cm, about 10 cm, and/or within a range defined by two of the aforementioned values.

In some embodiments, a thickness of a locking portion 210 as measured between an interior surface of the locking portion 210, wherein the interior surface faces towards the base portion 202, and an exterior surface of the locking portion 210, wherein the exterior surface faces away from the base portion 202, can be about 0.1 mm, about 0.2 mm, about 0.3 mm, about 0.4 mm, about 0.5 mm, about 0.6 mm, about 0.7 mm, about 0.8 mm, about 0.9 mm, about 1 mm, about 2 mm, about 3 mm, about 4 mm, about 5 mm, about 6 mm, about 7 mm, about 8 mm, about 9 mm, about 1 cm, about 1.1 cm, about 1.2 cm, about 1.3 cm, about 1.4 cm, about 1.5 cm, about 1.6 cm, about 1.7 cm, about 1.8 cm, about 1.9 cm, about 2 cm, about 2.1 cm, about 2.2 cm, about 2.3 cm, about 2.4 cm, about 2.5 cm, about 2.6 cm, about 2.7 cm, about 2.8 cm, about 2.9 cm, about 3 cm, about 4 cm, about 5 cm, about 6 cm, about 7 cm, about 8 cm, about 9 cm, about 10 cm, and/or within a range defined by any two of the aforementioned values. In certain embodiments, the ratio between a circular portion, elongated portion, and/or thickness of a sidewall portion 208 can be calculated from any of the aforementioned values. Moreover, in some embodiments, the ratio between any parameter identified herein of the base portion 202, base wall portion 204, connecting portion 206, sidewall portion 208, and/or locking portion 210 can be calculated from any of the values identified herein.

In certain embodiments, the one or more locking portions 210 extend and/or protrude from the whole outer rim of the one or more sidewall portions 208. In other embodiments, the one or more locking portions 210 do not encompass the whole rim of the one or more sidewall portions 208 but only extends and/or protrudes from a fragment thereof. For example, in some embodiments, the one or more locking portions 210 can extend and/or protrude from about 10°, about 20°, about 30°, about 40°, about 50°, about 60°, about 70°, about 80°, about 90°, about 100°, about 110°, about 120°, about 130°, about 140°, about 150°, about 160°, about 170°, about 180°, about 190°, about 200°, about 210°, about 220°, about 230°, about 240°, about 250°, about 260°, about 270°, about 280°, about 290°, about 300°, about 310°, about 320°, about 330°, about 340°, about 350°, about 360° of the rim of the one or more sidewall portions 208. In certain embodiments, the one or more locking portions 210 can extend and/or protrude from a fragment of the rim of the one or more sidewall portions 208, wherein the fragment can be defined as comprising a portion of the rim of the one or more sidewall portions 208 within a range of degrees defined by any of the two above-identified values.

In some embodiments, one or more gaps can be formed between two or more ends of the one or more locking portions 210. For example, in certain embodiments, one, two, three, four, five, six, seven, eight, nine, or ten gaps can be formed between two or more ends of one or more locking portions 210. In certain embodiments, a first gap can formed between a first end of a first locking portion 210 and a first end of a second locking portion 210. In some embodiments, a headband portion of a headphone device can be configured to extend from one or more earpiece portions of a headphone device through this first gap. For example, in certain embodiments a width of this first gap can be larger than a width of a headband portion of a headphone device as to allow such had been portion to extend through this first gap. In some embodiments, a width of a first gap of the one or more locking portions 210 can be about 1 cm, about 2 cm, about 3 cm, about 4 cm, about 5 cm, about 6 cm, about 7 cm, about 8 cm, 9 cm, about 10 cm, about 11 cm, about 12 cm, about 13 cm, about 14 cm, 15 cm, 16 cm, 17 cm, about 18 cm, 19 cm, about 20 cm, and/or can be within a range defined by any two of the above-identified values. In certain embodiments, a width of a gap or first gap of one or more locking portions 210 can be substantially equal to a width of a gap or first gap of one or more sidewall portions 208 and/or a gap or first gap of one or more connecting portions 206.

In some embodiments, a second gap can be formed between a second end of a first locking portion 210 and a second and of a second locking portion 210. In certain embodiments, having the second gap of the one or more locking portions 210 can be advantageous for sliding a cap 200 onto an earpiece portion of a headphone and/or earphone device. Further, in some embodiments, a second gap in the one or more locking portions 210 can be advantageous for easily removing and/or sliding on or otherwise attaching the cap onto an earpiece portion of a headphone and/or earphone device. In certain embodiments, a width of a gap and/or the second gap of one or more locking portions 210 can be substantially equal to a width of a gap or a second gap of the one or more sidewall portions 208, a gap of the base wall portion 204 and/or a width of a gap or second gap of one or more connecting portions 206. In some embodiments, a width of a second gap of one or more locking portions 210 can be about 1 cm, about 2 cm, about 3 cm, about 4 cm, about 5 cm, about 6 cm, about 7 cm, about 8 cm, 9 cm, about 10 cm, about 11 cm, about 12 cm, about 13 cm, about 14 cm, 15 cm, 16 cm, 17 cm, about 18 cm, 19 cm, about 20 cm, and/or can be within a range defined by any two of the above-identified values.

Figure 2A:
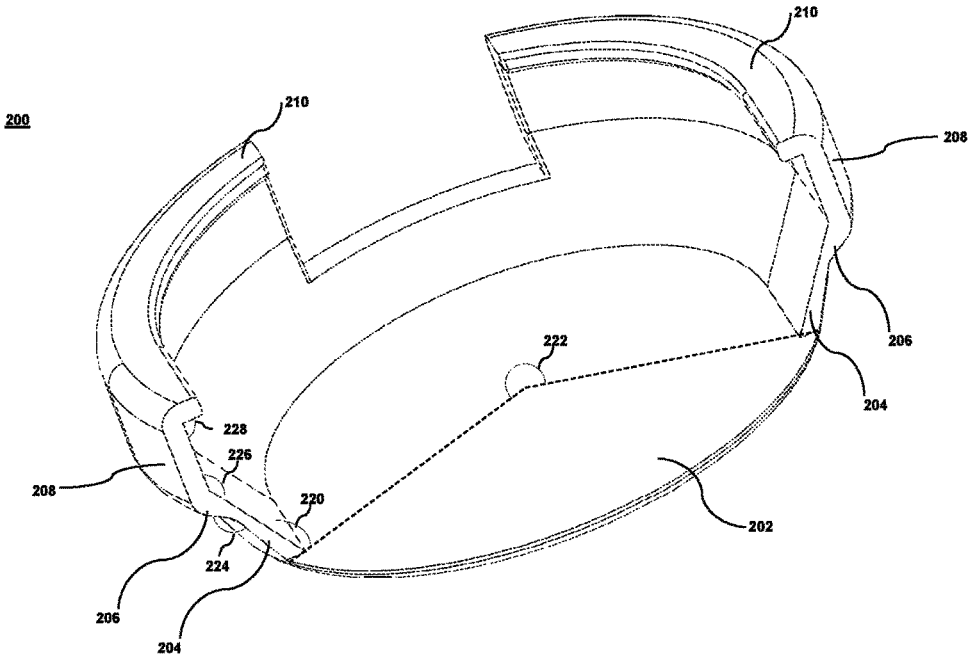
FIGS. 2A-H illustrate an embodiment of a protective, sound absorbing, and/or decorative device configured to be attached to an earpiece portion of a headphone and/or earphone device.
Figure 2B:
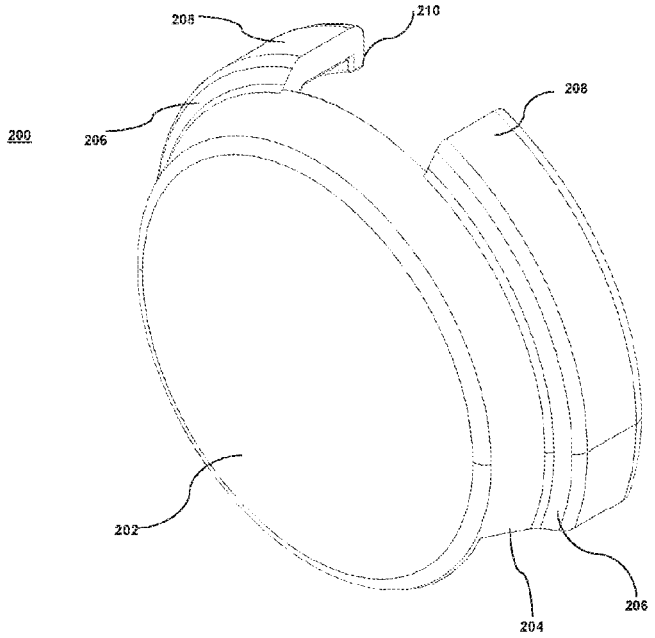
Figure 2C:
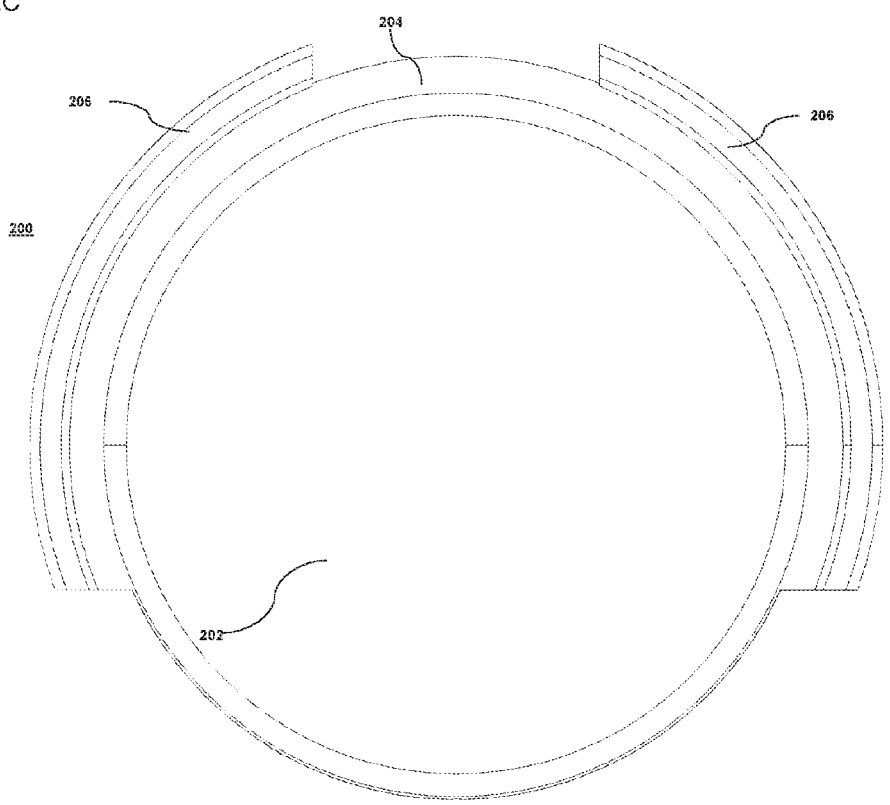
Figure 2D:
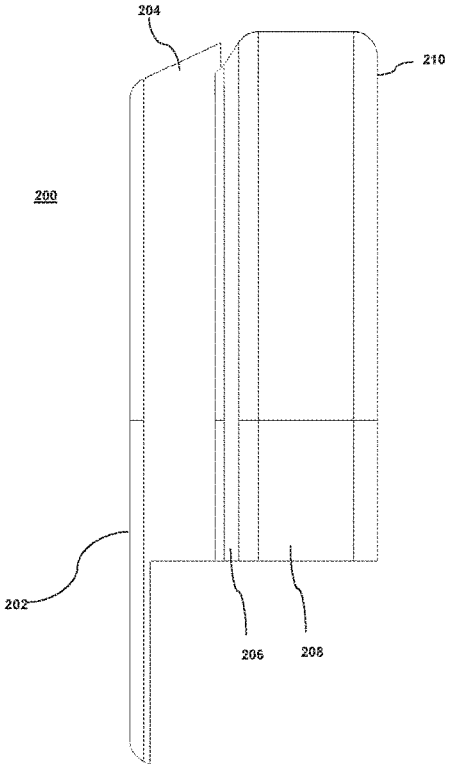
Figure 2E:
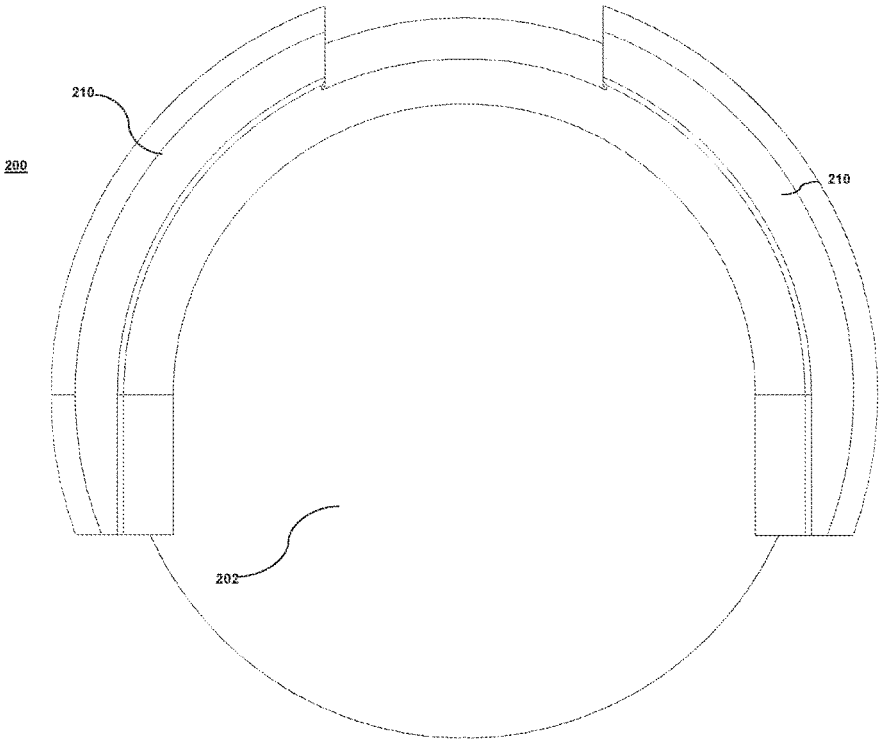
Figure 2F:
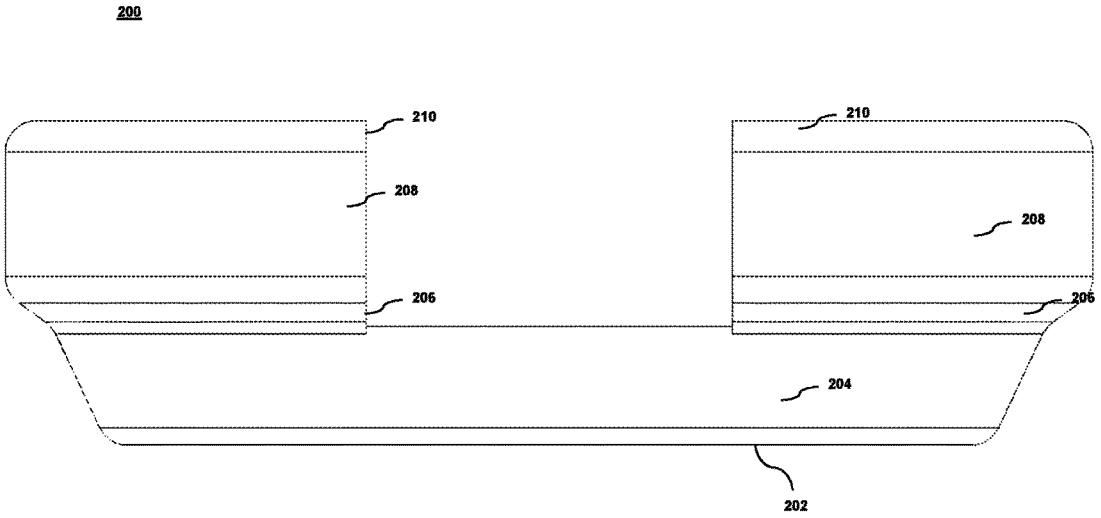
Figure 2G:
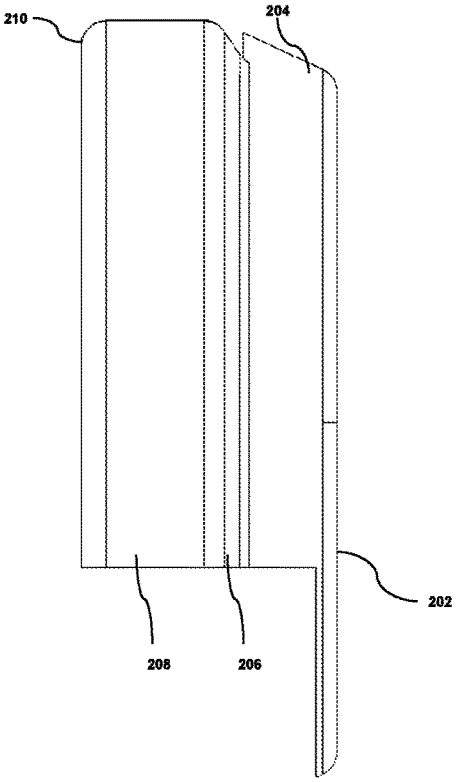
Figure 2H:
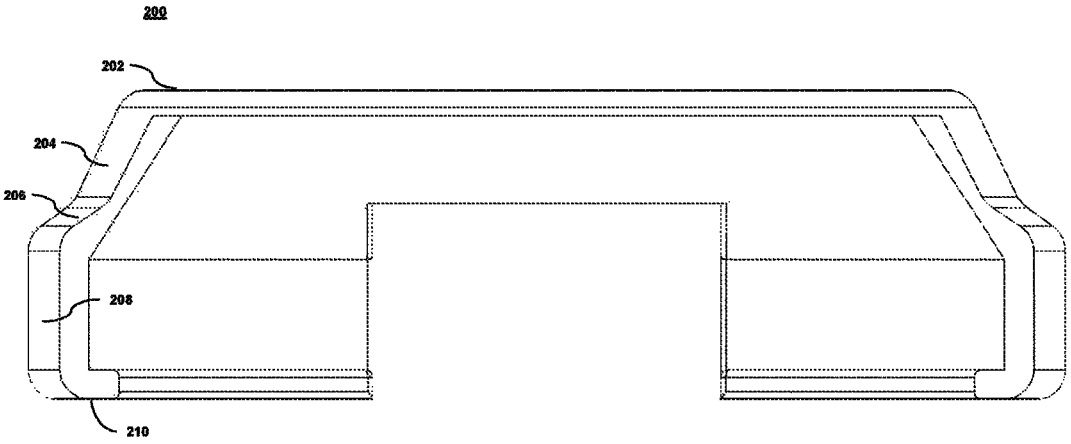
Figure 2I:
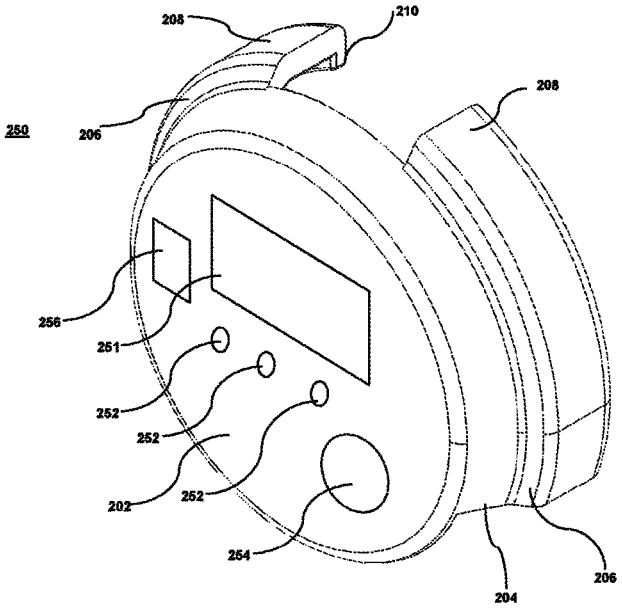
FIG. 2I illustrates an embodiment of a protective, sound absorbing, and/or decorative device configured to be attached to an earpiece portion of a headphone and/or earphone device.
Figure 3A:
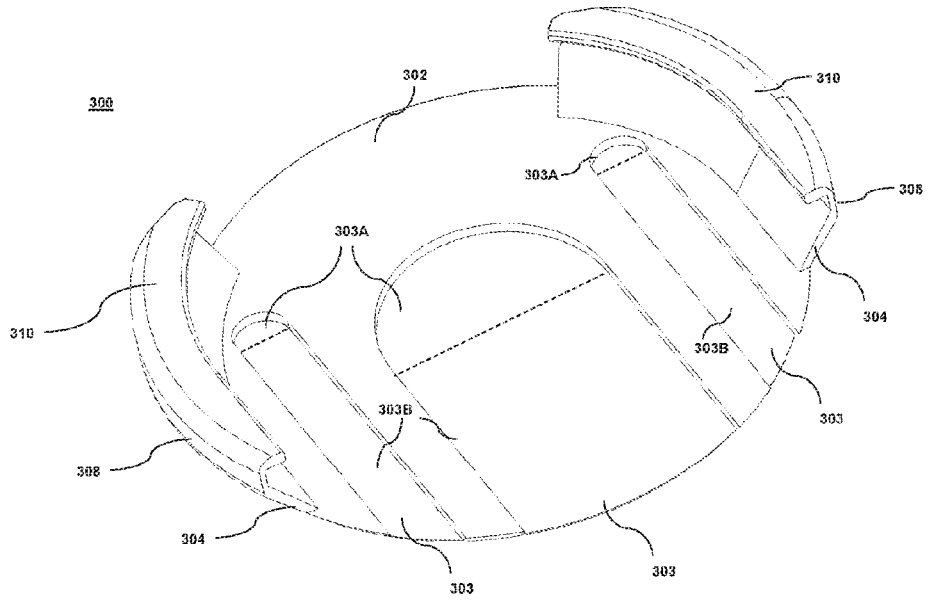
FIGS. 3A-H illustrate an embodiment of a protective, sound absorbing, and/or decorative device configured to be attached to an earpiece portion of a headphone and/or earphone device.
Figure 3B:
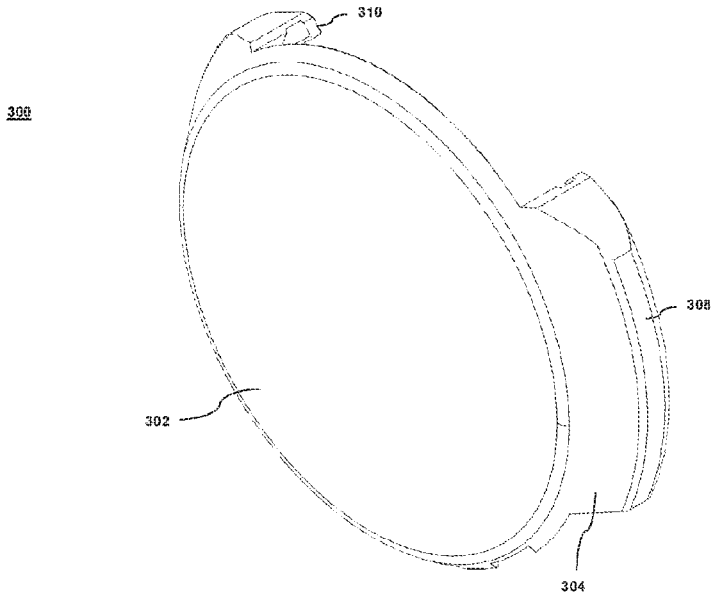
Figure 3C:
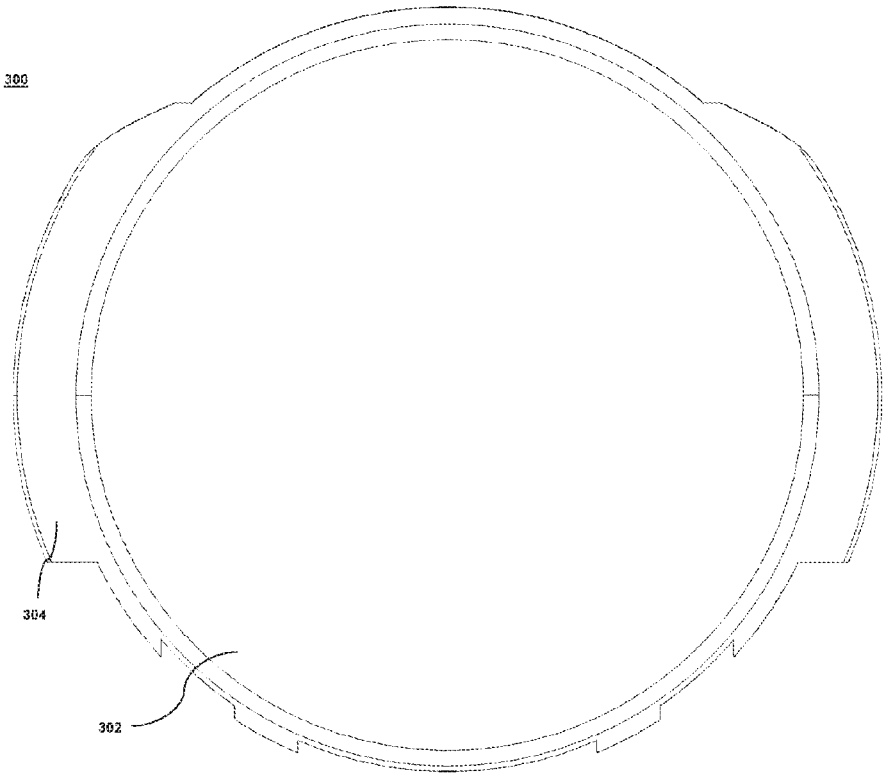
Figure 3D:
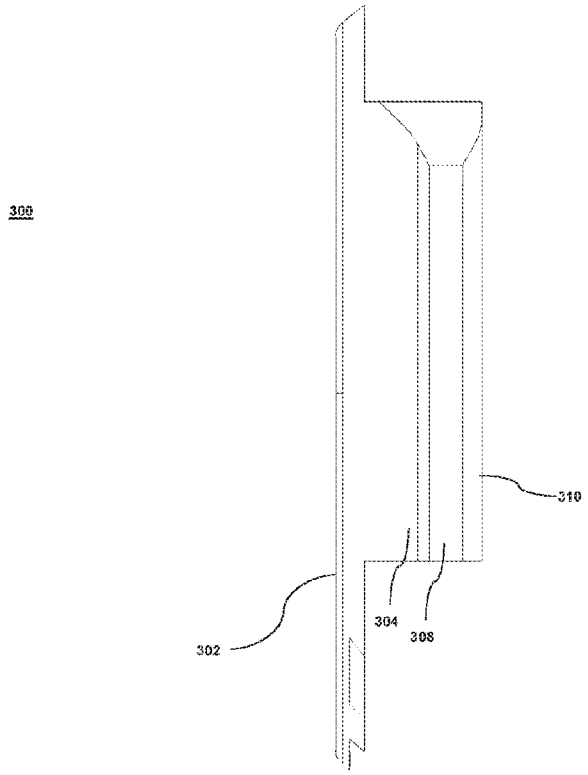
Figure 3E:
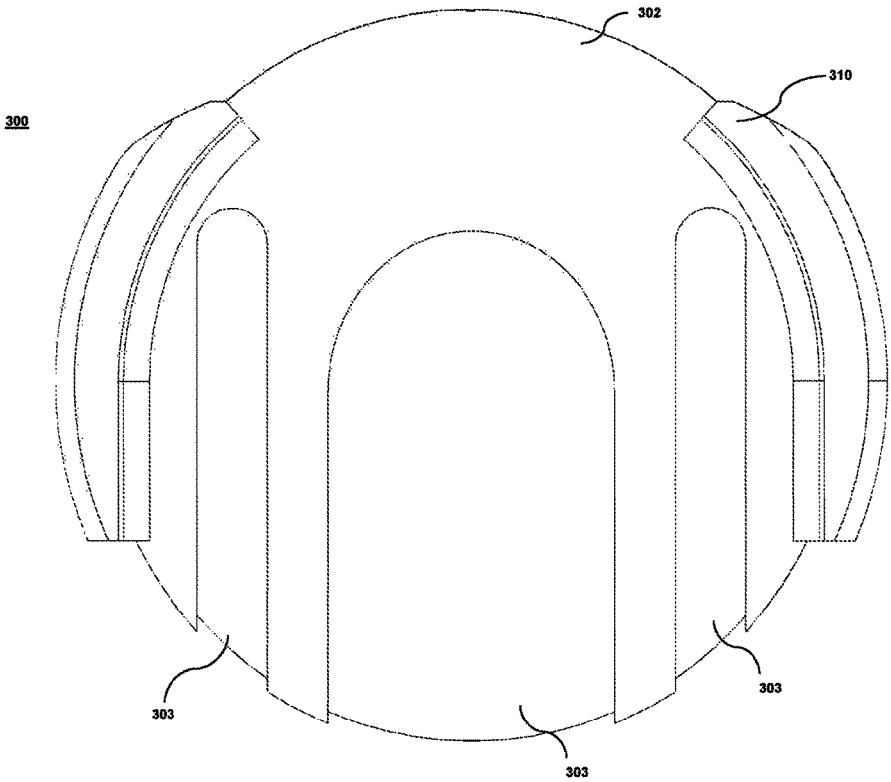
Figure 3F:
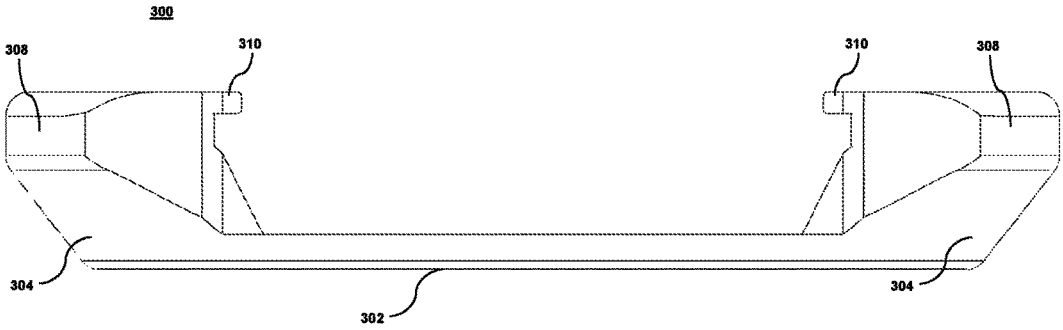
Figure 3G:
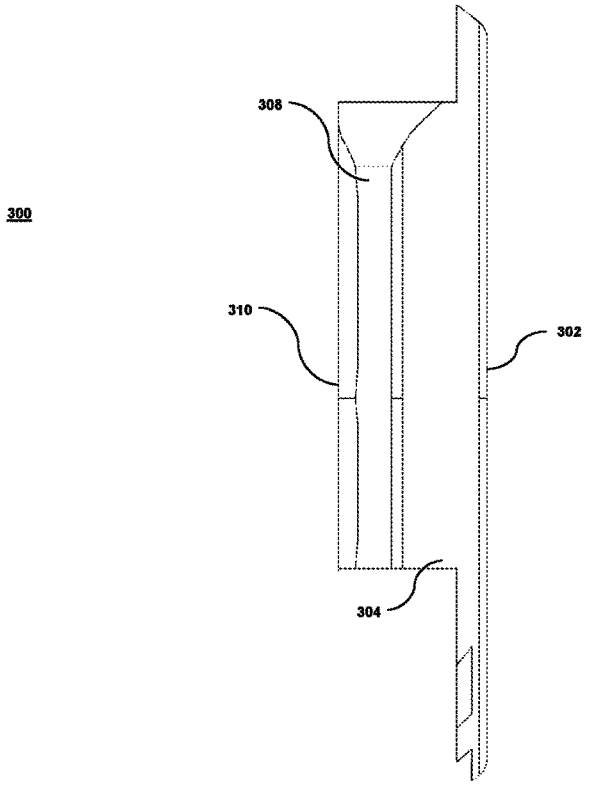
Figure 3H:
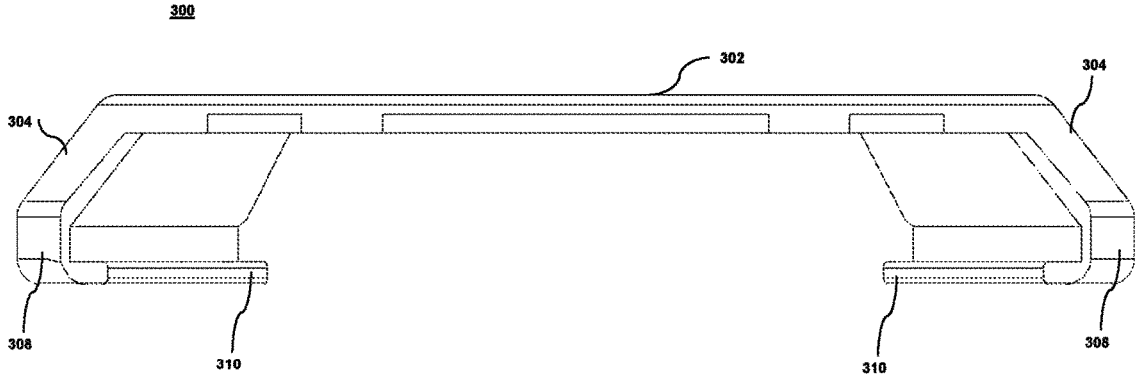
Figure 4A:
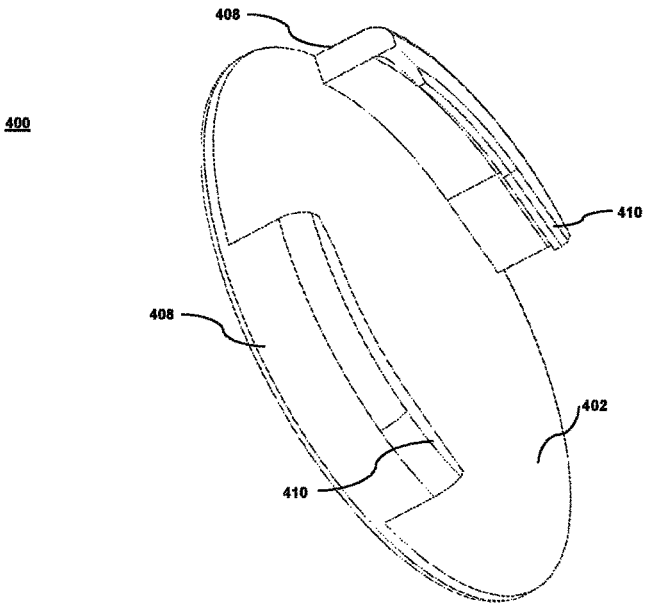
FIGS. 4A-H illustrate an embodiment of a protective, sound absorbing, and/or decorative device configured to be attached to an earpiece portion of a headphone and/or earphone device.
Figure 4B:
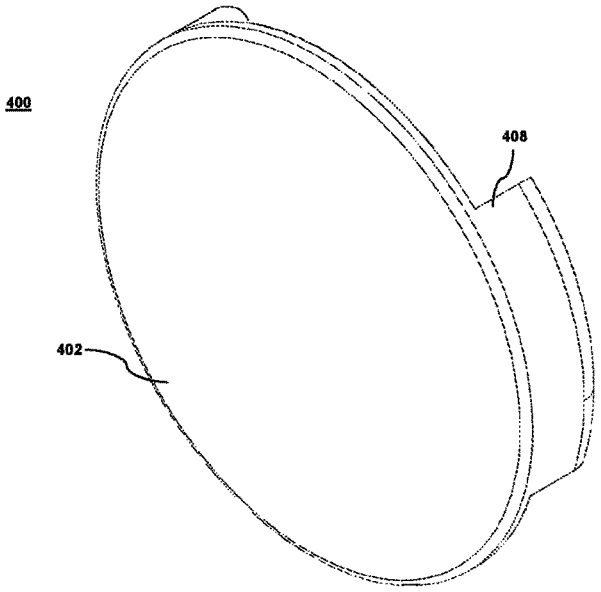
Figure 4C:
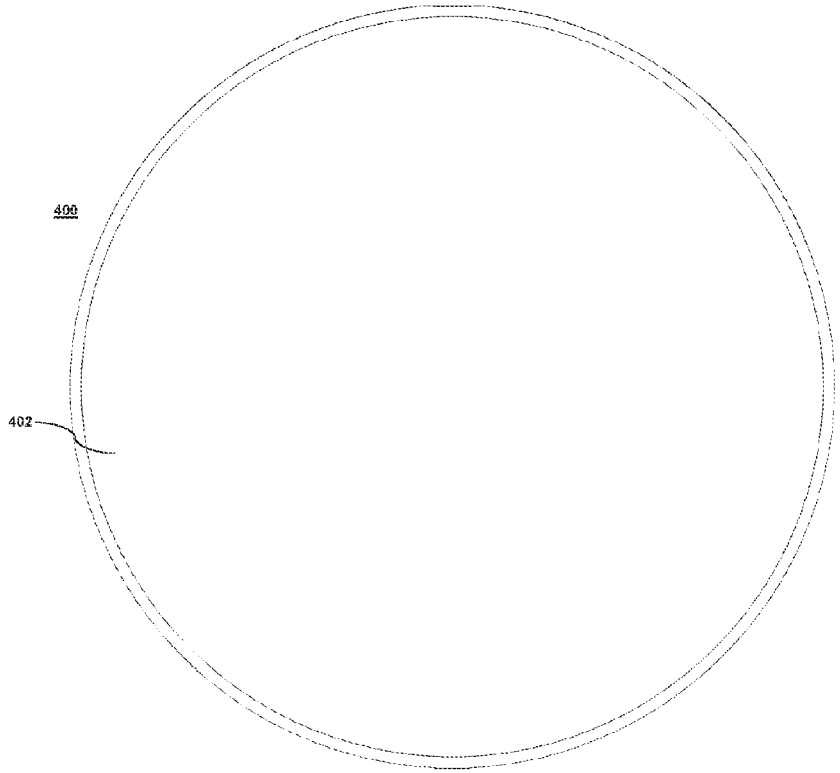
Figure 4D:
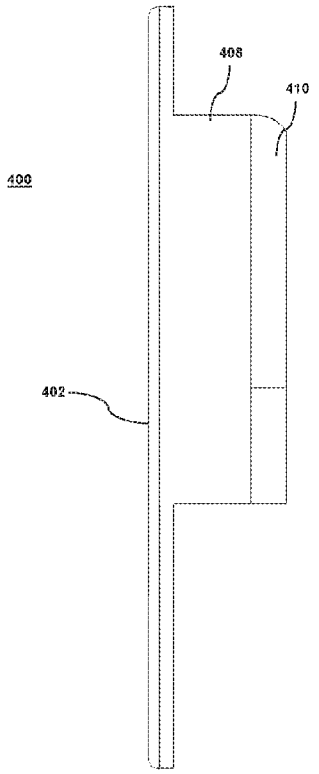
Figure 4E:
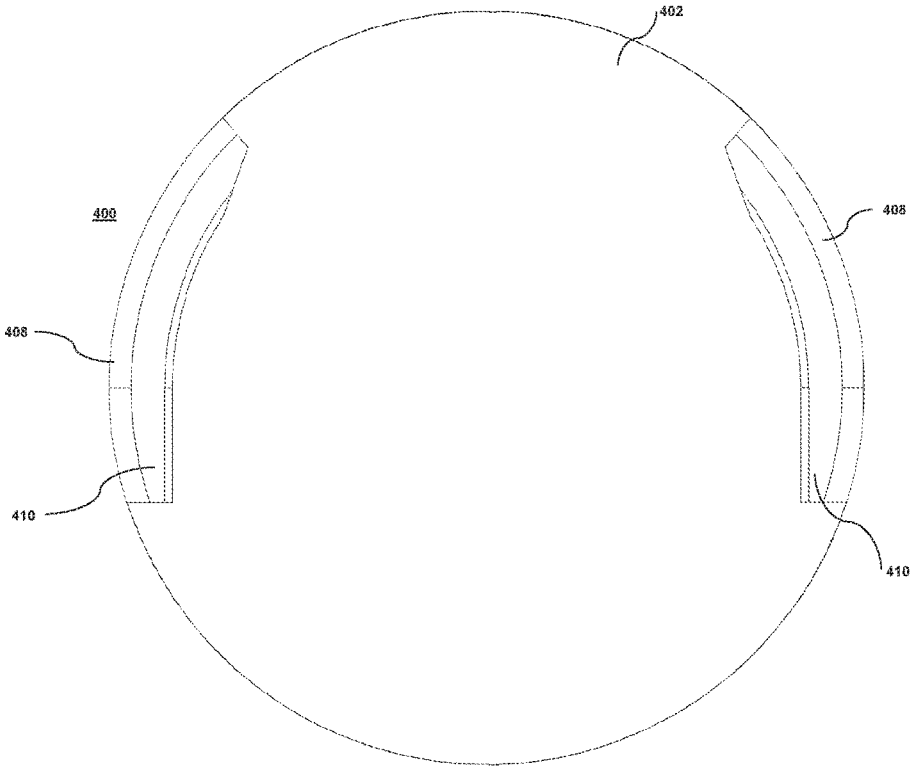
Figure 4F:
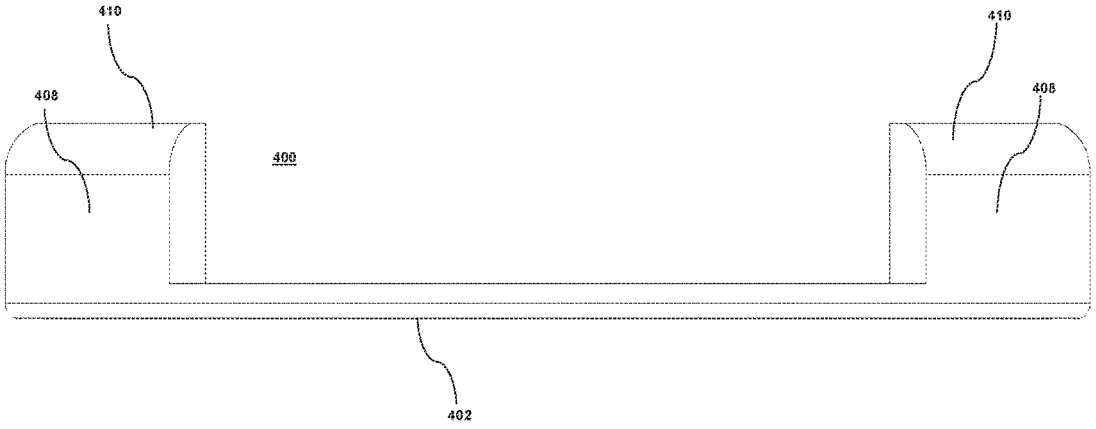
Figure 4G:
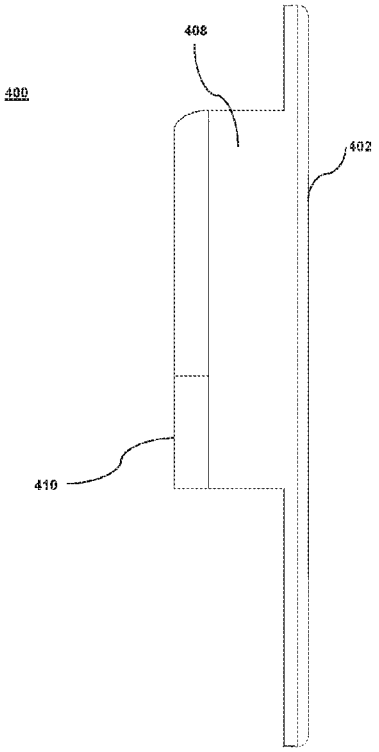
Figure 4H:
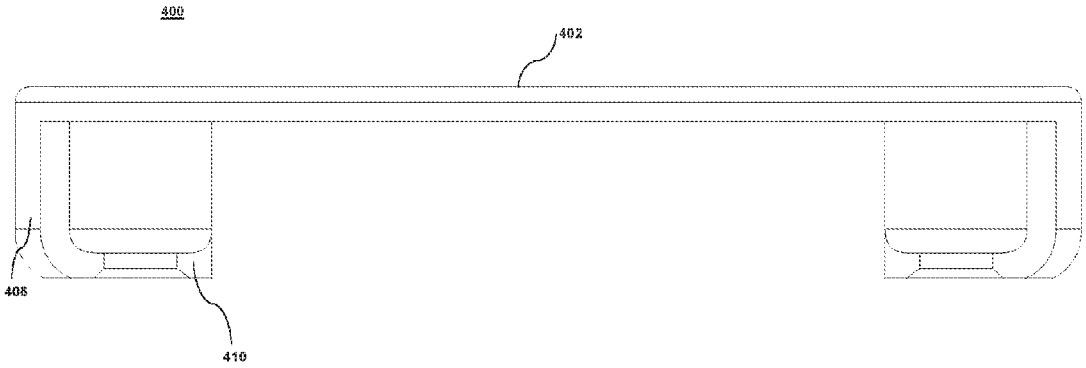
Figure 5A:
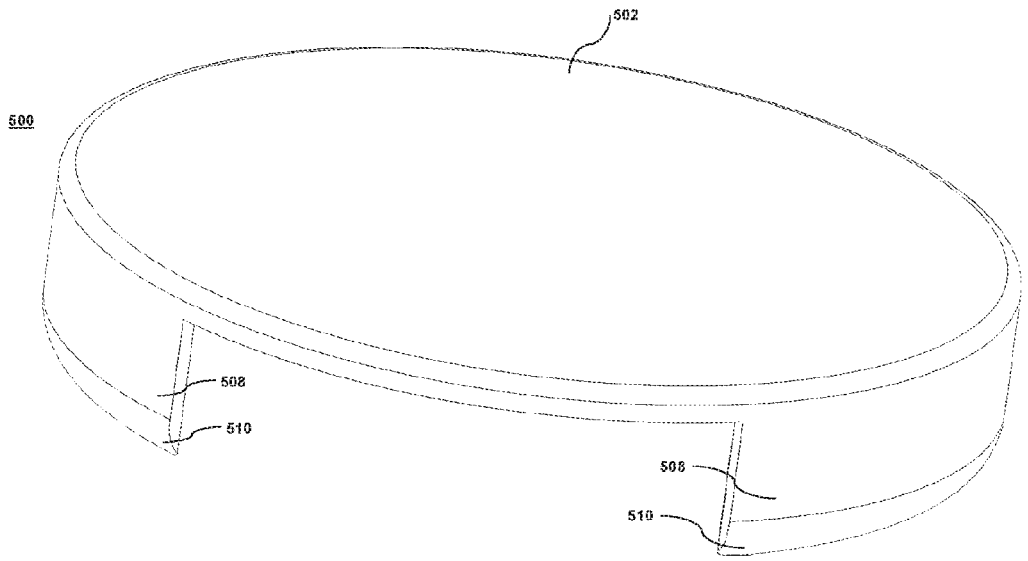
FIGS. 5A-H illustrate an embodiment of a protective, sound absorbing, and/or decorative device configured to be attached to an earpiece portion of a headphone and/or earphone device.
Figure 5B:
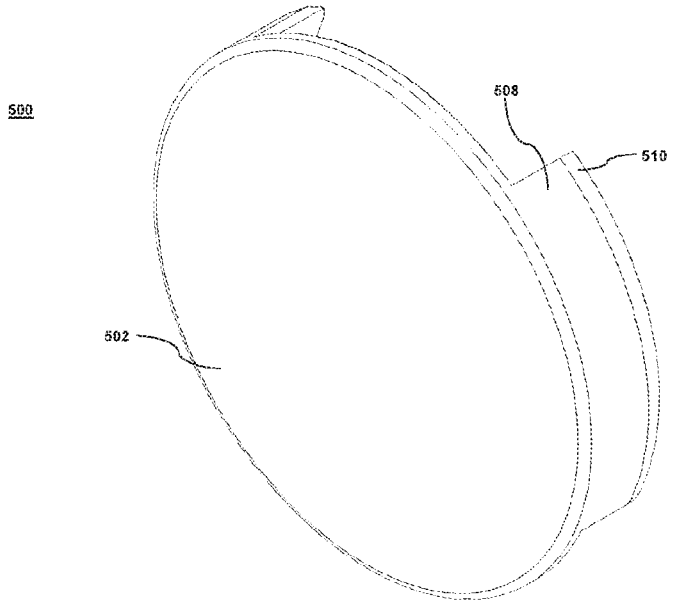
Figure 5C:
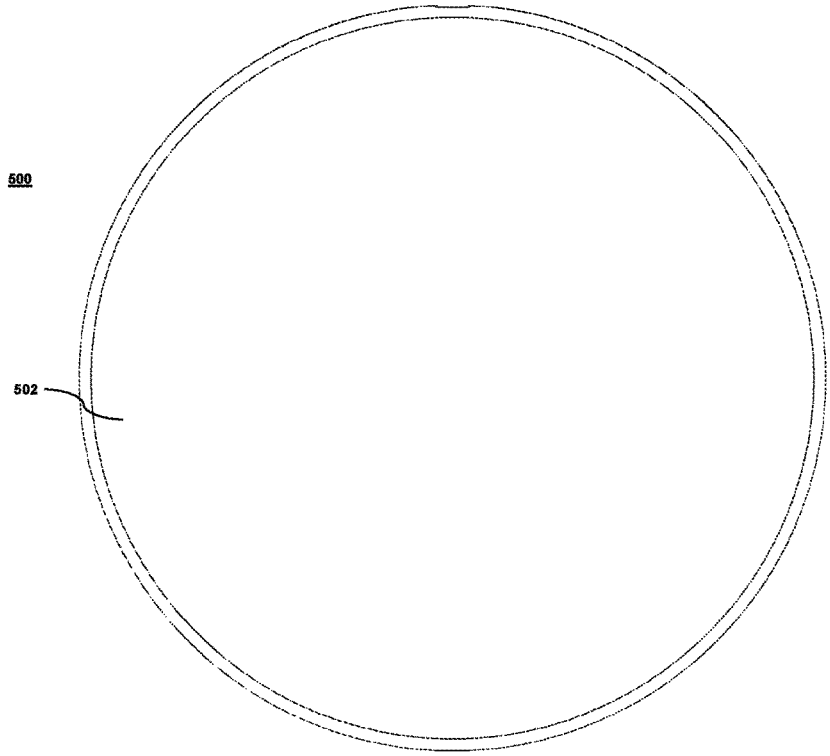
Figure 5D:
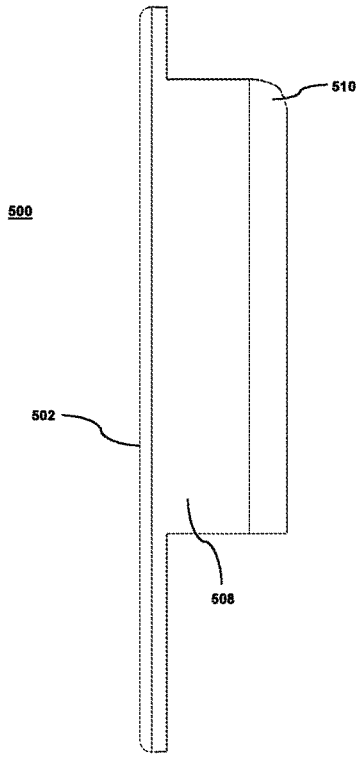
Figure 5E:
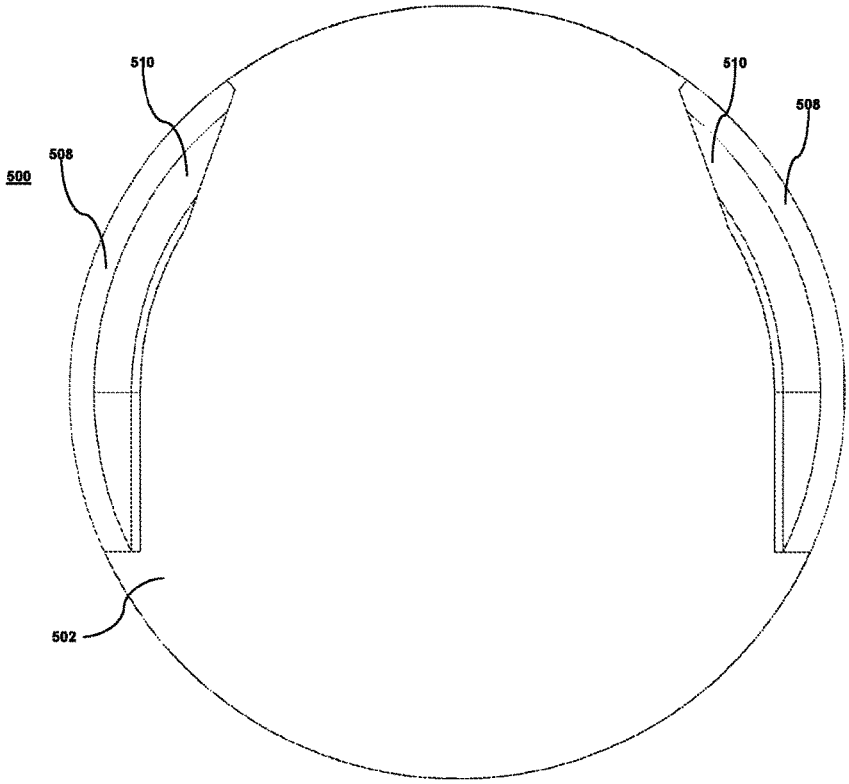
Figure 5F:
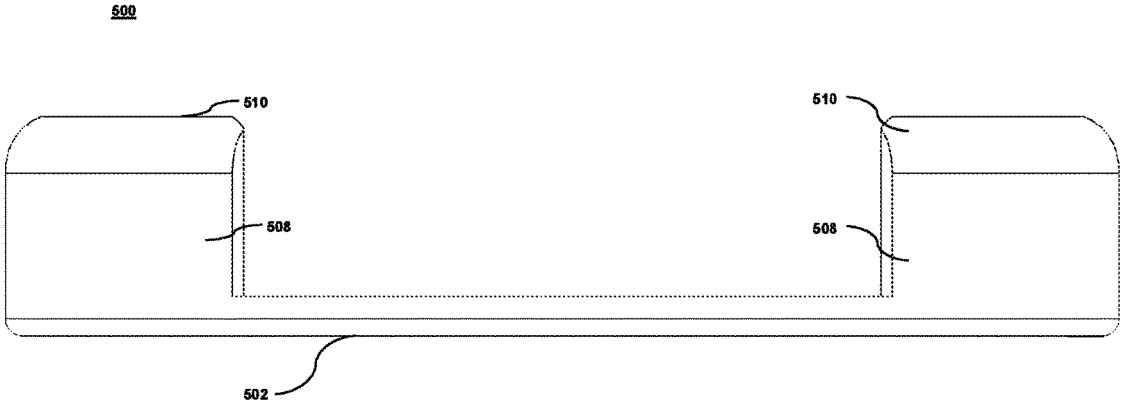
Figure 5G:
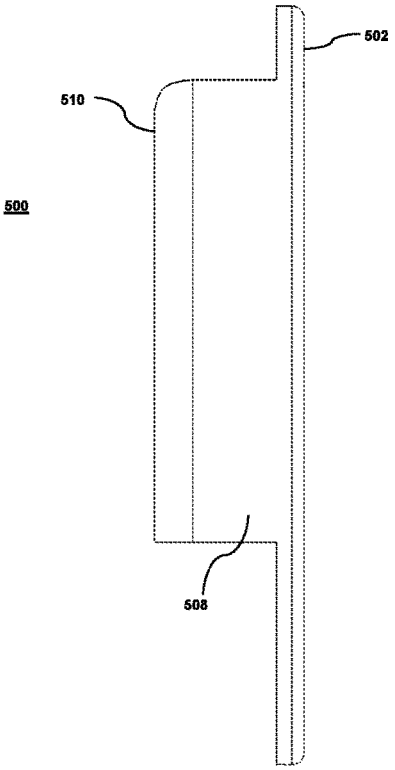
Figure 5H:
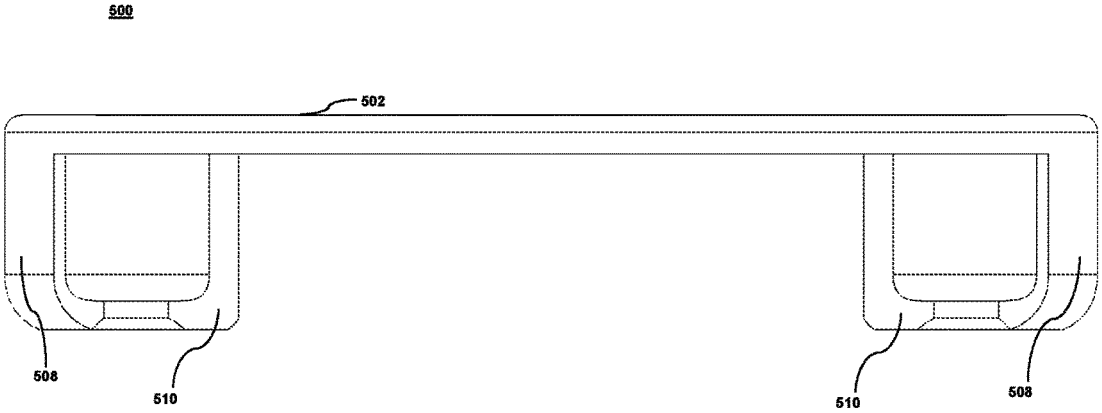
Figure 6A:
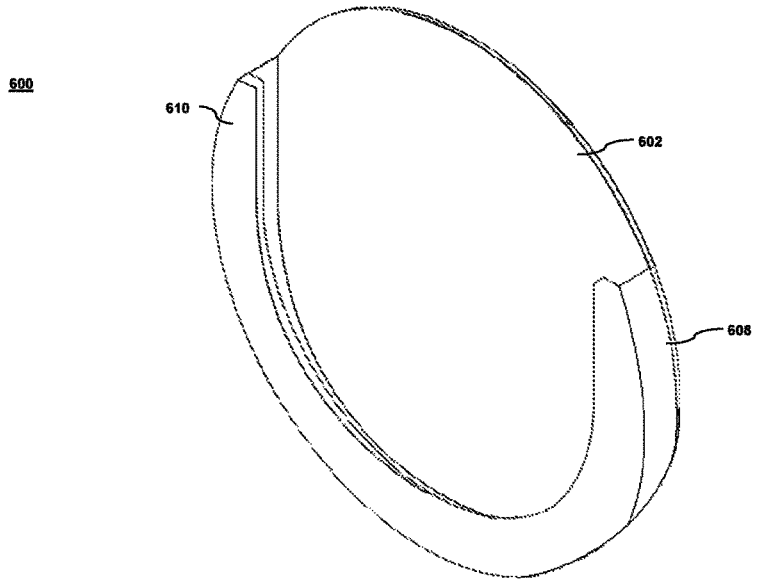
FIGS. 6A-G illustrate an embodiment of a protective, sound absorbing, and/or decorative device configured to be attached to an earpiece portion of a headphone and/or earphone device.
Figure 6B:
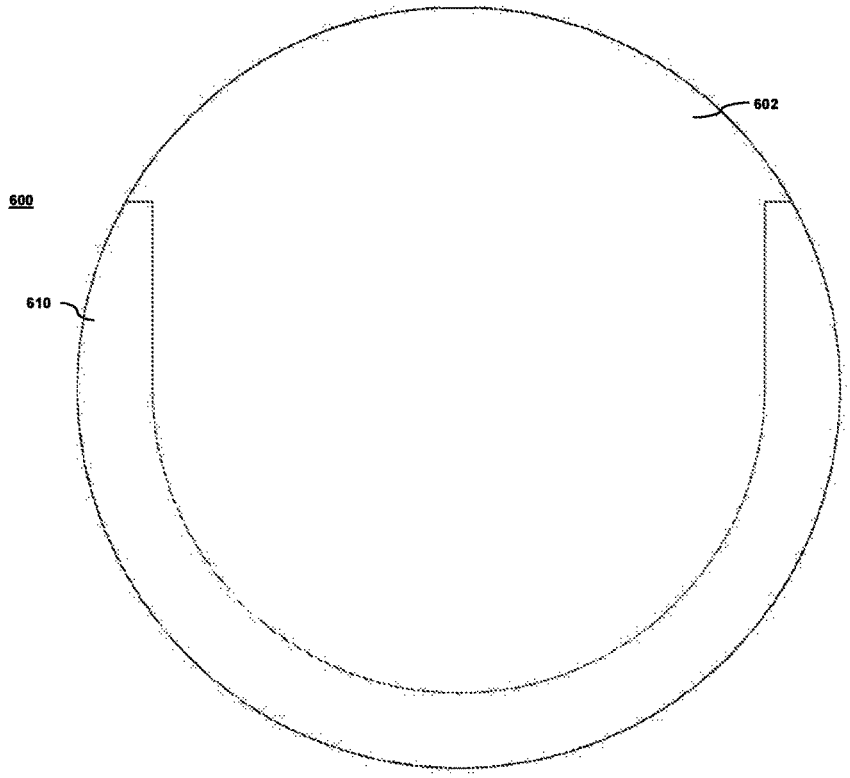
Figure 6C:
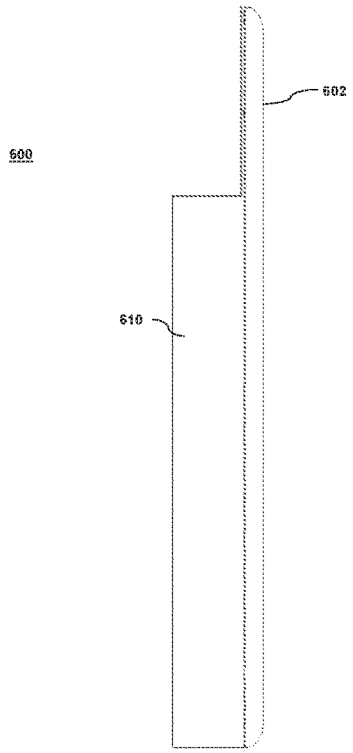
Figure 6D:
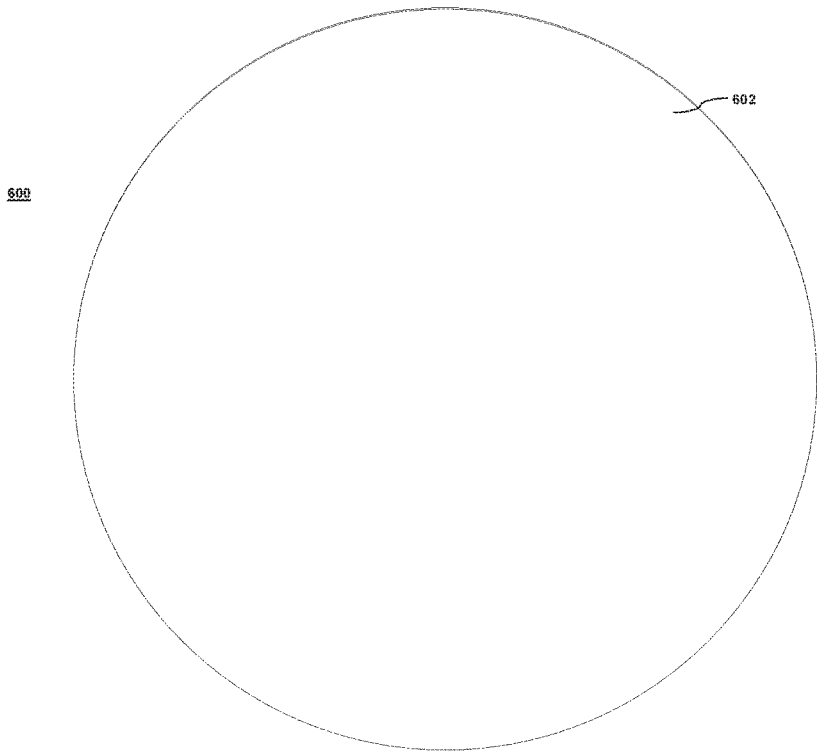
Figure 6E:
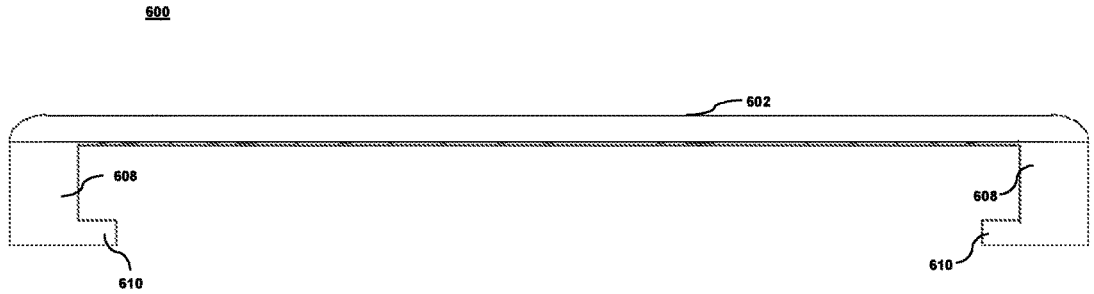
Figure 6F:
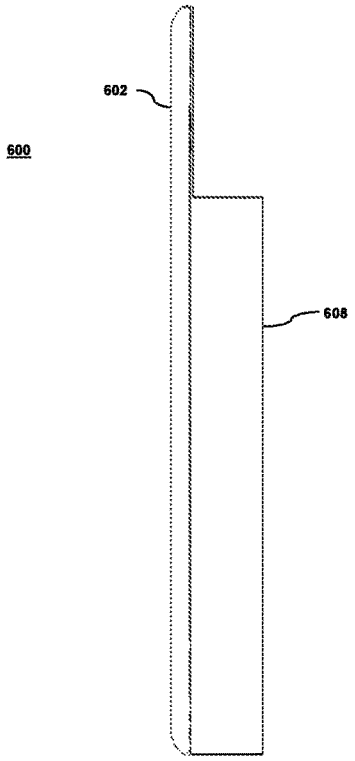
Figure 6G:
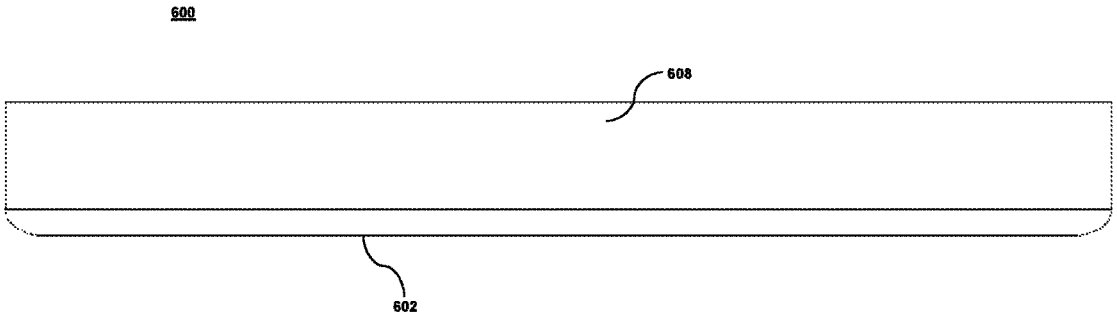
Figure 7A:
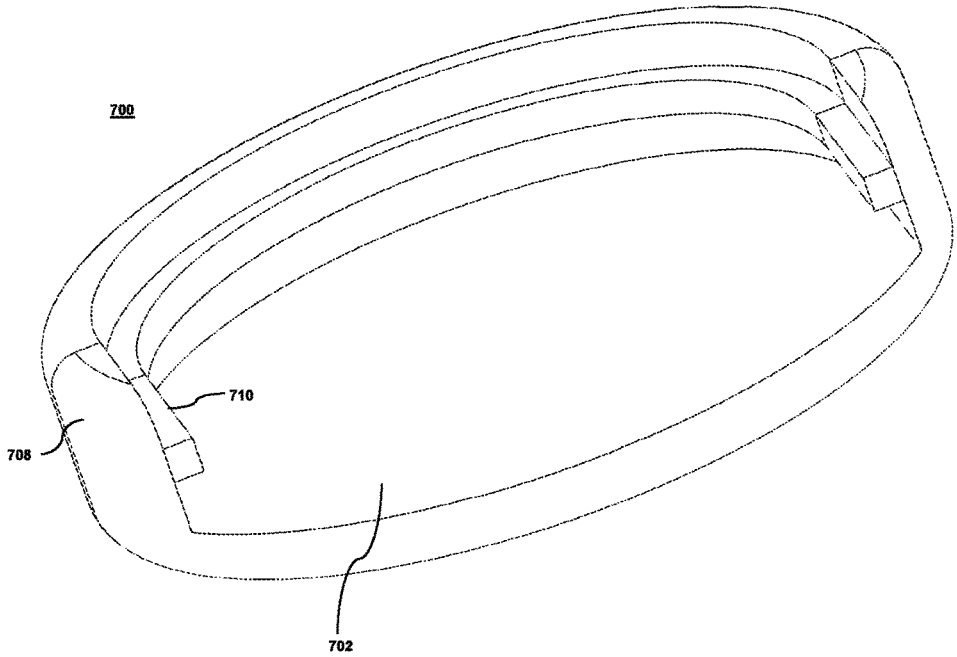
FIGS. 7A-H illustrate an embodiment of a protective, sound absorbing, and/or decorative device configured to be attached to an earpiece portion of a headphone and/or earphone device.
Figure 7B:
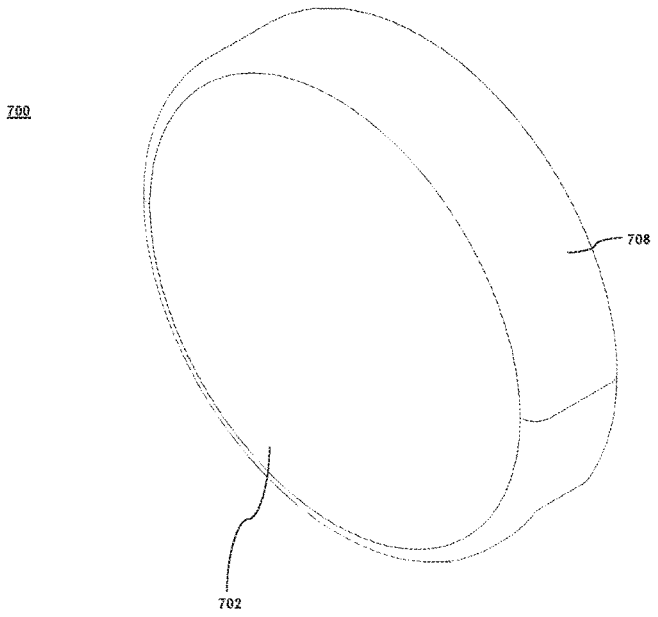
Figure 7C:
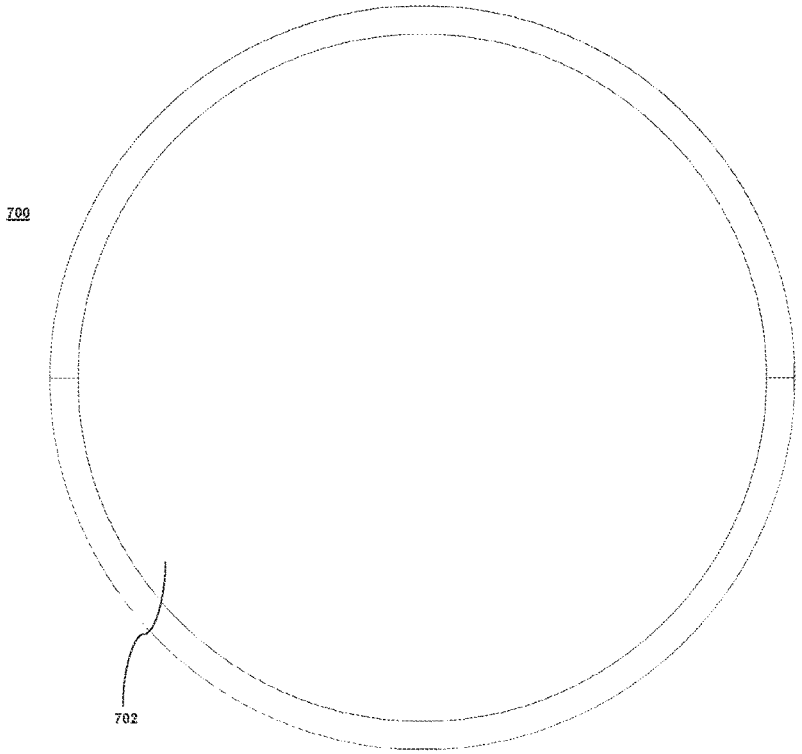
Figure 7D:
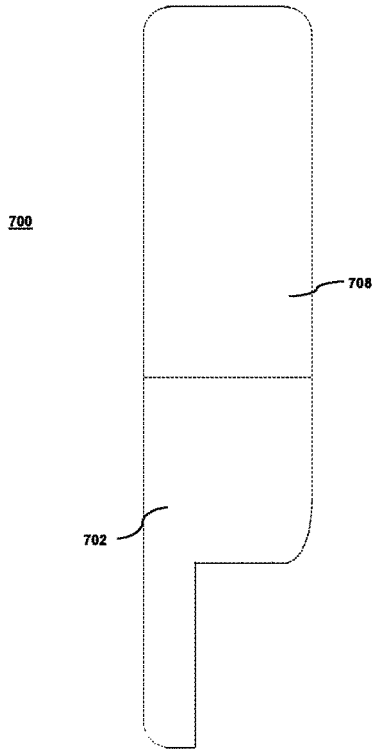
Figure 7E:
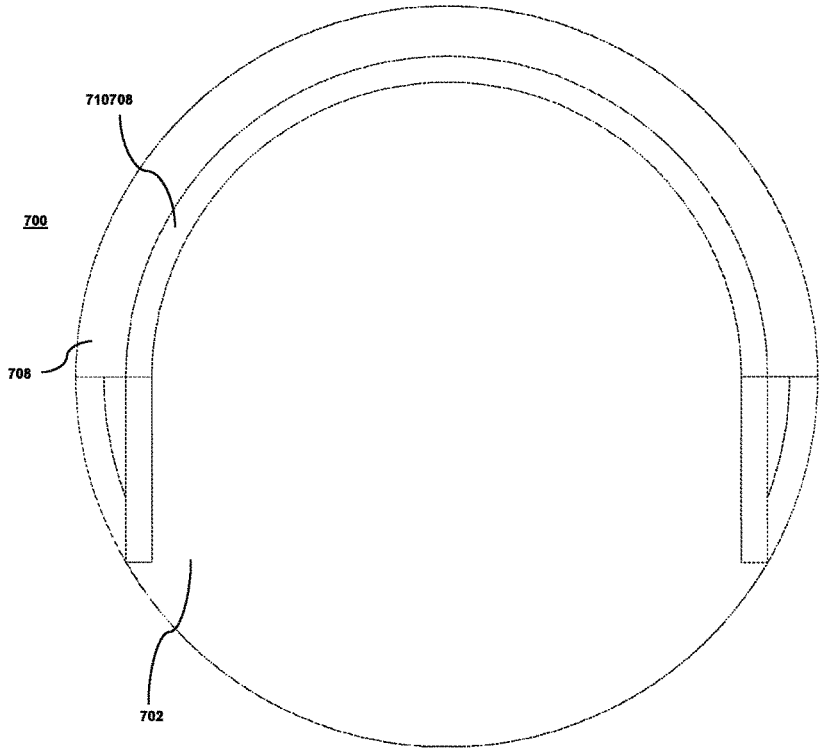
Figure 7F:
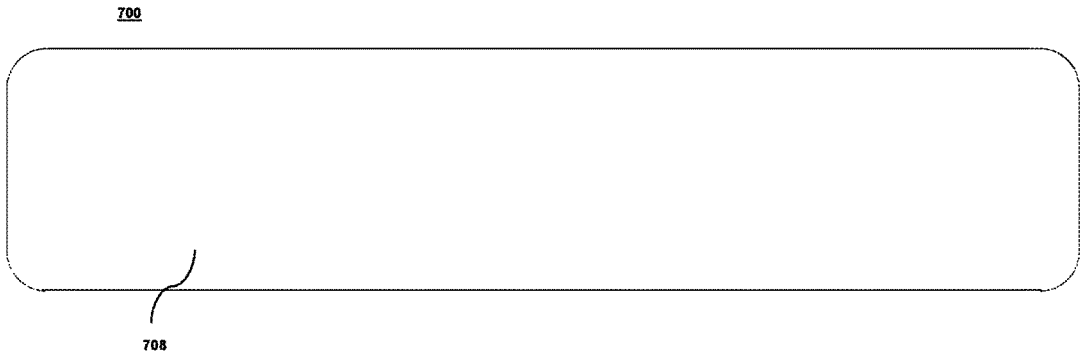
Figure 7G:
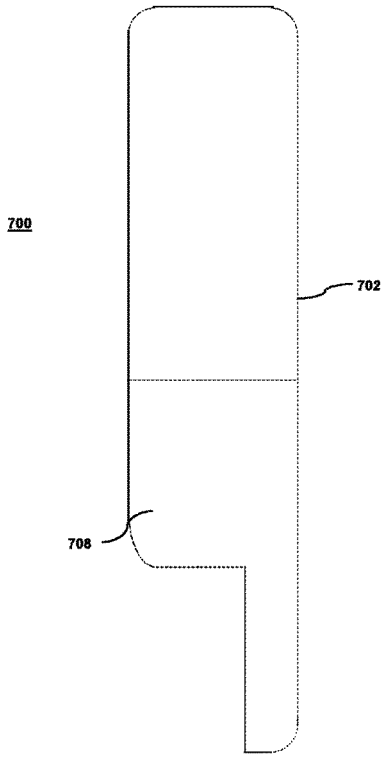
Figure 7H:
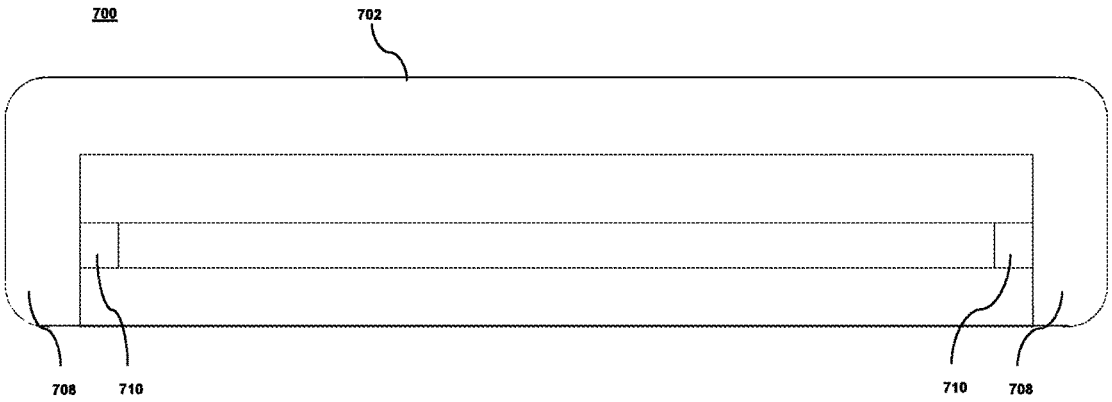
Figure 8A:
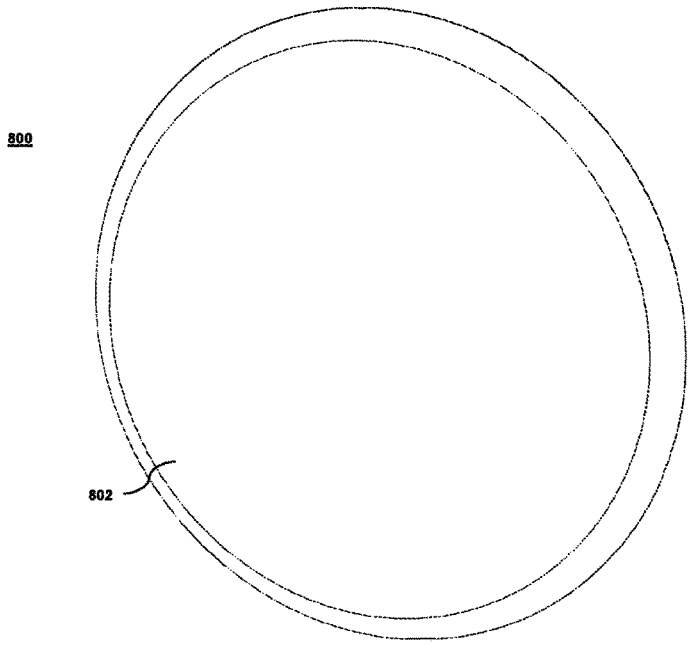
FIGS. 8A-H illustrate an embodiment of a protective, sound absorbing, and/or decorative device configured to be attached to an earpiece portion of a headphone and/or earphone device.
Figure 8B:
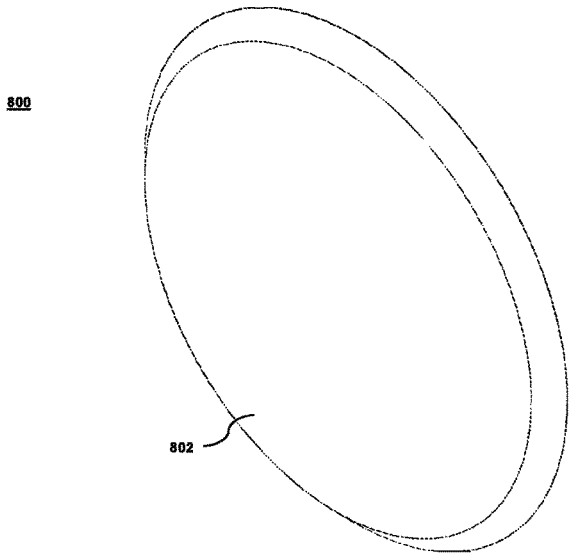
Figure 8C:
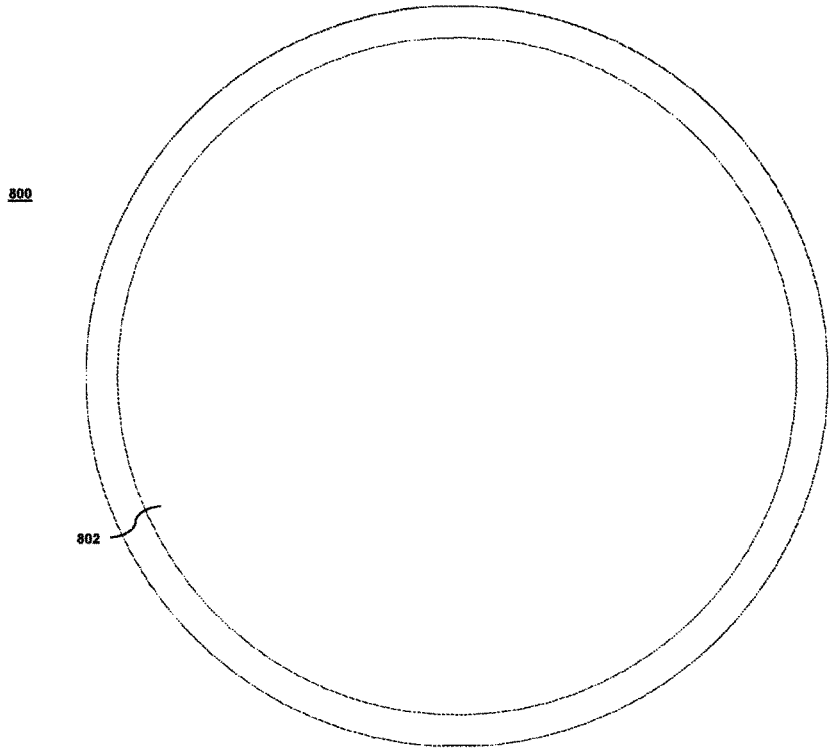
Figure 8D:
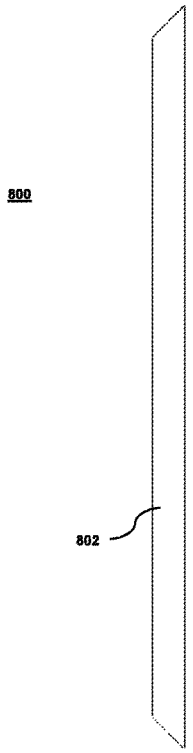
Figure 8E:
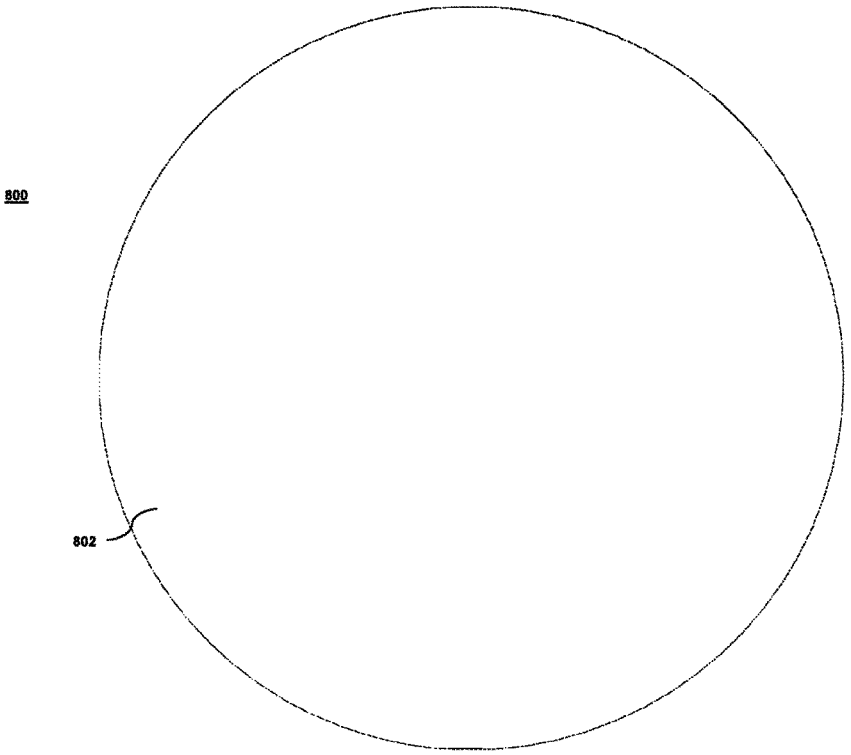
Figure 8F:
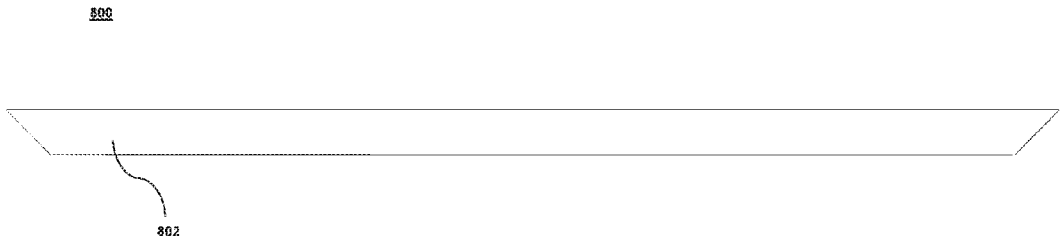
Figure 8G:
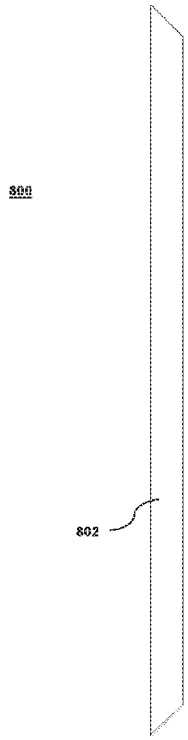
Figure 8H:
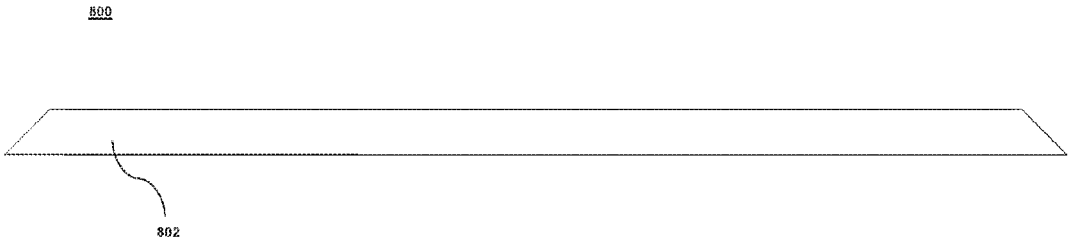
Figure 9A:
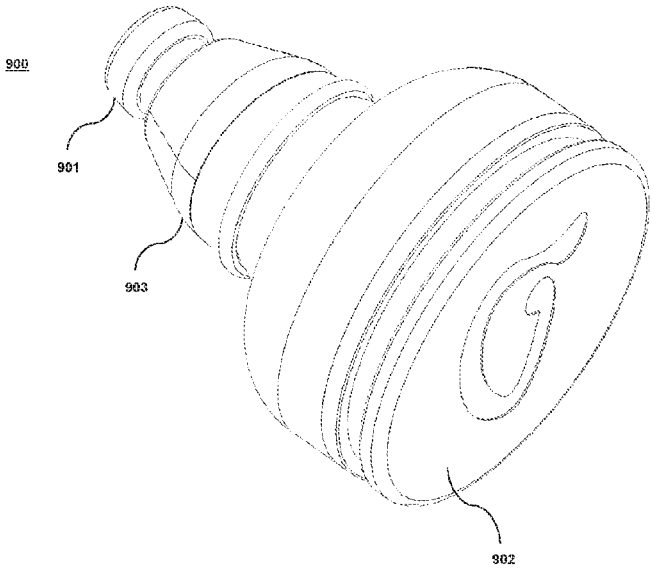
FIGS. 9A-H illustrate an embodiment of a protective, sound absorbing, and/or decorative device attached to an earphone device.
Figure 9B:
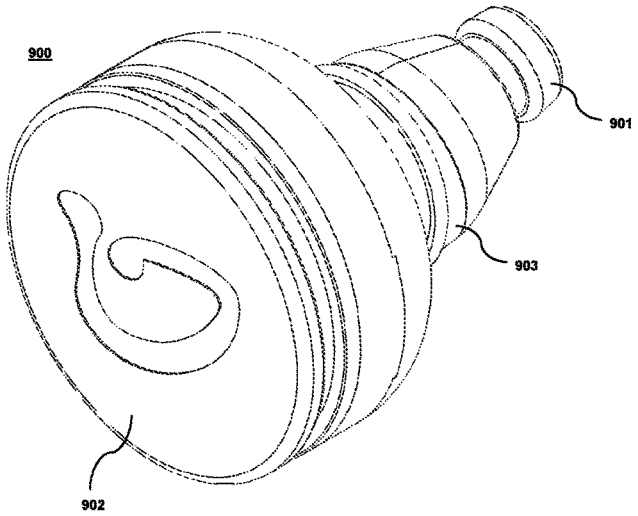
Figure 9C:
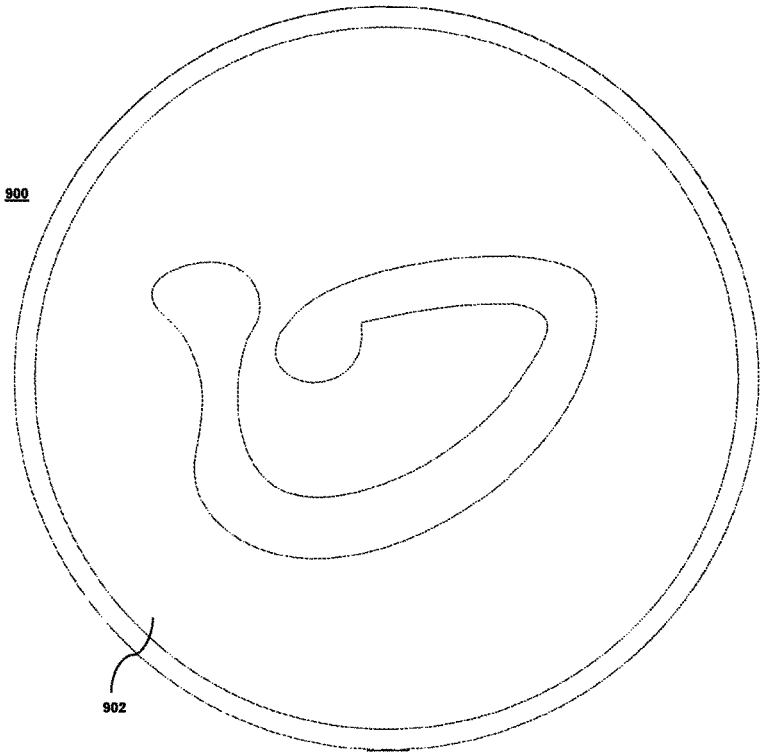
Figure 9D:
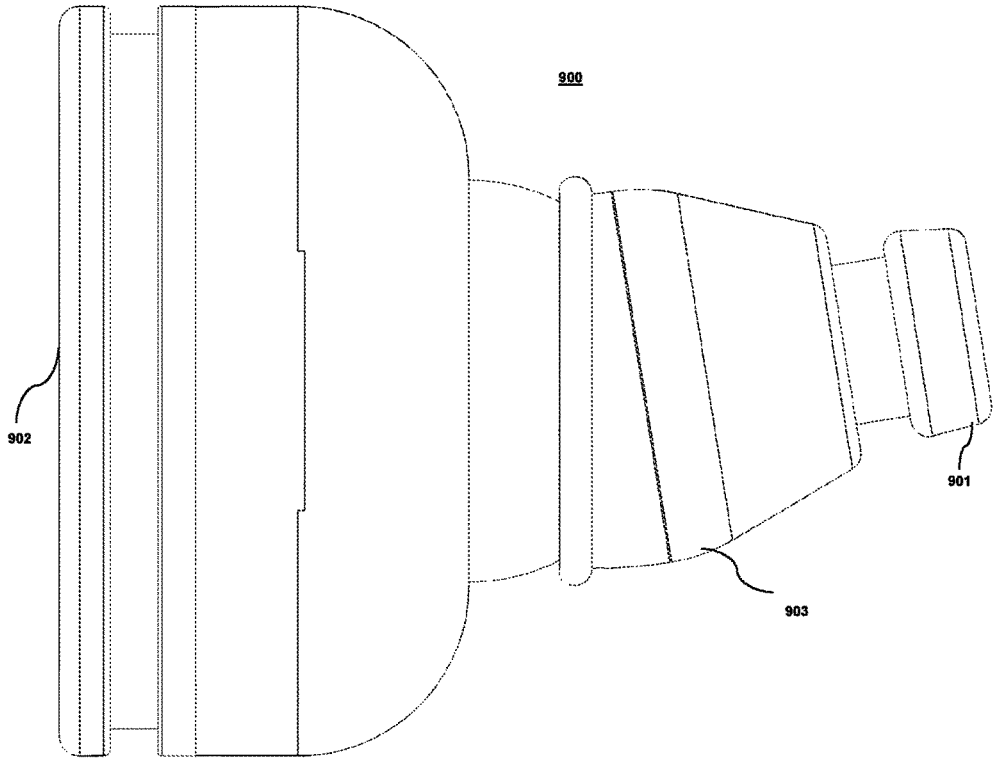
Figure 9E:
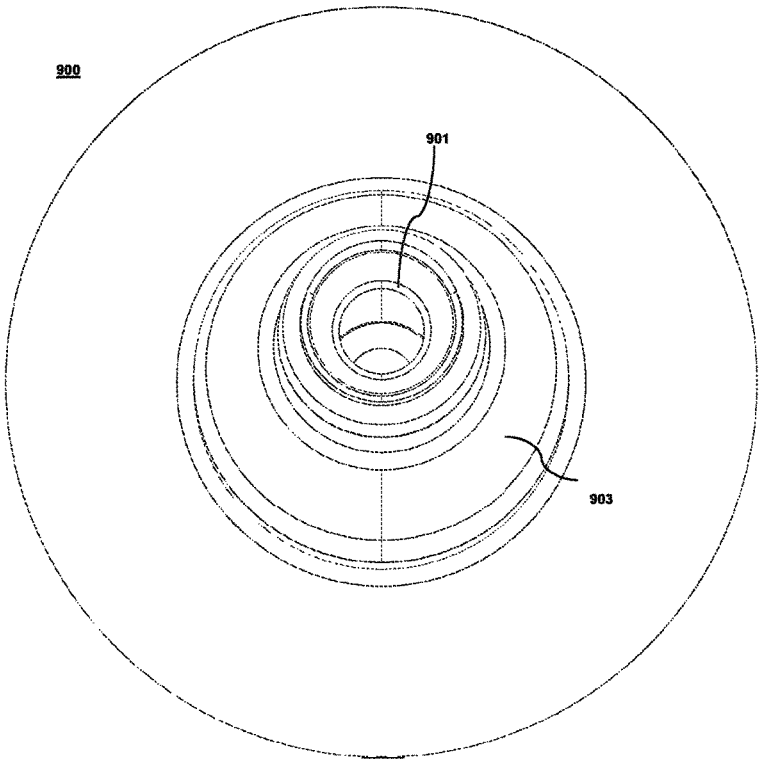
Figure 9F:
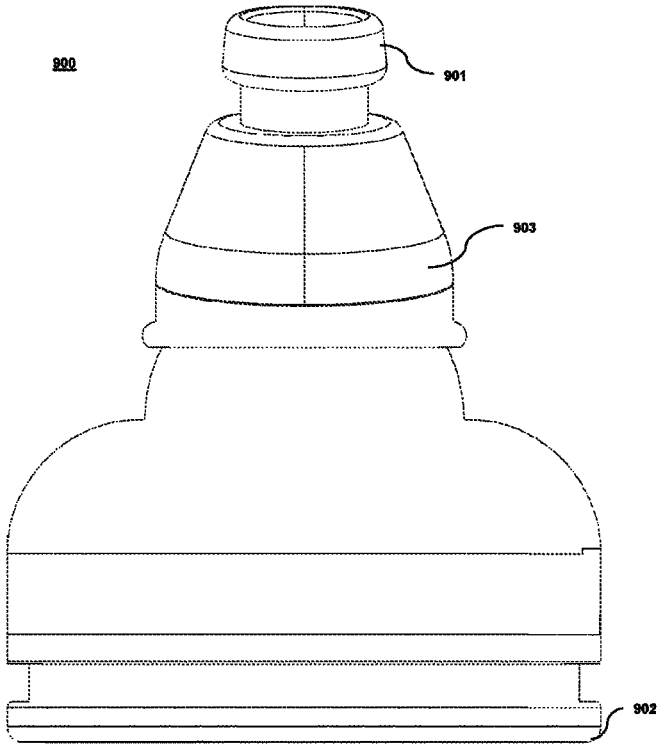
Figure 9G:
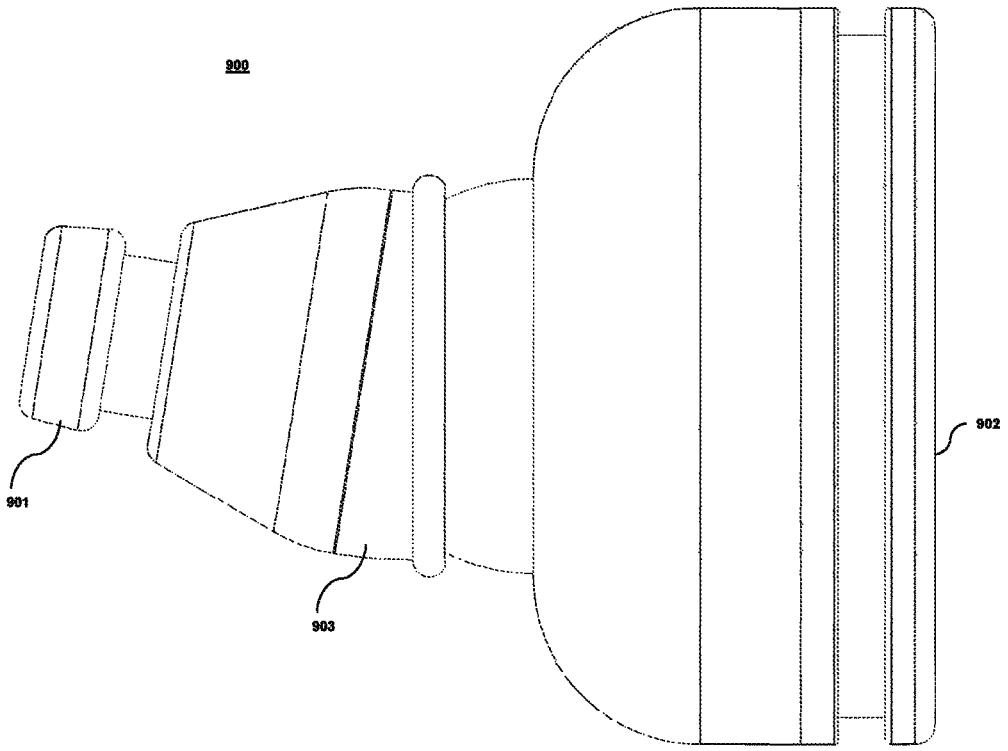
Figure 9H:
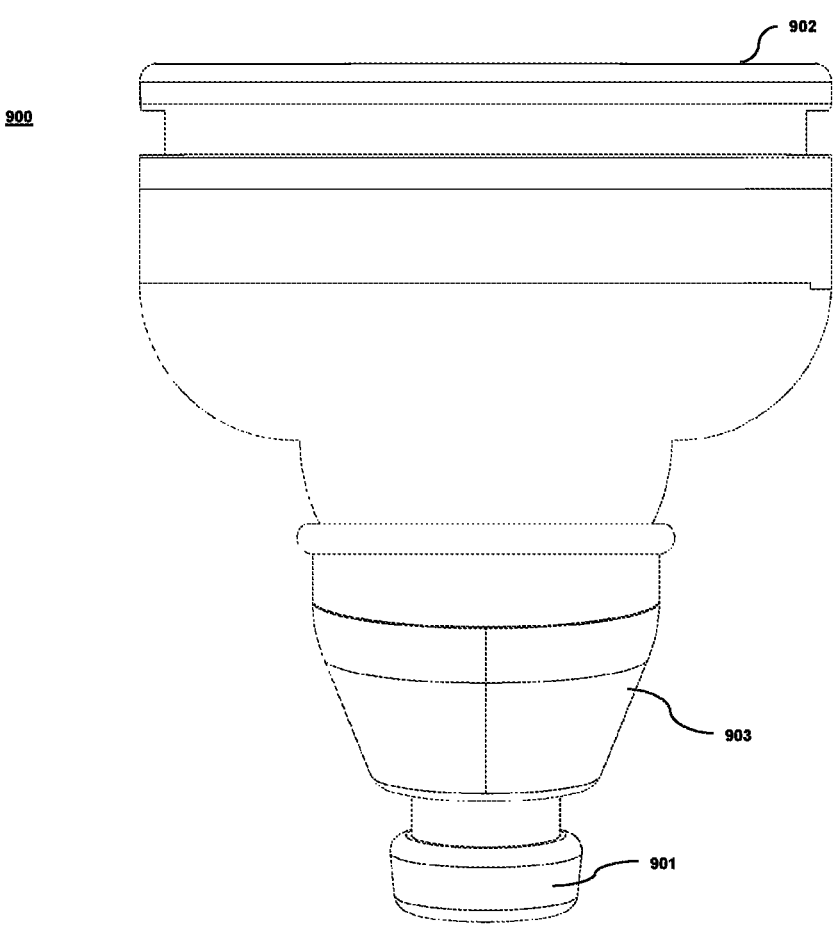

As discussed above, various embodiments of caps disclosed herein may comprise one or more graphical displays, user input features, a power source to provide power to these features, and/or the like. FIG. 2I illustrates an embodiment of a cap 250 that is similar to the embodiment of the cap 200 illustrated in FIGS. 2A through 2H, except a graphical display 251, a plurality of user input features 252, a power source 254, and a circuit board 256 have been added. In this embodiment, the graphical display 251, user interface features or buttons 252, power source 245 (in this case, a coin cell battery), and circuit board 256 are positioned on or in the base portion 202. In other embodiments, any of these features may be alternatively or additionally positioned elsewhere on or in the cap. For example, a battery may be positioned within the sidewall 208 instead of or in addition to having a battery positioned within the base portion 202. In some embodiments, it may be desirable to keep the base portion 202 as thin as possible so that it does not stick out very far from the headset. Accordingly, in such an embodiment, it may be desirable to position the power source, user input features or buttons 252, and/or circuit board 256 within the sidewall 208. Further, although the graphical display 251 is illustrated in this embodiment as a generally rectangular display, such as an LCD display, other types of displays may be used with various embodiments disclosed herein, such as an LCD display of a different shape, one or more individual LED lights, one or more light pipes that transfer light from an internal LED or other light source to an externally visible indicator, and/or the like. The circuit board 256 may comprise electronics configured to control other features of the device. For example, the circuit board 256 may comprise a computer processor, an LCD and/or LED driver, input/output leads, power charging circuitry, and/or the like. Further, although the graphical display 251, user input features 252, power source 254, and circuit board 256 are depicted in FIG. 2I in use with an embodiment similar to the embodiment shown in FIGS. 2A through 2H, one of skill in the art will recognize that similar features may be incorporated into any of the other embodiments disclosed herein.

Although various embodiments disclosed herein are described with respect to various discreet portions of the cap, such as the base portion 202, base wall portion 204, connecting portion 206, sidewall portion 208, and/or locking portion 210, some embodiments may include fewer portions, more portions, and/or one or more of the functions performed by each of these portions may be performed by a different portion. For example, in some embodiments, a cap may comprise a base portion 202 and one or more locking portions 210, and those portions may be connected by a single sidewall portion that performs the functions of, for example, the base wall portions 204, connecting portions 206, and sidewall portions 208 of cap 200.

Embodiment(s) #2

FIGS. 3A-H illustrate different views of an embodiment of a protective, sound absorbing, and/or decorative cap configured to be coupled and/or attached to an earpiece portion of a headphone device and/or earphones. In some embodiments, as shown in FIGS. 3A-H, protective, sound absorbing, and/or decorative cap 300 can comprise one or more base portions 302, one or more base wall portions 304, one or more sidewall portions 308, and/or one or more locking portions 310. In certain embodiments, the one or more base portions 302, base wall portions 304, sidewall portions 308, and/or locking portions 310 are formed as a single piece, as to create a cap 300 that is monolithic. In other embodiments, the one or more base portions 302, base wall portions 304, sidewall portions 308, locking portions 310, and/or any portion(s) thereof and/or any combination thereof are formed separately first and then attached together to create a single cap 300.

Base Portion(s)

In some embodiments, the base portion 302 comprises a generally circular shape. In other embodiments, the base portion 302 can comprise a substantially rectangular, substantially square, substantially triangular, substantially pentagonal, substantially hexagonal, and/or any other shape. In certain embodiments, the base portion 302 can comprise a shape that is substantially equal to and/or is a smaller or larger version of a substantially same shape as an earpiece portion of a headphone and/or earphone.

In certain embodiments, the base portion 302 can comprise one or more surfaces. For example, in certain embodiments, the base portion 302 can comprise an inner surface and an outer surface. The inner surface can be configured to oppositely face an earpiece portion of a headphone and/or earphone device. In some embodiments, the inner surface of a base portion 302 or a portion thereof can come into contact with an outer surface of an earpiece of a headphone and/or earphone when coupled to the headphone and/or earphone device. The outer surface of the base portion 302, in certain embodiments, comprises one or more decorative artwork and/or other graphical display as discussed above.

Groove(s)

In some embodiments, an inner surface of the base portion 302 can comprise one or more grooves 303 (e.g., grooves, slots, cutouts, voids, impressions, and/or the like). It can be advantageous, in some embodiments, to have grooves to allow for effective installation of a cap 300 onto an earpiece portion of a headphone and/or earphone device. For example, in certain embodiments, one or more grooves 303 of a base portion 302 can be configured to encompass or cover or create clearance for one or more protrusions of an earpiece portion of a headphone and/or earphone device as to allow a user to slide on the cap 300 over the earpiece portion.

In some embodiments, the one or more grooves 303 of a base portion 302 can be larger and/or wider than one or more protrusions of an earpiece portion of a headphone and/or earphone device. In certain embodiments, a portion(s) of the one or more grooves 303 can comprise a slightly larger but substantially equal shape as one or more protrusions of an earpiece portion of a headphone and/or earphone device.

In some embodiments, one or more grooves can comprise one or more generally circular portions 303A and one or more generally elongated portions 303B. The one or more generally elongated portions 303B can be substantially straight. In some embodiments, the generally elongated portion 303B is positioned or configured to enable the groove 303 to clear a corresponding protrusion of an earpiece and/or earphone device as the cap 300 is slid into place. In other words, the generally elongated portion 303B can provide a path that the corresponding protrusion passes through during installation of the cap 300.

In some embodiments, the one or more generally elongated portions 303B can be substantially parallel among one another. In some embodiments, a width of one or more grooves as measured between two edges of an elongated portion 303B can be about 1 cm, about 2 cm, about 3 cm, about 4 cm, about 5 cm, about 6 cm, about 7 cm, about 8 cm, about 9 cm, about 10 cm, about 11 cm, about 12 cm, about 13 cm, about 14 cm, about 15 cm, about 16 cm, about 17 cm, about 18 cm, about 19 cm, about 20 cm, or within a range defined by any of the two above-identified values. In some embodiments, the generally circular portions 303A can be differently shaped and/or can be shaped to provide clearance about a correspondingly shaped protrusion of the earpiece and/or earphone device.

Base Wall Portion(s)

In some embodiments, one or more base wall portions 304 can extend and/or protrude from the base portion 302. For example, as shown in FIGS. 3A-H, in some embodiments, a cap 300 comprises two base wall portions 304. In some embodiments, a cap 300 can comprise one, two, three, four, five, six, seven, eight, nine, or ten base wall portions 304. In certain embodiments, one or more base wall portions 304 can extend and/or protrude from the base portion 302 at an angle. An angle measured from the inner surface of one or more base wall portions 304 and the inner surface of the base portion 302 can be greater than 90° . In certain embodiments, the angle measured from the inner surface of one or more base wall portions 304 and the inner surface of the base portion 302 can be about 0°, about 10°, about 20°, about 30°, about 40°, about 50°, about 60°, about 70°, about 80°, about 90°, about 100°, about 110°, about 120°, about 130°, about 140°, about 150°, about 160°, about 170°, about 180°, or within a range defined by any of the two above-identified values.

In certain embodiments, one or more base wall portions 304 comprise a generally annular shape that surrounds the outer circumference of the base portion 302. In some embodiments, one or more base wall portions 304 comprise one or more circular portions and one or more elongated portions. In certain embodiments, the one or more elongated portions can be substantially straight. For example, a base wall portion 304 can comprise a circular portion and an elongated portion, wherein the elongated portion connects from the circular portion.

In certain embodiments, one or more base wall portions 304 extend and/or protrude from the whole outer circle conference of the base portion 302. In other embodiments, one or more base wall portions 304 do not encompass the whole outer circumference of the base portion 302 but only extends and/or protrudes from a fragment of the outer circumference of the base portion 302. For example, in some embodiments, one or more base wall portions 304 can extend and/or protrude from about 10°, about 20°, about 30°, about 40°, about 50°, about 60°, about 70°, about 80°, about 90°, about 100°, about 110°, about 120°, about 130°, about 140°, about 150°, about 160°, about 170°, about 180°, about 190°, about 200°, about 210°, about 220°, about 230°, about 240°, about 250°, about 260°, about 270°, about 280°, about 290°, about 300°, about 310°, about 320°, about 330°, about 340°, about 350°, about 360° of the outer circumference of the base portion 302. In certain embodiments, one or more base wall portions 304 can extend and/or protrude from a fragment of the outer circumference of the base portion 302, wherein the fragment can be defined as comprising a portion of the outer circumference of the base portion 302 within a range of degrees defined by any of the two above-identified values.

In some embodiments, one or more gaps can be formed between two or more ends of the one or more base wall portions 304. For example, in certain embodiments, one, two, three, four, five, six, seven, eight, nine, or ten gaps can be formed between two or more ends of one or more base wall portions 304. In certain embodiments, a first gap can formed between a first end of a first base wall portion 304 and a first end of a second base wall portion 304. In some embodiments, a headband portion of a headphone device can be configured to extend from one or more earpiece portions of a headphone device through this first gap. For example, in certain embodiments a width of the first gap can be larger or slightly larger than a width of a headband portion of a headphone device as to allow the headband portion to extend through the first gap. In some embodiments, a width of a first gap of the one or more base wall portions 308 can be about 1 cm, about 2 cm, about 3 cm, about 4 cm, about 5 cm, about 6 cm, about 7 cm, about 8 cm, 9 cm, about 10 cm, about 11 cm, about 12 cm, about 13 cm, about 14 cm, 15 cm, 16 cm, 17 cm, about 18 cm, 19 cm, about 20 cm, and/or can be within a range defined by any two of the above-identified values.

In some embodiments, a second gap can be formed between a second end of a first base wall portion 304 and a second end of a second base wall portion 304. In certain embodiments, having a second gap in the one or more base wall portions 304 can be advantageous for sliding a cap 300 onto an earpiece portion of a headphone and/or earphone device. Further, in some embodiments, a second gap in the one or more base wall portions 304 can be advantageous for easily removing and/or sliding on or otherwise attaching the cap 300 onto an earpiece portion of a headphone and/or earphone device. In some embodiments, a width of a second gap of the one or more base wall portions 304 can be about 1 cm, about 2 cm, about 3 cm, about 4 cm, about 5 cm, about 6 cm, about 7 cm, about 8 cm, 9 cm, about 10 cm, about 11 cm, about 12 cm, about 13 cm, about 14 cm, 15 cm, 16 cm, 17 cm, about 18 cm, 19 cm, about 20 cm, and/or can be within a range defined by any two of the above identified values.

Sidewall Portion(s)

In certain embodiments, one or more sidewall portions 308 further extend and/or protrude from the one or more base wall portions 304 without being connected to the one or more base wall portions 304 via one or more connecting portions. In certain embodiments, one or more sidewall portions 308 can extend and/or protrude from one or more base wall portions 304 at an angle. An angle measured from the inner surface of the one or more sidewall portions 308 and an imaginary plane drawn to be parallel to the base portion 302 can be substantially 90° in some embodiments. In certain embodiments, an angle measured from the inner surface of the one or more sidewall portions 308 and the inner surface of the one or more base wall portions 306 can be about 0°, about 10°, about 20°, about 30°, about 40°, about 50°, about 60°, about 70°, about 80°, about 90°, about 100°, about 110°, about 120°, about 130°, about 140°, about 150°, about 160°, about 170°, about 180°, or within a range defined by any of the two above-identified values.

In certain embodiments, the one or more sidewall portions 308 comprise a generally annular shape that surround the outer circumference of the one or more base wall portions 304. In some embodiments, the one or more sidewall portions 308 comprise one or more circular portions and one or more elongated portions. In certain embodiments, the one or more elongated portions can be substantially straight. For example, each of the one or more sidewall portions 308 can comprise one circular portion and one elongated portion, wherein the elongated portion can be connected to the circular portion.

In certain embodiments, the one or more sidewall portions 308 extend and/or protrude from the whole outer rim of the one or more base wall portions 304. In other embodiments, the one or more sidewall portions 308 do not encompass the whole rim of the one or more base wall portions 306 but only extends and/or protrudes from a fragment thereof. For example, in some embodiments, the one or more sidewall portions 308 can extend and/or protrude from about 10°, about 20°, about 30°, about 40°, about 50°, about 60°, about 70°, about 80°, about 90°, about 100°, about 110°, about 120°, about 130°, about 140°, about 150°, about 160°, about 170°, about 180°, about 190°, about 200°, about 210°, about 220°, about 230°, about 240°, about 250°, about 260°, about 270°, about 280°, about 290°, about 300°, about 310°, about 320°, about 330°, about 340°, about 350°, about 360° of the rim of the one or more base wall portions 304. In certain embodiments, the one or more sidewall portions 308 can extend and/or protrude from a fragment of the rim of the one or more base wall portions 304, wherein the fragment can be defined as comprising a portion of the rim of the one or more base wall portions 304 within a range of degrees defined by any of the two above-identified values.

In some embodiments, one or more gaps can be formed between two or more ends of the one or more sidewall portions 308. For example, in certain embodiments, one, two, three, four, five, six, seven, eight, nine, or ten gaps can be formed between two or more ends of one or more sidewall portions 308. In certain embodiments, a first gap can formed between a first end of a first sidewall portion 308 and a first end of a second sidewall portion 308. In some embodiments, a headband portion of a headphone device can be configured to extend from one or more earpiece portions of a headphone device through this first gap. For example, in certain embodiments a width of the first gap can be larger or slightly larger than a width of a headband portion of a headphone device as to allow the headband portion to extend through the first gap. In some embodiments, a width of a first gap of the one or more sidewall portions 308 can be about 1 cm, about 2 cm, about 3 cm, about 4 cm, about 5 cm, about 6 cm, about 7 cm, about 8 cm, 9 cm, about 10 cm, about 11 cm, about 12 cm, about 13 cm, about 14 cm, 15 cm, 16 cm, 17 cm, about 18 cm, 19 cm, about 20 cm, and/or can be within a range defined by any two of the above-identified values. In certain embodiments, a width of a gap or first gap of one or more sidewall portions 308 can be substantially equal to a width of a gap or first gap of one or more base wall portions 304.

In some embodiments, a second gap can be formed between a second end of a first sidewall portion 308 and a second end of a second sidewall portion 308. In certain embodiments, having a second gap of the one or more sidewall portions 308 can be advantageous for sliding a cap 300 onto an earpiece portion of a headphone and/or earphone device. Further, in some embodiments, a second gap of the one or more sidewall portions 308 can be advantageous for easily removing and/or sliding on or otherwise attaching the cap onto an earpiece portion of a headphone and/or earphone device. In certain embodiments, a width of a gap or the second gap of one or more sidewall portions 308 can be substantially equal to a width of a gap or a second gap of the one or more base wall portions 304. In some embodiments, a width of a second gap of the one or more sidewall portions 308 can be about 1 cm, about 2 cm, about 3 cm, about 4 cm, about 5 cm, about 6 cm, about 7 cm, about 8 cm, 9 cm, about 10 cm, about 11 cm, about 12 cm, about 13 cm, about 14 cm, 15 cm, 16 cm, 17 cm, about 18 cm, 19 cm, about 20 cm, and/or can be within a range defined by any two of the above-identified values.

Locking Portion(s)

In certain embodiments, one or more locking portions 310 further extend and/or protrude from the one or more sidewall portions 308. For example, in some embodiments, a cap 300 can comprise one, two, three, four, five, six, seven, eight, nine, or ten locking portions 310. In certain embodiments, one or more locking portions 310 can extend and/or protrude from one or more sidewall portions 308 at an angle. An angle measured from the inner surface of the one or more locking portions 310 and an inner surface of the one or more sidewall portions 308 can be substantially 90° in some embodiments. In certain embodiments, an angle measured from the inner surface of the one or more locking portions 310 and one or more sidewall portions 308 can be about 0°, about 10°, about 20°, about 30°, about 40°, about 50°, about 60°, about 70°, about 80°, about 90°, about 100°, about 110°, about 120°, about 130°, about 140°, about 150°, about 160°, about 170°, about 180°, or within a range defined by any of the two above-identified values.

In certain embodiments, the one or more locking portions 310 comprise a generally annular shape that surrounds the outer circumference of the one or more sidewall portions 308. In some embodiments, the one or more locking portions 310 comprise one or more circular portions and one or more elongated portions. In certain embodiments, the one or more elongated portions can be substantially straight. For example, each of the one or more locking portions 310 can comprise one circular portion and one elongated portion, wherein the elongated portion can be each connected to the circular portion.

In certain embodiments, the one or more locking portions 310 extend and/or protrude from the whole outer rim of the one or more sidewall portions 308. In other embodiments, the one or more locking portions 310 do not encompass the whole rim of the one or more sidewall portions 308 but only extends and/or protrudes from a fragment thereof. For example, in some embodiments, the one or more locking portions 310 can extend and/or protrude from about 10°, about 20°, about 30°, about 40°, about 50°, about 60°, about 70°, about 80°, about 90°, about 100°, about 110°, about 120°, about 130°, about 140°, about 150°, about 160°, about 170°, about 180°, about 190°, about 200°, about 210°, about 220°, about 230°, about 240°, about 250°, about 260°, about 270°, about 280°, about 290°, about 300°, about 310°, about 320°, about 330°, about 340°, about 350°, about 360° of the rim of the one or more sidewall portions 308. In certain embodiments, the one or more locking portions 310 can extend and/or protrude from a fragment of the rim of the one or more sidewall portions 308, wherein the fragment can be defined as comprising a portion of the rim of the one or more sidewall portions 308 within a range of degrees defined by any of the two above-identified values.

In some embodiments, one or more gaps can be formed between two or more ends of the one or more locking portions 310. For example, in certain embodiments, one, two, three, four, five, six, seven, eight, nine, or ten gaps can be formed between two or more ends of one or more locking portions 310. In certain embodiments, a first gap can be formed between a first end of a first locking portion 310 and a first end of a second locking portion 310. In some embodiments, a headband portion of a headphone device can be configured to extend from one or more earpiece portions of a headphone device through this first gap. For example, in certain embodiments a width of the first gap can be larger than a width of a headband portion of a headphone device as to allow the headband portion to extend through this first gap. In some embodiments, a width of a first gap of one or more locking portions can be about 1 cm, about 2 cm, about 3 cm, about 4 cm, about 5 cm, about 6 cm, about 7 cm, about 8 cm, 9 cm, about 10 cm, about 11 cm, about 12 cm, about 13 cm, about 14 cm, 15 cm, 16 cm, 17 cm, about 18 cm, 19 cm, about 20 cm, and/or can be within a range defined by any two of the above identified values. In certain embodiments, a width of a gap or first gap of one or more locking portions 310 can be substantially equal to a width of a gap or first gap of one or more sidewall portions 308 and/or a width of a gap or a first gap of one or more base wall portions 304.

In some embodiments, a second gap can be formed between a second end of a first locking portion 310 and a second end of a second locking portion 310. In certain embodiments, having a second gap in the one or more locking portions 310 can be advantageous for sliding a cap 300 onto an earpiece portion of a headphone and/or earphone device. Further, in some embodiments, a second gap in the locking portion 310 can be advantageous for easily removing and/or sliding on or otherwise attaching the cap onto an earpiece portion of a headphone and/or earphone device. In certain embodiments, a width of a gap and/or the second gap of one or more locking portions 310 can be substantially equal to a width of a gap of second gap of one or more sidewall portions 308, and/or a gap or second gap of one or more base wall portions 304. In some embodiments, a width of a second gap of one or more locking portions 310 can be about 1 cm, about 2 cm, about 3 cm, about 4 cm, about 5 cm, about 6 cm, about 7 cm, about 8 cm, 9 cm, about 10 cm, about 11 cm, about 12 cm, about 13 cm, about 14 cm, 15 cm, 16 cm, 17 cm, about 18 cm, 19 cm, about 20 cm, and/or can be within a range defined by any two of the above-identified values.

Embodiment(s) #3

FIGS. 4A-H illustrate different views of an embodiment of a protective, sound absorbing, and/or decorative cap configured to be coupled in or attached to an earpiece portion of a headphone device and/or earphones. In some embodiments, as shown in FIGS. 4A-H, protective, sound absorbing, and/or decorative cap 400 can comprise one or more base portions 402, one or more sidewall portions 408, and/or one or more locking portions 410. In certain embodiments, the one or more base portions 402, sidewall portions 408, and/or locking portions 410 are formed as a single piece, as to create a cap 400 that is monolithic. In other embodiments, the one or more base portions 402, sidewall portions 408, locking portions 410, and/or any portion(s) thereof and/or any combination thereof are formed separately first and then attached together to create a single cap 400.

Base Portion(s)

In some embodiments, the base portion 402 comprises a generally circular shape. In other embodiments, the base portion 402 can comprise a substantially rectangular, substantially square, substantially triangular, substantially pentagonal, substantially hexagonal, and/or any other shape. In certain embodiments, the base portion 402 can comprise a shape that is substantially equal to and/or is a smaller or larger version of a substantially same shape as an earpiece portion of a headphone and/or earphone.

In certain embodiments, the base portion 402 can comprise one or more surfaces. For example, in certain embodiments, the base portion 402 can comprise an inner surface and an outer surface. The inner surface can be configured to oppositely face an exterior surface of an earpiece portion of a headphone device and/or earphones. In some embodiments, the inner surface of a base portion 402 or a portion thereof can come into contact with an outer surface of an earpiece of a headphone and/or earphone when coupled to the headphone and/or earphone device. The outer surface of the base portion 402, in certain embodiments, comprises one or more decorative artwork and/or other graphical display as discussed above.

Sidewall Portion(s)

In certain embodiments, one or more sidewall portions 408 extend and/or protrude from the base portion 402. For example, in some embodiments, one or more sidewall portions 408 extend and/or protrude from the base portion 402 directly, without one or more connecting portions and/or base wall portions in between. In certain embodiments, one or more sidewall portions 408 can extend and/or protrude from the base portion 402 at an angle. An angle measured from the inner surface of the one or more sidewall portions 408 and an inner surface of the base portion 402 can be substantially 90° in some embodiments. In certain embodiments, an angle measured from the inner surface of the one or more sidewall portions 408 and the inner surface of the base portions 402 can be about 0°, about 10°, about 20°, about 30°, about 40°, about 50°, about 60°, about 70°, about 80°, about 90°, about 100°, about 110°, about 120°, about 130°, about 140°, about 150°, about 160°, about 170°, about 180°, or within a range defined by any of the two above-identified values.

In certain embodiments, the one or more sidewall portions 408 comprise a generally annular shape that surrounds the outer circumference of the base portion 402. In some embodiments, the one or more sidewall portions 408 comprise one or more circular portions and/or one or more elongated portions. In certain embodiments, the one or more elongated portions can be substantially straight. For example, each of the one or more sidewall portions 408 can comprise one circular portion and one elongated portion, wherein the elongated portion can be connected to the circular portion.

In certain embodiments, the one or more sidewall portions 408 extend and/or protrude from the whole outer rim of the base portion 402. In other embodiments, the one or more sidewall portions 408 do not encompass the whole rim of the base portion 402 but only extend and/or protrude from a fragment thereof. For example, in some embodiments, the one or more sidewall portions 408 can extend and/or protrude from about 10°, about 20°, about 30°, about 40°, about 50°, about 60°, about 70°, about 80°, about 90°, about 100°, about 110°, about 120°, about 130°, about 140°, about 150°, about 160°, about 170°, about 180°, about 190°, about 200°, about 210°, about 220°, about 230°, about 240°, about 250°, about 260°, about 270°, about 280°, about 290°, about 300°, about 310°, about 320°, about 330°, about 340°, about 350°, about 360° of the rim of the base wall portion 402. In certain embodiments, the one or more sidewall portions 408 can extend and/or protrude from a fragment of the rim of the base portion 402, wherein the fragment can be defined as comprising a portion of the rim of the base portion 402 within a range of degrees defined by any of the two above-identified values.

In some embodiments, one or more gaps can be formed between two or more ends of the one or more sidewall portions 408. For example, in certain embodiments, one, two, three, four, five, six, seven, eight, nine, or ten gaps can be formed between two or more ends of one or more sidewall portions 408. In certain embodiments, a first gap can formed between a first end of a first sidewall portion 408 and a first end of a second sidewall portion 408. In some embodiments, a headband portion of a headphone device can be configured to extend from one or more earpiece portions of a headphone device through this first gap. For example, in certain embodiments a width of the first gap can be larger or slightly larger than a width of a headband portion of a headphone device as to allow the headband portion to extend through the first gap. In some embodiments, a width of a first gap of the one or more sidewall portions 408 can be about 1 cm, about 2 cm, about 3 cm, about 4 cm, about 5 cm, about 6 cm, about 7 cm, about 8 cm, 9 cm, about 10 cm, about 11 cm, about 12 cm, about 13 cm, about 14 cm, 15 cm, 16 cm, 17 cm, about 18 cm, 19 cm, about 20 cm, and/or can be within a range defined by any two of the above-identified values.

In some embodiments, a second gap can be formed between a second end of a first sidewall portion 408 and a second end of a second sidewall portion 408. In certain embodiments, having a second gap of the one or more sidewall portions 408 can be advantageous for sliding a cap 400 onto an earpiece portion of a headphone device and/or earphone. Further, in some embodiments, a second gap of the one or more sidewall portions 408 can be advantageous for easily removing and/or sliding on or otherwise attaching the cap onto an earpiece portion of a headphone device and/or earphone. In some embodiments, a width of a second gap of the one or more sidewall portions 408 can be about 1 cm, about 2 cm, about 3 cm, about 4 cm, about 5 cm, about 6 cm, about 7 cm, about 8 cm, 9 cm, about 10 cm, about 11 cm, about 12 cm, about 13 cm, about 14 cm, 15 cm, 16 cm, 17 cm, about 18 cm, 19 cm, about 20 cm, and/or can be within a range defined by any two of the above-identified values.

Locking Portion(s)

In certain embodiments, one or more locking portions 410 further extend and/or protrude from the one or more sidewall portions 408. For example, in some embodiments, a cap 400 can comprise one, two, three, four, five, six, seven, eight, nine, or ten locking portions 410. In certain embodiments, one or more locking portions 410 can extend and/or protrude from one or more sidewall portions 408 at an angle. An angle measured from the inner surface of the one or more locking portions 410 and an inner surface of the one or more sidewall portions 408 can be substantially 90° in some embodiments. In certain embodiments, an angle measured from the inner surface of the one or more locking portions 410 and one or more sidewall portions 408 can be about 0°, about 10°, about 20°, about 30°, about 40°, about 50°, about 60°, about 70°, about 80°, about 90°, about 100°, about 110°, about 120°, about 130°, about 140°, about 150°, about 160°, about 170°, about 180°, or within a range defined by any of the two above-identified values.

In certain embodiments, the one or more locking portions 410 comprise a generally annular shape that surrounds the outer circumference of the one or more sidewall portions 408. In some embodiments, the one or more locking portions 410 comprise one or more circular portions and/or one or more elongated portions. In certain embodiments, the one or more elongated portions can be substantially straight. For example, each of the one or more locking portions 410 can comprise one circular portion and one elongated portion, wherein the elongated portion can be each connected to the circular portion.

In certain embodiments, the one or more locking portions 410 extend and/or protrude from the whole outer rim of the one or more sidewall portions 408. In other embodiments, the one or more locking portions 410 do not encompass the whole rim of the one or more sidewall portions 408 but only extends and/or protrudes from a fragment thereof. For example, in some embodiments, the one or more locking portions 410 can extend and/or protrude from about 10°, about 20°, about 30°, about 40°, about 50°, about 60°, about 70°, about 80°, about 90°, about 100°, about 110°, about 120°, about 130°, about 140°, about 150°, about 160°, about 170°, about 180°, about 190°, about 200°, about 210°, about 220°, about 230°, about 240°, about 250°, about 260°, about 270°, about 280°, about 290°, about 300°, about 310°, about 320°, about 330°, about 340°, about 350°, about 360° of the rim of the one or more sidewall portions 408. In certain embodiments, the one or more locking portions 410 can extend and/or protrude from a fragment of the rim of the one or more sidewall portions 408, wherein the fragment can be defined as comprising a portion of the rim of the one or more sidewall portions 408 within a range of degrees defined by any of the two above-identified values.

In some embodiments, one or more gaps can be formed between two or more ends of the one or more locking portions 410. For example, in certain embodiments, one, two, three, four, five, six, seven, eight, nine, or ten gaps can be formed between two or more ends of one or more locking portions 410. In certain embodiments, a first gap can be formed between a first end of a first locking portion 410 and a first end of a second locking portion 410. In some embodiments, a headband portion of a headphone device can be configured to extend from one or more earpiece portions of a headphone device through this first gap. For example, in certain embodiments a width of the first gap can be larger than a width of a headband portion of a headphone device as to allow the headband portion to extend through this first gap. In some embodiments, a width of a first gap of one or more locking portions 410 can be about 1 cm, about 2 cm, about 3 cm, about 4 cm, about 5 cm, about 6 cm, about 7 cm, about 8 cm, 9 cm, about 10 cm, about 11 cm, about 12 cm, about 13 cm, about 14 cm, 15 cm, 16 cm, 17 cm, about 18 cm, 19 cm, about 20 cm, and/or can be within a range defined by any two of the above identified values. In certain embodiments, a width of a gap or first gap of one or more locking portions 410 can be substantially equal to a width of a gap or first gap of one or more sidewall portions 408.

In some embodiments, a second gap can be formed between a second end of a first locking portion 410 and a second end of a second locking portion 410. In certain embodiments, having a second gap in the one or more locking portions 410 can be advantageous for sliding a cap 400 onto an earpiece portion of a headphone device and/or earphone. Further, in some embodiments, a second gap in the locking portion 410 can be advantageous for easily removing and/or sliding on or otherwise attaching the cap onto an earpiece portion of a headphone and/or earphone device. In certain embodiments, a width of a gap and/or the second gap of one or more locking portions 410 can be substantially equal to a width of a gap of second gap of one or more sidewall portions 408. In some embodiments, a width of a second gap of one or more locking portions 410 can be about 1 cm, about 2 cm, about 3 cm, about 4 cm, about 5 cm, about 6 cm, about 7 cm, about 8 cm, 9 cm, about 10 cm, about 11 cm, about 12 cm, about 13 cm, about 14 cm, 15 cm, 16 cm, 17 cm, about 18 cm, 19 cm, about 20 cm, and/or can be within a range defined by any two of the above-identified values.

Embodiment(s) #4

FIGS. 5A-H illustrate different views of an embodiment of a protective, sound absorbing, and/or decorative cap configured to be coupled in or attached to an earpiece portion of a headphone device and/or earphones. In some embodiments, as shown in FIGS. 5A-H, protective, sound absorbing, and/or decorative cap 500 can comprise one or more base portions 502, one or more sidewall portions 508, and/or one or more locking portions 510. In certain embodiments, the one or more base portions 502, sidewall portions 508, and/or locking portions 510 are formed as a single piece, as to create a cap 500 that is monolithic. In other embodiments, the one or more base portions 502, sidewall portions 508, locking portions 510, and/or any portion(s) thereof and/or any combination thereof are formed separately first and then attached together to create a single cap 500.

Base Portion(s)

In some embodiments, the base portion 502 comprises a generally circular shape. In other embodiments, the base portion 502 can comprise a substantially rectangular, substantially square, substantially triangular, substantially pentagonal, substantially hexagonal, and/or any other shape. In certain embodiments, the base portion 502 can comprise a shape that is substantially equal to and/or is a smaller or larger version of a substantially same shape as an earpiece portion of a headphone and/or earphone.

In certain embodiments, the base portion 502 can comprise one or more surfaces. For example, in certain embodiments, the base portion 502 can comprise an inner surface and an outer surface. The inner surface can be configured to oppositely face an exterior surface of an earpiece portion of a headphone device and/or earphones. In some embodiments, the inner surface of a base portion 502 or a portion thereof can come into contact with an outer surface of an earpiece of a headphone and/or earphone when coupled to the headphone and/or earphone device. The outer surface of the base portion 502, in certain embodiments, comprises one or more decorative artwork and/or other graphical display as discussed above.

Sidewall Portion(s)

In certain embodiments, one or more sidewall portions 508 extend and/or protrude from the base portion 502. For example, in some embodiments, one or more sidewall portions 508 extend and/or protrude from the base portion 502 directly, without one or more connecting portions and/or base wall portions in between. In certain embodiments, one or more sidewall portions 508 can extend and/or protrude from the base portion 502 at an angle. An angle measured from the inner surface of the one or more sidewall portions 508 and an inner surface of the base portion 502 can be substantially 90° in some embodiments. In certain embodiments, an angle measured from the inner surface of the one or more sidewall portions 508 and the inner surface of the base portions 502 can be about 0°, about 10°, about 20°, about 30°, about 40°, about 50°, about 60°, about 70°, about 80°, about 90°, about 100°, about 110°, about 120°, about 130°, about 140°, about 150°, about 160°, about 170°, about 180°, or within a range defined by any of the two above-identified values.

In certain embodiments, the one or more sidewall portions 508 comprise a generally annular shape that surrounds the outer circumference of the base portion 502. In some embodiments, the one or more sidewall portions 408 comprise one or more circular portions and/or one or more elongated portions. In certain embodiments, the one or more elongated portions can be substantially straight. For example, each of the one or more sidewall portions 508 can comprise one circular portion and one elongated portion, wherein the elongated portion can be connected to the circular portion.

In certain embodiments, the one or more sidewall portions 508 extend and/or protrude from the whole outer rim of the base portion 502. In other embodiments, the one or more sidewall portions 508 do not encompass the whole rim of the base portion 502 but only extend and/or protrude from a fragment thereof. For example, in some embodiments, the one or more sidewall portions 508 can extend and/or protrude from about 10°, about 20°, about 30°, about 40°, about 50°, about 60°, about 70°, about 80°, about 90°, about 100°, about 110°, about 120°, about 130°, about 140°, about 150°, about 160°, about 170°, about 180°, about 190°, about 200°, about 210°, about 220°, about 230°, about 240°, about 250°, about 260°, about 270°, about 280°, about 290°, about 300°, about 310°, about 320°, about 330°, about 340°, about 350°, about 360° of the rim of the base wall portion 502. In certain embodiments, the one or more sidewall portions 508 can extend and/or protrude from a fragment of the rim of the base portion 502, wherein the fragment can be defined as comprising a portion of the rim of the base portion 502 within a range of degrees defined by any of the two above-identified values.

In some embodiments, one or more gaps can be formed between two or more ends of the one or more sidewall portions 508. For example, in certain embodiments, one, two, three, four, five, six, seven, eight, nine, or ten gaps can be formed between two or more ends of one or more sidewall portions 508. In certain embodiments, a first gap can formed between a first end of a first sidewall portion 508 and a first end of a second sidewall portion 508. In some embodiments, a headband portion of a headphone device can be configured to extend from one or more earpiece portions of a headphone device through this first gap. For example, in certain embodiments a width of the first gap can be larger or slightly larger than a width of a headband portion of a headphone device as to allow the headband portion to extend through the first gap. In some embodiments, a width of a first gap of the one or more sidewall portions 508 can be about 1 cm, about 2 cm, about 3 cm, about 4 cm, about 5 cm, about 6 cm, about 7 cm, about 8 cm, 9 cm, about 10 cm, about 11 cm, about 12 cm, about 13 cm, about 14 cm, 15 cm, 16 cm, 17 cm, about 18 cm, 19 cm, about 20 cm, and/or can be within a range defined by any two of the above-identified values.

In some embodiments, a second gap can be formed between a second end of a first sidewall portion 508 and a second end of a second sidewall portion 508. In certain embodiments, having a second gap of the one or more sidewall portions 508 can be advantageous for sliding a cap 500 onto an earpiece portion of a headphone device and/or earphone. Further, in some embodiments, a second gap of the one or more sidewall portions 508 can be advantageous for easily removing and/or sliding on or otherwise attaching the cap onto an earpiece portion of a headphone device and/or earphone. In some embodiments, a width of a second gap of the one or more sidewall portions 508 can be about 1 cm, about 2 cm, about 3 cm, about 4 cm, about 5 cm, about 6 cm, about 7 cm, about 8 cm, 9 cm, about 10 cm, about 11 cm, about 12 cm, about 13 cm, about 14 cm, 15 cm, 16 cm, 17 cm, about 18 cm, 19 cm, about 20 cm, and/or can be within a range defined by any two of the above-identified values.

Locking Portion(s)

In certain embodiments, one or more locking portions 510 further extend and/or protrude from the one or more sidewall portions 508. For example, in some embodiments, a cap 500 can comprise one, two, three, four, five, six, seven, eight, nine, or ten locking portions 510. In certain embodiments, one or more locking portions 510 can extend and/or protrude from one or more sidewall portions 508 at an angle. An angle measured from the inner surface of the one or more locking portions 510 and an inner surface of the one or more sidewall portions 508 can be substantially 90° in some embodiments. In certain embodiments, an angle measured from the inner surface of the one or more locking portions 510 and one or more sidewall portions 508 can be about 0°, about 10°, about 20°, about 30°, about 40°, about 50°, about 60°, about 70°, about 80°, about 90°, about 100°, about 110°, about 120°, about 130°, about 140°, about 150°, about 160°, about 170°, about 180°, or within a range defined by any of the two above-identified values.

In certain embodiments, the one or more locking portions 510 comprise a generally annular shape that surrounds the outer circumference of the one or more sidewall portions 508. In some embodiments, the one or more locking portions 510 comprise one or more circular portions and/or one or more elongated portions. In certain embodiments, the one or more elongated portions can be substantially straight. For example, each of the one or more locking portions 510 can comprise one circular portion and one elongated portion, wherein the elongated portion can be each connected to the circular portion.

In certain embodiments, the one or more locking portions 510 extend and/or protrude from the whole outer rim of the one or more sidewall portions 508. In other embodiments, the one or more locking portions 510 do not encompass the whole rim of the one or more sidewall portions 508 but only extends and/or protrudes from a fragment thereof. For example, in some embodiments, the one or more locking portions 510 can extend and/or protrude from about 10°, about 20°, about 30°, about 40°, about 50°, about 60°, about 70°, about 80°, about 90°, about 100°, about 110°, about 120°, about 130°, about 140°, about 150°, about 160°, about 170°, about 180°, about 190°, about 200°, about 210°, about 220°, about 230°, about 240°, about 250°, about 260°, about 270°, about 280°, about 290°, about 300°, about 310°, about 320°, about 330°, about 340°, about 350°, about 360° of the rim of the one or more sidewall portions 508. In certain embodiments, the one or more locking portions 510 can extend and/or protrude from a fragment of the rim of the one or more sidewall portions 508, wherein the fragment can be defined as comprising a portion of the rim of the one or more sidewall portions 508 within a range of degrees defined by any of the two above-identified values.

In some embodiments, one or more gaps can be formed between two or more ends of the one or more locking portions 510. For example, in certain embodiments, one, two, three, four, five, six, seven, eight, nine, or ten gaps can be formed between two or more ends of one or more locking portions 510. In certain embodiments, a first gap can be formed between a first end of a first locking portion 510 and a first end of a second locking portion 510. In some embodiments, a headband portion of a headphone device can be configured to extend from one or more earpiece portions of a headphone device through this first gap. For example, in certain embodiments a width of the first gap can be larger than a width of a headband portion of a headphone device as to allow the headband portion to extend through this first gap. In some embodiments, a width of a first gap of one or more locking portions 510 can be about 1 cm, about 2 cm, about 3 cm, about 4 cm, about 5 cm, about 6 cm, about 7 cm, about 8 cm, 9 cm, about 10 cm, about 11 cm, about 12 cm, about 13 cm, about 14 cm, 15 cm, 16 cm, 17 cm, about 18 cm, 19 cm, about 20 cm, and/or can be within a range defined by any two of the above identified values. In certain embodiments, a width of a gap or first gap of one or more locking portions 510 can be substantially equal to a width of a gap or first gap of one or more sidewall portions 508.

In some embodiments, a second gap can be formed between a second end of a first locking portion 510 and a second end of a second locking portion 510. In certain embodiments, having a second gap in the one or more locking portions 510 can be advantageous for sliding a cap 500 onto an earpiece portion of a headphone device and/or earphone. Further, in some embodiments, a second gap in the locking portion 510 can be advantageous for easily removing and/or sliding on or otherwise attaching the cap onto an earpiece portion of a headphone and/or earphone device. In certain embodiments, a width of a gap and/or the second gap of one or more locking portions 510 can be substantially equal to a width of a gap of second gap of one or more sidewall portions 508. In some embodiments, a width of a second gap of one or more locking portions 510 can be about 1 cm, about 2 cm, about 3 cm, about 4 cm, about 5 cm, about 6 cm, about 7 cm, about 8 cm, 9 cm, about 10 cm, about 11 cm, about 12 cm, about 13 cm, about 14 cm, 15 cm, 16 cm, 17 cm, about 18 cm, 19 cm, about 20 cm, and/or can be within a range defined by any two of the above-identified values.

Embodiment(s) #5

FIGS. 6A-G illustrate different views of an embodiment of a protective, sound absorbing, and/or decorative cap configured to be coupled in or attached to an earpiece portion of a headphone device and/or earphones. In some embodiments, as shown in FIGS. 6A-G, a protective, sound absorbing, and/or decorative cap 600 can comprise one or more base portions 602, one or more sidewall portions 608, and/or one or more locking portions 610. In certain embodiments, the one or more base portions 602, sidewall portions 608, and/or locking portions 610 are formed as a single piece, as to create a cap 600 that is monolithic. In other embodiments, the one or more base portions 602, sidewall portions 608, locking portions 610, and/or any portion(s) thereof and/or any combination thereof are formed separately first and then attached together to create a single cap 600.

Base Portion(s)

In some embodiments, the base portion 602 comprises a generally circular shape. In other embodiments, the base portion 602 can comprise a substantially rectangular, substantially square, substantially triangular, substantially pentagonal, substantially hexagonal, and/or any other shape. In certain embodiments, the base portion 602 can comprise a shape that is substantially equal to and/or is a smaller or larger version of a substantially same shape as an earpiece portion of a headphone and/or earphone.

In certain embodiments, the base portion 602 can comprise one or more surfaces. For example, in certain embodiments, the base portion 602 can comprise an inner surface and an outer surface. The inner surface can be configured to oppositely face an exterior surface of an earpiece portion of a headphone device and/or earphones. In some embodiments, the inner surface of a base portion 602 or a portion thereof can come into contact with an outer surface of an earpiece of a headphone and/or earphone when coupled to the headphone and/or earphone device. The outer surface of the base portion 602, in certain embodiments, comprises one or more decorative artwork and/or other graphical display as discussed above.

Sidewall Portion(s)

In certain embodiments, one or more sidewall portions 608 extend and/or protrude from the base portion 602. For example, in some embodiments, one or more sidewall portions 608 extend and/or protrude from the base portion 602 directly, without one or more connecting portions and/or base wall portions in between. In certain embodiments, one or more sidewall portions 608 can extend and/or protrude from the base portion 602 at an angle. An angle measured from the inner surface of the one or more sidewall portions 608 and an inner surface of the base portion 602 can be substantially 90° in some embodiments. In certain embodiments, an angle measured from the inner surface of the one or more sidewall portions 608 and the inner surface of the base portions 602 can be about 0°, about 10°, about 20°, about 30°, about 40°, about 50°, about 60°, about 70°, about 80°, about 90°, about 100°, about 110°, about 120°, about 130°, about 140°, about 150°, about 160°, about 170°, about 180°, or within a range defined by any of the two above-identified values.

In certain embodiments, the one or more sidewall portions 608 comprise a generally annular shape that surrounds the outer circumference of the base portion 602. In some embodiments, the one or more sidewall portions 608 comprise one or more circular portions and/or one or more elongated portions. In certain embodiments, the one or more elongated portions or a portion thereof can be substantially straight. For example, a cap 600 can comprise one continuous sidewall portion 608, wherein the sidewall portion 608 comprises one circular portion and two elongated portions, wherein the two elongated portions can be connected to each end of the circular portion.

In certain embodiments, the one or more sidewall portions 608 extend and/or protrude from the whole outer rim of the base portion 602. In other embodiments, the one or more sidewall portions 608 do not encompass the whole rim of the base portion 602 but only extend and/or protrude from a fragment thereof. For example, in some embodiments, the one or more sidewall portions 608 can extend and/or protrude from about 10°, about 20°, about 30°, about 40°, about 50°, about 60°, about 70°, about 80°, about 90°, about 100°, about 110°, about 120°, about 130°, about 140°, about 150°, about 160°, about 170°, about 180°, about 190°, about 200°, about 210°, about 220°, about 230°, about 240°, about 250°, about 260°, about 270°, about 280°, about 290°, about 300°, about 310°, about 320°, about 330°, about 340°, about 350°, about 360° of the rim of the base wall portion 602. In certain embodiments, the one or more sidewall portions 608 can extend and/or protrude from a fragment of the rim of the base portion 602, wherein the fragment can be defined as comprising a portion of the rim of the base portion 602 within a range of degrees defined by any of the two above-identified values.

In some embodiments, one or more gaps can be formed between two or more ends of the one or more sidewall portions 608. For example, in certain embodiments, one, two, three, four, five, six, seven, eight, nine, or ten gaps can be formed between two or more ends of one or more sidewall portions 608. In certain embodiments, a gap can be formed between a first end of a sidewall portion 608 and a second end of the sidewall portion 608. In some embodiments, a headband portion of a headphone device can be configured to extend from one or more earpiece portions of a headphone device through this first gap. For example, in certain embodiments a width of the first gap can be larger or slightly larger than a width of a headband portion of a headphone device as to allow the headband portion to extend through the first gap. In some embodiments, a width of a gap of the one or more sidewall portions 608 can be about 1 cm, about 2 cm, about 3 cm, about 4 cm, about 5 cm, about 6 cm, about 7 cm, about 8 cm, 9 cm, about 10 cm, about 11 cm, about 12 cm, about 13 cm, about 14 cm, 15 cm, 16 cm, 17 cm, about 18 cm, 19 cm, about 20 cm, and/or can be within a range defined by any two of the above-identified values.

Locking Portion(s)

In certain embodiments, one or more locking portions 610 further extend and/or protrude from the one or more sidewall portions 608. For example, in some embodiments, a cap 600 can comprise one, two, three, four, five, six, seven, eight, nine, or ten locking portions 610. In certain embodiments, one or more locking portions 610 can extend and/or protrude from one or more sidewall portions 608 at an angle. An angle measured from the inner surface of the one or more locking portions 610 and an inner surface of the one or more sidewall portions 608 can be substantially 90° in some embodiments. In certain embodiments, an angle measured from the inner surface of the one or more locking portions 610 and one or more sidewall portions 608 can be about 0°, about 10°, about 20°, about 30°, about 40°, about 50°, about 60°, about 70°, about 80°, about 90°, about 100°, about 110°, about 120°, about 130°, about 140°, about 150°, about 160°, about 170°, about 180°, or within a range defined by any of the two above-identified values.

In certain embodiments, the one or more locking portions 610 comprise a generally annular shape that surrounds the outer circumference of the one or more sidewall portions 608. In some embodiments, the one or more locking portions 610 comprise one or more circular portions and/or one or more elongated portions. In certain embodiments, the one or more elongated portions can be substantially straight. For example, a cap 600 can comprise a single locking portion 610 comprising one circular portion and two elongated portions, wherein the two elongated portions can be each connected to two different ends of the circular portion.

In certain embodiments, the one or more locking portions 610 extend and/or protrude from the whole outer rim of the one or more sidewall portions 608. In other embodiments, the one or more locking portions 610 do not encompass the whole rim of the one or more sidewall portions 608 but only extends and/or protrudes from a fragment thereof. For example, in some embodiments, the one or more locking portions 610 can extend and/or protrude from about 10°, about 20°, about 30°, about 40°, about 50°, about 60°, about 70°, about 80°, about 90°, about 100°, about 110°, about 120°, about 130°, about 140°, about 150°, about 160°, about 170°, about 180°, about 190°, about 200°, about 210°, about 220°, about 230°, about 240°, about 250°, about 260°, about 270°, about 280°, about 290°, about 300°, about 310°, about 320°, about 330°, about 340°, about 350°, about 360° of the rim of the one or more sidewall portions 608. In certain embodiments, the one or more locking portions 610 can extend and/or protrude from a fragment of the rim of the one or more sidewall portions 608, wherein the fragment can be defined as comprising a portion of the rim of the one or more sidewall portions 608 within a range of degrees defined by any of the two above-identified values.

In some embodiments, one or more gaps can be formed between two or more ends of the one or more locking portions 610. For example, in certain embodiments, one, two, three, four, five, six, seven, eight, nine, or ten gaps can be formed between two or more ends of one or more locking portions 610. In certain embodiments, a gap can be formed between a first end of a locking portion 610 and a second end of the locking portion 610. In some embodiments, a headband portion of a headphone device can be configured to extend from one or more earpiece portions of a headphone device through this gap. For example, in certain embodiments a width of the gap can be larger than a width of a headband portion of a headphone device as to allow the headband portion to extend through this first gap. In some embodiments, a width of a gap of one or more locking portions 610 can be about 1 cm, about 2 cm, about 3 cm, about 4 cm, about 5 cm, about 6 cm, about 7 cm, about 8 cm, 9 cm, about 10 cm, about 11 cm, about 12 cm, about 13 cm, about 14 cm, 15 cm, 16 cm, 17 cm, about 18 cm, 19 cm, about 20 cm, and/or can be within a range defined by any two of the above identified values. In certain embodiments, a width of a gap of one or more locking portions 610 can be substantially equal to a width of a gap of one or more sidewall portions 608.

Embodiment(s) #6

FIGS. 7A-H illustrate different views of an embodiment of a protective, sound absorbing, and/or decorative cap configured to be coupled in or attached to an earpiece portion of a headphone device and/or earphones. In some embodiments, as shown in FIGS. 7A-H, a protective, sound absorbing, and/or decorative cap 700 can comprise one or more base portions 702, one or more sidewall portions 708, and/or one or more locking portions 710. In certain embodiments, the one or more base portions 702, sidewall portions 708, and/or locking portions 710 are formed as a single piece, as to create a cap 700 that is monolithic. In other embodiments, the one or more base portions 702, sidewall portions 708, locking portions 710, and/or any portion(s) thereof and/or any combination thereof are formed separately first and then attached together to create a single cap 700.

Base Portion(s)

In some embodiments, the base portion 702 comprises a generally circular shape. In other embodiments, the base portion 702 can comprise a substantially rectangular, substantially square, substantially triangular, substantially pentagonal, substantially hexagonal, and/or any other shape. In certain embodiments, the base portion 702 can comprise a shape that is substantially equal to and/or is a smaller or larger version of a substantially same shape as an earpiece portion of a headphone and/or earphone.

In certain embodiments, the base portion 702 can comprise one or more surfaces. For example, in certain embodiments, the base portion 702 can comprise an inner surface and an outer surface. The inner surface can be configured to oppositely face an exterior surface of an earpiece portion of a headphone device and/or earphones. In some embodiments, the inner surface of a base portion 702 or a portion thereof can come into contact with an outer surface of an earpiece of a headphone and/or earphone when coupled to the headphone and/or earphone device. The outer surface of the base portion 702, in certain embodiments, comprises one or more decorative artwork and/or other graphical display as discussed above.

Sidewall Portion(s)

In certain embodiments, one or more sidewall portions 708 extend and/or protrude from the base portion 702. For example, in some embodiments, one or more sidewall portions 708 extend and/or protrude from the base portion 702 directly, without one or more connecting portions and/or base wall portions in between. In certain embodiments, one or more sidewall portions 708 can extend and/or protrude from the base portion 702 at an angle. An angle measured from the inner surface of the one or more sidewall portions 708 and an inner surface of the base portion 702 can be substantially 90° in some embodiments. In certain embodiments, an angle measured from the inner surface of the one or more sidewall portions 708 and the inner surface of the base portions 702 can be about 0°, about 10°, about 20°, about 30°, about 40°, about 50°, about 60°, about 70°, about 80°, about 90°, about 100°, about 110°, about 120°, about 130°, about 140°, about 150°, about 160°, about 170°, about 180°, or within a range defined by any of the two above-identified values.

In certain embodiments, the one or more sidewall portions 708 comprise a generally annular shape that surrounds the outer circumference of the base portion 702. In some embodiments, the one or more sidewall portions 708 comprise one or more circular portions and/or one or more elongated portions. In certain embodiments, the one or more elongated portions or a portion thereof can be substantially straight. For example, a cap 700 can comprise one continuous sidewall portion 708, wherein the sidewall portion 708 comprises one circular portion and two elongated portions, wherein the two elongated portions can be connected to each end of the circular portion.

In certain embodiments, the one or more sidewall portions 708 extend and/or protrude from the whole outer rim of the base portion 702. In other embodiments, the one or more sidewall portions 708 do not encompass the whole rim of the base portion 702 but only extend and/or protrude from a fragment thereof. For example, in some embodiments, the one or more sidewall portions 708 can extend and/or protrude from about 10°, about 20°, about 30°, about 40°, about 50°, about 60°, about 70°, about 80°, about 90°, about 100°, about 110°, about 120°, about 130°, about 140°, about 150°, about 160°, about 170°, about 180°, about 190°, about 200°, about 210°, about 220°, about 230°, about 240°, about 250°, about 260°, about 270°, about 280°, about 290°, about 300°, about 310°, about 320°, about 330°, about 340°, about 350°, about 360° of the rim of the base wall portion 702. In certain embodiments, the one or more sidewall portions 708 can extend and/or protrude from a fragment of the rim of the base portion 702, wherein the fragment can be defined as comprising a portion of the rim of the base portion 702 within a range of degrees defined by any of the two above-identified values.

In some embodiments, one or more gaps can be formed between two or more ends of the one or more sidewall portions 708. For example, in certain embodiments, one, two, three, four, five, six, seven, eight, nine, or ten gaps can be formed between two or more ends of one or more sidewall portions 708. In certain embodiments, a gap can be formed between a first end of a sidewall portion 708 and a second end of the sidewall portion 708. In some embodiments, a headband portion of a headphone device can be configured to extend from one or more earpiece portions of a headphone device through this first gap. For example, in certain embodiments a width of the first gap can be larger or slightly larger than a width of a headband portion of a headphone device as to allow the headband portion to extend through the first gap. In some embodiments, a width of a gap of the one or more sidewall portions 708 can be about 1 cm, about 2 cm, about 3 cm, about 4 cm, about 5 cm, about 6 cm, about 7 cm, about 8 cm, 9 cm, about 10 cm, about 11 cm, about 12 cm, about 13 cm, about 14 cm, 15 cm, 16 cm, 17 cm, about 18 cm, 19 cm, about 20 cm, and/or can be within a range defined by any two of the above-identified values.

Locking Portion(s)

In certain embodiments, one or more locking portions 710 further extend and/or protrude from the one or more sidewall portions 708. For example, in some embodiments, a cap 700 can comprise one, two, three, four, five, six, seven, eight, nine, or ten locking portions 710. In certain embodiments, one or more locking portions 710 can extend and/or protrude from one or more sidewall portions 708 at an angle. An angle measured from the inner surface of the one or more locking portions 710 and an inner surface of the one or more sidewall portions 708 can be substantially 90° in some embodiments. In certain embodiments, an angle measured from the inner surface of the one or more locking portions 710 and one or more sidewall portions 708 can be about 0°, about 10°, about 20°, about 30°, about 40°, about 50°, about 60°, about 70°, about 80°, about 90°, about 100°, about 110°, about 120°, about 130°, about 140°, about 150°, about 160°, about 170°, about 180°, or within a range defined by any of the two above-identified values.

In certain embodiments, the one or more locking portions 710 comprise a generally annular shape. In some embodiments, the one or more locking portions 710 can extend and/or protrude from a middle portion of the one or more sidewall portions 708. For example, in certain embodiments, one or more locking portions 710 can extend and/or protrude from a portion of the one or more sidewall portions 708, wherein the portion is located about 1/10, about 2/10, about 3/10, about 4/10, about 5/10, about 6/10, about 7/10, about 8/10, about 10/10 from a bottom of the one or more sidewall portions 708 that connects with one or more base portions 702. In some embodiments, the one or more side portions 708 can extend and/or protrude from a portion of the one or more sidewall portions 708, wherein the portion is located within a range defined two of the above-identified values. In some embodiments, the location from which the one or more locking portions 710 extend and/or protrude from the one or more sidewall portions 708 can be configured to match or substantially match the location of one or more grooves present in an earpiece portion of a headphone and/or earphone device.

In some embodiments, the one or more locking portions 710 comprise one or more circular portions and/or one or more elongated portions. In certain embodiments, the one or more elongated portions can be substantially straight. For example, a cap 700 can comprise a single locking portion 710 comprising one circular portion and two elongated portions, wherein the two elongated portions can be each connected to two different ends of the circular portion.

In certain embodiments, the one or more locking portions 710 extend and/or protrude from the whole circumference of the one or more sidewall portions 708. In other embodiments, the one or more locking portions 710 do not encompass the whole rim of the one or more sidewall portions 708 but only extends and/or protrudes from a fragment thereof. For example, in some embodiments, the one or more locking portions 710 can extend and/or protrude from about 10°, about 20°, about 30°, about 40°, about 50°, about 60°, about 70°, about 80°, about 90°, about 100°, about 110°, about 120°, about 130°, about 140°, about 150°, about 160°, about 170°, about 180°, about 190°, about 200°, about 210°, about 220°, about 230°, about 240°, about 250°, about 260°, about 270°, about 280°, about 290°, about 300°, about 310°, about 320°, about 330°, about 340°, about 350°, about 360° of the circumference of the one or more sidewall portions 708. In certain embodiments, the one or more locking portions 710 can extend and/or protrude from a fragment of the circumference of the one or more sidewall portions 708, wherein the fragment can be defined as comprising a portion of the circumference of the one or more sidewall portions 708 within a range of degrees defined by any of the two above-identified values.

In some embodiments, one or more gaps can be formed between two or more ends of the one or more locking portions 710. For example, in certain embodiments, one, two, three, four, five, six, seven, eight, nine, or ten gaps can be formed between two or more ends of one or more locking portions 710. In certain embodiments, a gap can be formed between a first end of a locking portion 710 and a second end of the locking portion 710. In some embodiments, a headband portion of a headphone device can be configured to extend from one or more earpiece portions of a headphone device through this gap. For example, in certain embodiments a width of the gap can be larger than a width of a headband portion of a headphone device as to allow the headband portion to extend through this first gap. In some embodiments, a width of a gap of one or more locking portions 710 can be about 1 cm, about 2 cm, about 3 cm, about 4 cm, about 5 cm, about 6 cm, about 7 cm, about 8 cm, 9 cm, about 10 cm, about 11 cm, about 12 cm, about 13 cm, about 14 cm, 15 cm, 16 cm, 17 cm, about 18 cm, 19 cm, about 20 cm, and/or can be within a range defined by any two of the above identified values. In certain embodiments, a width of a gap of one or more locking portions 710 can be substantially equal to a width of a gap of one or more sidewall portions 708.

Embodiment(s) #7

FIGS. 8A-H illustrate different views of an embodiment of a protective, sound absorbing, and/or decorative cap configured to be coupled in or attached to an earpiece portion of a headphone device and/or earphones. In some embodiments, as shown in FIGS. 8A-H, a protective, sound absorbing, and/or decorative cap 800 can comprise one or more base portions 802. In some embodiments, a cap 800 can be monolithic. In other embodiments, one or more portions of a cap 800 can be formed separately first and then attached together to create a single cap 800.

Base Portion(s)

In some embodiments, the base portion 802 comprises a generally circular shape. In other embodiments, the base portion 802 can comprise a substantially rectangular, substantially square, substantially triangular, substantially pentagonal, substantially hexagonal, and/or any other shape. In certain embodiments, the base portion 802 can comprise a shape that is substantially equal to and/or is a smaller or larger version of a substantially same shape as an earpiece portion of a headphone and/or earphone.

In certain embodiments, the base portion 802 can comprise one or more surfaces. For example, in certain embodiments, the base portion 802 can comprise an inner surface and an outer surface. The inner surface can be configured to oppositely face an exterior surface of an earpiece portion of a headphone device and/or earphones. In some embodiments, the inner surface of a base portion 802 or a portion thereof can come into contact with an outer surface of an earpiece of a headphone and/or earphone when coupled to the headphone and/or earphone device. The outer surface of the base portion 802, in certain embodiments, comprises one or more decorative artwork and/or other graphical display as discussed above.

In some embodiments, an inner surface and outer surface of a base portion 802 can comprise substantially the same shape but are different sizes thereof. In certain embodiments, the inner surface and outer surface of a base portion 802 are substantially the same size and/or shape. For example, in certain embodiments, an inner surface of a base portion 802 can be about 100%, about 99%, about 98%, about 97%, about 96%, about 95%, about 94%, about 93%, about 92%, about 91%, about 90%, about 85%, about 80%, about 75%, about 70%, about 60%, about 50%, about 40%, about 30%, about 20%, about 10% of the size of the outer surface of a base portion 802 or can be of a size within a range defined by two of the above-identified values. In some embodiments, an outer surface of a base portion 802 can be about 100%, about 99%, about 98%, about 97%, about 96%, about 95%, about 94%, about 93%, about 92%, about 91%, about 90%, about 85%, about 80%, about 75%, about 70%, about 60%, about 50%, about 40%, about 30%, about 20%, about 10% of the size of the inner surface of a base portion 802 or can be of a size within a range defined by two of the above-identified values.

In some embodiments, one or more base portions 802 can further comprise one or more side surfaces. In certain embodiments, the one or more side surfaces can extend from an inner surface and/or outer surface of a base portion 802 at an angle. For example, in some embodiments, an angle between a side surface and an inner surface and/or outer surface of a base portion 802 can about 10°, about 20°, about 30°, about 40°, about 50°, about 60°, about 70°, about 80°, about 90°, about 100°, about 110°, about 120°, about 130°, about 140°, about 150°, about 160°, about 170°, and/or within a range defined by two of the above-identified values.

Embodiment(s) #8

As discussed above, in some embodiments, a protective, sound absorbing, and/or decorative device can be configured to be attached to an earphone device. FIGS. 9A-H illustrate an embodiment of a protective, sound absorbing, and/or decorative device attached to an earphone device 900. As shown in FIGS. 9A-9H, an earpiece device can comprise an earbud portion 901 configured for positioning within an ear of a user. In certain embodiments, an earpiece device can further comprise a neck portion 903 and/or a base portion 902. In some embodiments, a neck portion 903 can be configured to be coupled to a base portion 902.

In some embodiments, the base portion 902 can be part of and/or substantially is a protective, sound absorbing, and/or decorative device and/or cap as discussed above. In certain embodiments, the base portion 902 and/or device and/or cap can be configured to be removably, semi-permanently, and/or permanently attached to the earphone device. In certain embodiments, the base portion 902, neck portion 903, and/or earbud portion 901 and/or an outer shell thereof can be molded or otherwise formed together. In other embodiments, the base portion 902, neck portion 903, and/or earbud portion 901 and/or an outer shell thereof can be molded or otherwise formed separately at first and then combined at a later point in time.

In some embodiments, the earpiece device 900 can be configured to allow the neck portion 903 to be adjustable relative to the base portion 902. For example, the neck portion 903 can be configured to rotate about and/or be angled relative to the base portion 902. In an embodiment, the neck portion 903 can be configured to be positioned backwards and forwards and/or can be positioned from side to side relative to the base portion 902. In an embodiment, the neck portion 903 can be configured to have 360 degree motion relative to the base portion 902.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. Additionally, the skilled artisan will recognize that any of the above-described methods can be carried out using any appropriate apparatus. Further, the disclosure herein of any particular feature, aspect, method, property, characteristic, quality, attribute, element, or the like in connection with an embodiment can be used in all other embodiments set forth herein. For all of the embodiments described herein the steps of the methods need not be performed sequentially. Thus, it is intended that the scope of the present invention herein disclosed should not be limited by the particular disclosed embodiments described above.

What is claimed is:

1. A monolithic protective cap configured to be removably coupled to an earpiece portion of a headphone, wherein the earpiece portion comprises a circular façade, the cap comprising:

a generally circular base portion comprising an inner surface and an outer surface, wherein the outer surface comprises one or more graphics;

a base wall portion extending from an outer circumference of the base portion, wherein the base wall portion extends from the base portion at a first angle measured between the base wall portion and the inner surface of the base portion, wherein the first angle is greater than 90 degrees, wherein the base wall portion comprises a fragment of a generally annular shape, and wherein the base wall portion extends from only a fragment of the outer circumference of the base portion, thereby forming a first gap between a first end of the base wall portion and a second end of the base wall portion;

a first connecting portion and a second connecting portion, wherein the first and second connecting portions extend from the base wall portion at a second angle measured between an outer surface of the base wall portion and outer surfaces of the first and second connecting portions, wherein the second angle is greater than 90 degrees, wherein the first and second connecting portions comprise fragments of a generally annular shape, and wherein the first and second connecting portions each extend from only a portion of the base wall portion, wherein a first end of the first connecting portion and first end of the second connecting portion form a second gap, wherein a width of the second gap is larger than a width of a headband portion of the headphone as to allow the headband portion to extend from the earpiece portion of the headphone through the second gap, and wherein a third gap is formed by a second end of the first connecting portion and a second end of the second connecting portion, wherein a width of the third gap and a width of the first gap are substantially equal;

a first sidewall portion and a second sidewall portion, wherein the first and second sidewall portions are connected to the base wall portion via the first and second connecting portions respectively, wherein the first and second sidewall portions are substantially perpendicular to a plane parallel to the base portion, wherein a first end of the first sidewall portion and a first end of the second sidewall portion form a fourth gap, wherein a width of the fourth gap and the width of the second gap are substantially equal, and wherein a fifth gap is formed by a second end of the first sidewall portion and a second end of the second sidewall portion, wherein a width of the fifth gap and the widths of the first and third gaps are substantially equal; and a first locking portion and a second locking portion, wherein the first and second locking portions extend from the first and second sidewall portions respectively, wherein the first and second locking portions are substantially perpendicular to the first and second sidewall portions, and wherein the first and second locking portions are substantially parallel to the base portion, wherein the first and second locking portions each further comprises:

a curved portion, wherein the curved portion comprises a fragment of a generally annular shape, wherein a first end of the curved portion of the first locking portion and a first end of the curved portion of the second locking portion form a sixth gap, wherein a width of the sixth gap is substantially equal to the width of the second and fourth gaps; and a straight portion, wherein the straight portion is elongated from a second end of the curved portion of the first locking portion and a second end of the second locking portion, wherein a first end of the straight portion of the first locking portion and a first end of the straight portion of the second locking portion form a seventh gap, wherein a width of the seventh gap is substantially equal to the widths of the first, third, and fifth gaps, wherein the curved portion and straight portion are configured to allow the cap to be slid on over the earpiece portion of the headphone to protectively cover the earpiece portion, and wherein the curved portion and straight portion of the first and second locking portions comprise a fragment of a generally elongated annular shape, wherein an inner circumference of the generally elongated annular shape is smaller than a circumference of the earpiece of the headphone, thereby maintaining the cap over the earpiece at a substantially constant position with respect to the earpiece, wherein the protective cap is shaped such that a layer of air is formed between the inner surface of the base portion and the earpiece portion of the headphone when the cap is slid onto the earpiece portion, thereby decreasing friction between the cap and the earpiece portion to allow for easy removal and installation of the cap, and thereby preventing damage to the earpiece when removing or installing the cap, wherein the base portion comprises sound absorbing properties, thereby preventing outside noise from entering the earpiece of the headphone and further preventing sound from the headphone from escaping.

2. The monolithic protective cap of claim 1, wherein the monolithic protective cap is configured to be slid on over the earpiece portion in a general direction from a top end of the earpiece portion towards a bottom end of the earpiece portion, wherein the top end of the earpiece portion is closer to the headband portion compared to the bottom end of the earpiece portion.

3. The monolithic protective cap of claim 1, wherein the monolithic protective cap is configured to be slid on over the earpiece portion in a general direction from a bottom end of the earpiece portion towards a top end of the earpiece portion, wherein the top end of the earpiece portion is closer to the headband portion compared to the bottom end of the earpiece portion.

4. The monolithic protective cap of claim 1, wherein the monolithic protective cap is made of a rigid, plastic material.

5. The monolithic protective cap of claim 1, wherein monolithic protective cap further comprises one or more printed circuit boards.

6. The monolithic protective cap of claim 1, wherein the base portion further comprises one or more electronic display modules configured to display the one or more graphics.

7. The monolithic protective cap of claim 6, wherein the one or more graphics or one or more features thereof is configured to change at a speed corresponding to a beats per minute of music being played by the headphone.

8. The monolithic protective cap of claim 6, the cap further comprising one or more input buttons, wherein the one or more input buttons are configured to receive one or more input commands from a user, and wherein the one or more input buttons are further configured to initiate execution of the one or more input commands.

9. The monolithic protective cap of claim 8, wherein the one or more input commands comprises selecting one of the one or more graphics to be displayed on the base portion.

10. The monolithic protective cap of claim 6, wherein the one or more electronic display modules comprise an LED display.

11. A monolithic protective cap configured to be removably coupled to an earpiece portion of a headphone, wherein the earpiece portion comprises a circular façade, the cap comprising:

a generally circular base portion comprising an inner surface and an outer surface, wherein the outer further comprises one or more graphics;

a first sidewall portion and a second sidewall portion, wherein the first and second sidewall portions extend from the base portion, wherein the first and second sidewall portions are substantially perpendicular to the base portion, wherein a first end of the first sidewall portion and a first end of the second sidewall portion form a first gap, and wherein a second end of the first sidewall portion and a second end of the second sidewall portion form a second gap, wherein the first and second sidewall portions each further comprises:

a curved portion, wherein the curved portion of the first and second sidewall portions comprises a fragment of a generally annular shape, wherein a first end of the curved portion of the first sidewall portion and a first end of the curved portion of the second sidewall locking portion form the first gap; and a straight portion, wherein the straight portion of the first and second sidewall portions is elongated from a second end of the curved portion of the first sidewall portion and a second end of the second sidewall portion, wherein a first end of the straight portion of the first sidewall portion and a first end of the straight portion of the second sidewall portion form the second gap; and a first locking portion and a second locking portion, wherein the first and second locking portions extend from the first and second sidewall portions respectively, wherein the first and second locking portions are substantially perpendicular to the first and second sidewall portions, and wherein the first and second locking portions are substantially parallel to the base portion, wherein the first and second locking portions each further comprises:

a curved portion, wherein the curved portion of the first and second locking portions comprises a fragment of a generally annular shape, wherein a first end of the curved portion of the first locking portion and a first end of the curved portion of the second locking portion form a third gap, wherein a width of the third gap is substantially equal to the width of the first gap; and a straight portion, wherein the straight portion is elongated from a second end of the curved portion of the first locking portion and a second end of the second locking portion, wherein a first end of the straight portion of the first locking portion and a first end of the straight portion of the second locking portion form a fourth gap, wherein a width of the fourth gap is substantially equal to the width of the second gap, wherein the curved portion and straight portion of the first and second locking portions are configured to allow the cap to be slid on over the earpiece portion of the headphone to protectively cover the earpiece portion, and wherein the curved portion and straight portion of the first and second locking portions comprise a fragment of a generally elongated annular shape, wherein an inner circumference of the generally elongated annular shape is smaller than a circumference of the earpiece of the headphone, thereby maintaining the cap over the earpiece at a substantially constant position with respect to the earpiece, wherein the protective cap is shaped such that a layer of air is formed between the inner surface of the base portion and the earpiece portion of the headphone when the cap is slid onto the earpiece portion, thereby decreasing friction between the cap and the earpiece portion to allow for easy removal and installation of the cap, and thereby preventing damage to the earpiece when removing or installing the cap, wherein the base portion comprises sound absorbing properties, thereby preventing outside noise from entering the earpiece of the headphone and further preventing sound from the headphone from escaping.

12. The monolithic protective cap of claim 11, wherein the monolithic protective cap is configured to be slid on over the earpiece portion in a general direction from a top end of the earpiece portion towards a bottom end of the earpiece portion, wherein the top end of the earpiece portion is closer to the headband portion compared to the bottom end of the earpiece portion.

13. The monolithic protective cap of claim 11, wherein the monolithic protective cap is configured to be slid on over the earpiece portion in a general direction from a bottom end of the earpiece portion towards a top end of the earpiece portion, wherein the top end of the earpiece portion is closer to the headband portion compared to the bottom end of the earpiece portion.

14. The monolithic protective cap of claim 11, wherein the monolithic protective cap is made of a rigid, plastic material.

15. The monolithic protective cap of claim 11, wherein monolithic protective cap further comprises one or more printed circuit boards.

16. The monolithic protective cap of claim 11, wherein the base portion further comprises one or more electronic display modules configured to display the one or more graphics.

17. The monolithic protective cap of claim 16, wherein the one or more graphics or one or more features thereof is configured to change at a speed corresponding to a beats per minute of music being played by the headphone.

18. The monolithic protective cap of claim 16, the cap further comprising one or more input buttons, wherein the one or more input buttons are configured to receive one or more input commands from a user, and wherein the one or more input buttons are further configured to initiate execution of the one or more input commands.

19. The monolithic protective cap of claim 18, wherein the one or more input commands comprises selecting one of the one or more graphics to be displayed on the base portion.

20. The monolithic protective cap of claim 16, wherein the one or more electronic display modules comprise an LED display.

* * * * *